US010682877B2

(12) United States Patent
Schmid et al.

(10) Patent No.: US 10,682,877 B2
(45) **Date of Patent: *Jun. 16, 2020**

(54) OPTICAL EFFECT LAYERS SHOWING A VIEWING ANGLE DEPENDENT OPTICAL EFFECT, PROCESSES AND DEVICES FOR THEIR PRODUCTION, ITEMS CARRYING AN OPTICAL EFFECT LAYER, AND USES THEREOF

(71) Applicant: SICPA HOLDING SA, Prilly (CH)

(72) Inventors: Mathieu Schmid, Lausanne (CH); Evgeny Loginov, Renens (CH); Claude Alain Despland, Prilly (CH); Pierre Degott, Crissier (CH)

(73) Assignee: SICPA HOLDING SA, Prilly (CH)

( * ) Notice: Subject to any disclaimer, the term of this patent is extended or adjusted under 35 U.S.C. 154(b) by 218 days.

This patent is subject to a terminal disclaimer.

(21) Appl. No.: 15/703,063

(22) Filed: Sep. 13, 2017

(65) Prior Publication Data

US 2018/0093518 A1 Apr. 5, 2018

Related U.S. Application Data

(62) Division of application No. 14/759,836, filed as application No. PCT/EP2013/077698 on Dec. 20, 2013, now Pat. No. 9,849,713.

(30) Foreign Application Priority Data

Jan. 9, 2013 (EP) ..... 13150693

(51) Int. Cl.
*B42D 25/30* (2014.01)
*H01F 7/02* (2006.01)
(Continued)

(52) U.S. Cl.
CPC ..... *B42D 25/30* (2014.10); *B05D 3/20* (2013.01); *B05D 3/207* (2013.01); *B41M 3/148* (2013.01);
(Continued)

(58) Field of Classification Search
None
See application file for complete search history.

(56) References Cited

U.S. PATENT DOCUMENTS 2,570,856 A 10/1951 Carlton et al.
3,676,273 A 7/1972 Graves
(Continued)

FOREIGN PATENT DOCUMENTS

BE 678945 10/1966
CN 1735517 2/2006
(Continued)

OTHER PUBLICATIONS

Japanese office action in counterpart Japanese Application No. 2015-551163 dated Jul. 10, 2018 (along with English language translation).
(Continued)

*Primary Examiner* — Kevin M Bernatz
(74) *Attorney, Agent, or Firm* — Muncy, Geissler, Olds & Lowe, P.C.

(57) ABSTRACT

Magnetic field-generating device including a plurality of elements selected from magnets and pole pieces and including at least one magnet. Plurality of elements are (i) located below supporting surface or space configured to receive a substrate acting as supporting surface or (ii) forming a supporting surface, and are configured to provide a magnetic field with magnetic field lines running substantially parallel to supporting surface or space in two or more areas above supporting surface or space. Two or more areas form nested
(Continued)

loop-shaped areas surrounding a central area; and/or the plurality of elements include a plurality of magnets, which are rotatable around an axis of rotation such that areas with field lines running substantially parallel to supporting surface or space combine upon rotation around axis of rotation, thereby forming, upon rotation around axis of rotation, a plurality of nested loop-shaped areas surrounding one central area.

9 Claims, 17 Drawing Sheets

(51) Int. Cl.

| | |
|---|---|
| ***H01F 41/16*** | (2006.01) |
| ***B42D 25/369*** | (2014.01) |
| ***B05D 3/00*** | (2006.01) |
| ***B41M 3/14*** | (2006.01) |
| ***B42D 25/29*** | (2014.01) |

(52) U.S. Cl.
CPC ..... *B42D 25/29* (2014.10); *B42D 25/369* (2014.10); *H01F 7/0273* (2013.01); *H01F 7/0278* (2013.01); *H01F 41/16* (2013.01); *Y10T 428/24273* (2015.01)

(56) References Cited

U.S. PATENT DOCUMENTS

| | | | | |
|---|---|---|---|---|
| 3,791,864 | A | 2/1974 | Steingroever | |
| 4,838,648 | A | 6/1989 | Phillips et al. | |
| 5,079,085 | A | 1/1992 | Hashimoto et al. | |
| 5,364,689 | A | 11/1994 | Tamura et al. | |
| 5,630,877 | A | 5/1997 | Tamura et al. | |
| 6,410,130 | B1 | 6/2002 | Richter et al. | |
| 6,531,221 | B1 | 3/2003 | Schmid et al. | |
| 6,582,781 | B1 | 6/2003 | Richter et al. | |
| 6,838,166 | B2 | 1/2005 | Phillips et al. | |
| 7,047,883 | B2 * | 5/2006 | Raksha | B05D 3/207 101/489 |
| 7,258,900 | B2 | 8/2007 | Raksha et al. | |
| 8,343,615 | B2 * | 1/2013 | Raksha | G02B 5/09 428/195.1 |
| 8,511,712 | B2 | 8/2013 | Raksha et al. | |
| 9,724,956 | B2 * | 8/2017 | Schmid | B05D 3/20 |
| 9,849,713 | B2 * | 12/2017 | Schmid | B05D 3/20 |
| 2003/0031870 | A1 | 2/2003 | Argoitia et al. | |
| 2005/0063067 | A1 | 3/2005 | Phillips et al. | |
| 2005/0106367 | A1 | 5/2005 | Raksha | |
| 2006/0055169 | A1 | 3/2006 | Werner | |
| 2006/0198998 | A1 | 9/2006 | Raksha | |
| 2006/0237541 | A1 | 10/2006 | Downing | |
| 2007/0046408 | A1 * | 3/2007 | Shim | H05K 9/0071 335/296 |
| 2007/0172261 | A1 | 7/2007 | Raksha | |
| 2011/0290129 | A1 | 1/2011 | Gygi et al. | |
| 2013/0029112 | A1 | 1/2013 | Bargir | |
| 2014/0077485 | A1 | 3/2014 | Raksha | |
| 2015/0352888 | A1 | 12/2015 | Schmid | |

FOREIGN PATENT DOCUMENTS

| | | |
|---|---|---|
| CN | 101743127 | 6/2010 |
| EP | 0556449 | 8/1993 |
| EP | 686675 | 12/1995 |
| EP | 1710756 | 10/2006 |
| EP | 1842883 | 10/2007 |
| EP | 1845537 | 10/2007 |
| EP | 2087943 | 8/2009 |
| JP | 2011111622 | 6/2011 |
| WO | 2002/073250 | 9/2002 |
| WO | 2002073250 | 9/2002 |
| WO | 2002/090002 | 11/2002 |
| WO | 2003/000801 | 1/2003 |
| WO | 2005/002866 | 1/2005 |
| WO | 2005002866 | 1/2005 |
| WO | 2006/063926 | 6/2006 |
| WO | 2006/069218 | 6/2006 |
| WO | 2007/131833 | 11/2007 |
| WO | 2008/046702 | 4/2008 |
| WO | 2010/058026 | 5/2010 |
| WO | 2011/092502 | 8/2011 |

OTHER PUBLICATIONS

Crivello et al., "Photoinitiators for Free Radical Cationic & Anionic Photopolymerisation," Chemistry & Technology of UV & EB Formulation for Coatings, Inks & Paints, 1998.
Adams et al., "Printing Technology," 5th Edition, 2002.
Chinese office action in counterpart Chinese Application No. 201380069715.6 dated Aug. 25, 2016 (and English language translation).
Chinese Office Action and Search Report in counterpart Chinese Application No. 201380069715.6 dated Apr. 26, 2017 (and English Language Translation).
Australian Office Action in counterpart Australian Application No. 2013372261 dated Jun. 1, 2017.
Taiwan office action in counterpart Taiwan Application No. 103100181 dated May 18, 2017 (and English language translation).

* cited by examiner d=0mm d=1.5mm

OPTICAL EFFECT LAYERS SHOWING A VIEWING ANGLE DEPENDENT OPTICAL EFFECT, PROCESSES AND DEVICES FOR THEIR PRODUCTION, ITEMS CARRYING AN OPTICAL EFFECT LAYER, AND USES THEREOF

CROSS-REFERENCE TO RELATED APPLICATION

This application is a Divisional of U.S. application Ser. No. 14/759,836, issued on Dec. 26, 2017 as U.S. Pat. No. 9,849,713, which is a U.S. National Stage of International Application No. PCT/EP2013/077698 filed Dec. 20, 2013 claiming the priority of European Application No. EP 131 50 693.3 filed Jan. 9, 2013. The disclosures of U.S. application Ser. No. 14/759,836 and of International Application No. PCT/EP2013/077698 are expressly incorporated by reference herein in their entireties.

FIELD OF THE INVENTION

The present invention relates to the field of the protection of value documents and value commercial goods against counterfeit and illegal reproduction. In particular, the present invention relates to optical effect layers (OEL) showing a viewing-angle dependent optical effect, devices and processes for producing said OEL and items carrying said OEL, as well as uses of said optical effect layers as an anti-counterfeit means on documents.

BACKGROUND OF THE INVENTION

It is known in the art to use inks, compositions or layers containing oriented magnetic or magnetizable particles or pigments, particularly also magnetic optically variable pigments, for the production of security elements, e.g. in the field of security documents. Coatings or layers comprising oriented magnetic or magnetizable particles are disclosed for example in U.S. Pat. Nos. 2,570,856; 3,676,273; 3,791,864; 5,630,877 and 5,364,689. Coatings or layers comprising oriented magnetic color-shifting pigment particles, resulting in particularly appealing optical effects, useful for the protection of security documents, have been disclosed in WO 2002/090002 A2 and WO 2005/002866 A1.

Security features, e.g. for security documents, can generally be classified into "covert" security features one the one hand, and "overt" security features on the other hand. The protection provided by covert security features relies on the concept that such features are difficult to detect, typically requiring specialized equipment and knowledge for detection, whereas "overt" security features rely on the concept of being easily detectable with the unaided human senses, e.g. such features may be visible and/or detectable via the tactile senses while still being difficult to produce and/or to copy. However, the effectiveness of overt security features depends to a great extent on their easy recognition as a security feature, because most users, and particularly those having no prior knowledge of the security features of a therewith secured document or item, will only then actually perform a security check based on said security feature if they have actual knowledge of their existence and nature.

A particularly striking optical effect can be achieved if a security feature changes its appearance in view to a change in viewing conditions, such as the viewing angle. Such an effect can e.g. be obtained by dynamic appearance-changing optical devices (DACODs), such as concave, respectively convex Fresnel type reflecting surfaces relying on oriented pigment particles in a hardened coating layer, as disclosed in EP-A 1 710 756. This document describes one way to obtain a printed image that contains pigments or flakes having magnetic properties by aligning the pigments in a magnetic field. The pigments or flakes, after their alignment in a magnetic field, show a Fresnel structure arrangement, such as a Fresnel reflector. By tilting the image and thereby changing the direction of reflection towards a viewer, the area showing the greatest reflection to the viewer moves according to the alignment of the flakes or pigments. One example of such a structure is the so-called "rolling bar" effect. This effect is nowadays utilized for a number of security elements on banknotes, such as on the "50" of the 50 Rand banknote of South Africa. However, such rolling bar effects are generally observable if the security document is tilted in a certain direction, i.e. either up and down or sideways from the viewer's perspective While the Fresnel type reflecting surfaces are flat, they provide the appearance of a concave or convex reflecting hemisphere. Said Fresnel type reflecting surfaces can be produced by exposing a wet coating layer comprising non-isotropically reflecting magnetic or magnetizable particles to the magnetic field of a single dipole magnet, wherein the latter is disposed above, respectively below the plane of the coating layer, has its north-south axis parallel to said plane, and is rotating around the axis perpendicular to said plane, as illustrated in FIGS. 37A-37D of EP-A 1 710 75. The so-oriented particles are consequently fixed in position and orientation by hardening the coating layer.

Moving-ring images displaying an apparently moving ring with changing viewing angle ("rolling ring" effect) are produced by exposing a wet coating layer comprising non-isotropically reflecting magnetic or magnetizable particles to the magnetic field of a dipole magnet. WO 2011/092502 discloses moving-ring images that might be obtained or produced by using a device for orienting particles in a coating layer. The disclosed device allows the orientation of magnetic or magnetizable particles with the help of a magnetic field produced by the combination of a soft magnetizable sheet and a spherical magnet having its North-South axis perpendicular to the plane of the coating layer and disposed below said soft magnetizable sheet.

The prior art moving ring images are generally produced by alignment of the magnetic or magnetizable particles according to the magnetic field of only one rotating or static magnet. Since the field lines of only one magnet generally bend relatively softly, i.e. have a low curvature, also the change in orientation of the magnetic or magnetizable particles is relatively soft over the surface of the OEL. The intensity of the magnetic field decreases rapidly with increasing distance from the magnet when a single magnet is used. This makes it difficult to obtain a highly dynamic and well-defined feature through orientation of the magnetic or magnetizable particles, thus resulting in "rolling ring" effects that may exhibit blurred ring edges. This problem increases with increasing size (diameter) of the "rolling ring" image when only a single static or rotating magnet is used.

Therefore, a need remains for security features displaying an eye-catching dynamic loop-shaped effect covering an extended area on a document in good quality, which can be easily verified regardless of the orientation of the security document, is difficult to produce on a mass-scale with the equipment available to a counterfeiter, and which can be provided in great number of possible shapes and forms.

SUMMARY OF THE INVENTION

Accordingly, it is an object of the present invention to overcome the deficiencies of the prior art as discussed above. This is achieved by the provision of an optical effect layer (OEL) comprising a plurality of nested loop-shaped areas surrounding one common central area, e.g. on a document or other item, which exhibits a viewing-angle dependent apparent motion of image features over an extended length, has good sharpness and/or contrast, and which can be easily detected. The present invention provides such optical effect layers (OEL) as an improved easy-to-detect overt security feature, or, in addition or alternatively, as a covert security feature, e.g. in the field of document security. That is, in one aspect the present invention pertains to an optical effect layer (OEL) comprising a plurality of non-spherical magnetic or magnetizable particles, which are dispersed in a coating composition comprising a binder material, the OEL comprising two or more areas each having a loop shape (also referred to as loop-shaped areas), the loop-shaped areas being nested around a common central area that is surrounded by the innermost loop-shaped area, wherein, in each of the nested loop-shaped areas, at least a part of the plurality of non-spherical magnetic or magnetizable particles are oriented such that, in a cross-section perpendicular to the OEL layer and extending from the centre of the central area to the outer boundary of the outermost loop-shaped area, the longest axis of the particles in each of the cross-sectional areas of the looped-shaped areas follow a tangent of either a negatively curved or a positively curved part of hypothetical ellipses or circles.

Also described and claimed therein are devices for producing the optical effect layers described herein. Specifically, the present invention also relates to a magnetic field-generating device comprising a plurality of elements selected from magnets and pole pieces and comprising at least one magnet, the plurality of elements being either (i) located below a supporting surface or a space configured to receive a substrate acting as supporting surface or (ii) forming a supporting surface, and being configured such as to be capable of providing a magnetic field wherein magnetic field lines run substantially parallel to said supporting surface or space in two or more areas above said supporting surface or space, and wherein i) the two or more areas form nested loop-shaped areas surrounding a central area; and/or ii) the plurality of elements comprise a plurality of magnets, and the magnets are arranged rotatable around an axis of rotation such that the areas with field lines running substantially parallel to the supporting surface or space combine upon rotation around the axis of rotation, thereby forming, upon rotation around the axis of rotation, a plurality of nested loop-shaped areas surrounding one central area.

Also described and claimed herein are processes for producing the security element, the optical effect layers comprising it and uses of the optical effect layers for the counterfeit-protection of a security document or for a decorative application in the graphic arts. Specifically, the present invention relates to a process for producing an optical effect layer (OEL) comprising the steps of:

a) applying on a supporting surface of a magnetic field generating device or on a substrate surface a coating composition comprising a binder material and a plurality of non-spherical magnetic or magnetizable particles, said coating composition being in a first (fluid) state, b) exposing the coating composition in a first state to the magnetic field of a magnetic-field-generating device, preferably one as defined in any of claims 9-15, thereby orienting at least a part of the non-spherical magnetic or magnetizable particles in a plurality of nested loop-shaped areas surrounding one central area such that the longest axis of the particles in each of the cross-sectional areas of the looped-shaped areas each follow a tangent of either a negatively curved or a positively curved part of hypothetical ellipses or circles; and c) hardening the coating composition to a second state so as to fix the magnetic or magnetizable non-spherical particles in their adopted positions and orientations.

These and further aspects are summarized below:

1. An optical effect layer (OEL) comprising a plurality of non-spherical magnetic or magnetizable particles, which are dispersed in a coating composition comprising a binder material, the OEL comprising two or more loop-shaped areas, said loop-shaped areas forming an optical impression of closed loop-shaped bodies surrounding a central area and being nested around a common central area that is surrounded by the innermost loop-shaped area, wherein, in each of the loop-shaped areas, at least a part of the plurality of non-spherical magnetic or magnetizable particles are oriented such that, in a cross-section perpendicular to the OEL layer and extending from the centre of the central area to the outer boundary of the outermost loop-shaped area, the longest axis of the particles in each of the cross-sectional areas of the looped-shaped areas follow a tangent of either a negatively curved or a positively curved part of hypothetical ellipses or circles.

2. The optical effect layer (OEL) according to item 1, wherein the OEL further comprises an external area outside the outermost loop-shaped area, the external area surrounding the outermost loop-shaped area comprises a plurality of non-spherical magnetic or magnetizable particles, wherein at least a part of the plurality of non-spherical magnetic or magnetizable particles within the external area are oriented such that their longest axis is substantially perpendicular to the plane of the OEL or randomly oriented.

3. The optical effect layer (OEL) according to item 1 or 2, wherein the central area surrounded by the innermost loop-shaped area comprises a plurality of non-spherical magnetic or magnetizable particles, wherein a part of the plurality of non-spherical magnetic or magnetizable particles within the central area are oriented such that their longest axis is substantially parallel to the plane of the OEL, forming the optical effect of a protrusion.

4. The optical effect layer (OEL) according to item 3, wherein the outer peripheral shape of the protrusion is similar to the shape of the innermost loop-shaped closed body.

5. The optical effect layer (OEL) according to item 3 or 4, wherein the loop-shaped areas each provide the optical effect or impression of a loop-shaped body in the form of a ring, and the protrusion has the shape of a solid circle or half-sphere.

6. The optical effect layer (OEL) according to any one of items 1, 2, 3, 4 and 5, wherein at least a part of the plurality of non-spherical magnetic or magnetizable particles is constituted by non-spherical optically variable magnetic or magnetizable pigments.

7. The optical effect layer (OEL) according to item 6, wherein the optically variable magnetic or magnetizable pigments are selected from the group consisting of magnetic thin-film interference pigments, magnetic cholesteric liquid crystal pigments and mixtures thereof.

8. The optical effect layer (OEL) according to any preceding item, preferably item 3, 4 or 5, wherein the plurality of non-spherical magnetic or magnetizable particles within the loop-shaped areas and/or within the central area surrounded by the loop-shaped areas are oriented such as to provide the optical effect of (a) three-dimensional object(s) extending from the surface of the OEL.

9. A magnetic field-generating device comprising a plurality of elements selected from magnets and pole pieces and comprising at least one magnet, the plurality of elements being either (i) located below a supporting surface or a space configured to receive a substrate acting as supporting surface or (ii) forming a supporting surface, and being configured such as to be capable of providing a magnetic field wherein magnetic field lines run substantially parallel to said supporting surface or space in two or more areas above said supporting surface or space, and wherein i) the two or more areas form nested loop-shaped areas surrounding a central area; and/or ii) the plurality of elements comprise a plurality of magnets, and the magnets are arranged rotatable around an axis of rotation such that the areas with field lines running substantially parallel to the supporting surface or space combine upon rotation around the axis of rotation, thereby forming, upon rotation around the axis of rotation, a plurality of nested loop-shaped areas surrounding one central area.

10. The magnetic field-generating device according to item 9, option ii), wherein the magnets are arranged such that in an area, which is above said supporting surface or space and which is centered on the axis of rotation, a magnetic field with field lines running substantially parallel to the plane of magnets is generated.

11. The magnetic field-generating device according to item 9, option i), wherein the two or more areas of parallel field lines, which form the nested loop-shaped areas surrounding a central area, are caused by an arrangement of a plurality of elements selected from magnets and pole pieces, at least one of said elements having a loop-shaped form corresponding to the loop-shaped area with parallel field lines above the supporting surface or space.

12. The magnetic field-generating device according to item 11, wherein the arrangement of a plurality of elements selected from magnets and pole pieces comprises at least one loop-shaped magnet having its magnetic axis substantially perpendicular to said supporting surface or space, which arrangement preferably further contains a pole piece having a loop-shaped form, the loop-shaped magnet and the looped shaped pole piece surrounding a central area in a nested manner.

13. The magnetic-field-generating device according to item 12, wherein the central area comprises a bar dipole magnet having its magnetic axis substantially perpendicular to said supporting surface or space or a central pole piece, and wherein the pole piece and that magnet are arranged in alternating manner starting from the central area.

14. The magnetic field-generating device according to item 9, option ii), or item 10, wherein the plurality of magnets are arranged symmetrically around the axis of rotation and have their magnetic axis substantially parallel or substantially perpendicular to the supporting surface or space.

15. The magnetic-field-generating device according to item 9, which is selected from the group consisting of the following:

a) a magnetic-field-generating device, wherein a loop-shaped axially magnetized dipole magnet is provided such that the North-South axis is perpendicular to the supporting surface or space, wherein the loop-shaped magnet surrounds a central area, and the device further comprises a pole piece that is provided below the loop-shaped axially magnetized dipole magnet with respect to the supporting surface or the space and that closes one side of the loop formed by the loop-shaped magnet, and wherein the pole piece forms one or more projections extending into the space surrounded by the loop-shaped magnet and being spaced apart therefrom, wherein a1) the pole piece forms one projection that extends into the central area surrounded by the loop-shaped magnet, wherein the projection is laterally spaced apart from the loop-shaped magnet and fills a part of the central area;

a2) the pole piece forms one loop-shaped projection and surrounds a central bar dipole magnet having the same North-South direction as the loop-shaped magnet, the projection and the bar dipole magnet being spaced apart from each other, or a3) the pole piece forms two or more spaced-apart projections, either all of these or all but one of these are loop-shaped, and, depending on the number of projections, one or more additional axially magnetized loop shaped magnets having the same North South direction as the first axially magnetized loop-shaped magnet is/are provided in the space formed between the spaced-apart loop-shaped projections, the additional magnets being spaced apart from the loop-shaped projections, and wherein the central area surrounded by the loop-shaped projections and the loop-shaped magnets is partly filled with either a central bar dipole magnet having the same North-South direction as the surrounding loop-shaped magnets or with a central projection of the pole piece, such that, as viewed from the supporting surface or the space, an alternating arrangement of spaced-apart loop-shaped pole piece projections and loop-shaped axially magnetized dipole magnets is formed, surrounding one central area, wherein the central area is filled either with a bar dipole magnet or a central projection as set out above;

b) a magnetic-field-generating device, comprising two or more bar dipole magnets and two or more pole pieces, wherein the device comprises an equal number of pole pieces and bar dipole magnets, wherein the bar dipole magnets have their North-South axis substantially perpendicular to the supporting surface or space, have the same North-South direction and are provided in different distances from the supporting surface or space, preferably along one line extending perpendicular from the supporting surface or space, and spaced apart from each other; and the pole pieces being provided in the space between the bar dipole magnets and in contact therewith, wherein the pole pieces form one or more projections which, in loop-shaped form, surrounds a central area in which the bar dipole magnet located next to the supporting surface or space is located;

c) a magnetic-field-generating device, comprising one bar dipole magnet located below the supporting surface or space and having its North-South direction perpendicular to said supporting surface or space, one or more loop-shaped pole pieces arranged above the magnet and below the supporting surface or space, which, for a plurality of loop-shaped pole pieces, are arranged spaced apart and coplanar nested, the one or more pole pieces laterally surrounding a central area under which the magnet is located, the device further comprising a first plate-like pole piece having about the same size and about the same outer peripheral shape as the outermost loop-shaped pole piece, the plate-like pole piece being arranged below the magnet such that its outer peripheral shape is superimposed with the periphery of outermost of the loop-shaped pole pieces in direction from the supporting surface or space, and which is in contact with one of the poles of the magnet; and a central pole piece in contact with the respectively other pole of the magnet, the central pole piece having the outer peripheral shape of a loop, partly filling the central area and being laterally and spaced apart from and surrounded by the one or more loop-shaped pole pieces;

d) a magnetic-field-generating device according to item c) above, wherein a second plate like pole piece having the outer peripheral shape of a loop is provided at a position above and in contact with one pole of the magnet and below and in contact with the one or more loop-shaped pole pieces and below and in contact with the central pole piece, so that the central pole piece is no longer in direct contact with the pole of the magnet, the second plate-like pole piece being of about the same size and shape as the first plate-like pole piece;

e) a magnetic-field-generating device, wherein two or more bar dipole magnets are arranged below the supporting surface or space and such as to be rotatable around an axis of rotation that is perpendicular to the supporting surface or space, the two or more bar dipole magnets being spaced apart from the axis of rotation and from each other and provided symmetrically on opposite sides of the axis of rotation, the device optionally further comprising one bar dipole magnet that is arranged below the supporting surface or space and on the axis of rotation, wherein either e1) the device comprises, on either side of the axis of rotation, one or more bar dipole magnets all having their North-South axis substantially perpendicular to the supporting surface or space and substantially parallel to the axis of rotation, the North-South direction of all magnets being identical with respect to the supporting surface or space, and the magnets being spaced apart from each other, the device optionally comprising one bar dipole magnet that is arranged below the supporting surface or space and on the axis of rotation, the North-South axis thereof being substantially perpendicular to the supporting surface or space and substantially parallel to the axis of rotation, and the North-South direction of which is either identical to the North South direction of the magnets that are arranged rotatable around the axis and spaced apart therefrom or opposite thereto;

e2) no optional bar dipole magnet on the axis of rotation is present and the device comprises, on either side of the axis of rotation, two or more bar dipole magnets arranged spaced apart from each other and from the axis of rotation, the North-South axis of the magnets being substantially perpendicular to the supporting surface or space and substantially parallel to the axis of rotation, and wherein the magnets provided on either side of the axis have alternating North-South directions, and the innermost magnets with regard to the axis of rotation either have the same or opposite North-South directions;

e3) no optional bar dipole magnet on the axis of rotation is present and the device comprises, on either side of the axis of rotation, two or more bar dipole magnets arranged spaced apart from each other and from the axis of rotation, the North-South axis of the magnets being substantially perpendicular to the supporting surface or space and substantially parallel to the axis of rotation, and wherein the magnets provided on either side of the axis have the same North-South direction and the magnets provided on different sides of the axis of rotation have opposite North-South directions;

e4) the device comprises, on either side of the axis of rotation, one or more bar dipole magnets that are arranged spaced apart from the axis of rotation and, if more than one magnet is present on one side, spaced apart from each other, the North-South axis of the magnets being substantially parallel to the supporting surface or space and substantially radial to the axis of rotation, and the North-South directions of the magnets being arranged such that the North-South directions of all magnets point essentially in the same direction, wherein further either e4-1) no optional magnet is provided on the axis of rotation and at least two magnets are provided on either side of the axis of rotation; or e4-2) an optional magnet is provided on the axis of rotation, the magnets on either side being arranged spaced apart therefrom, the magnet on the axis of rotation being a bar dipole magnet having its North-South axis substantially parallel to the supporting surface and its North-South direction pointing in the same direction as the other magnets provided on either side of the axis or rotation;

e5) the device comprises no optional magnet provided on the axis of rotation and comprises, on either side of the axis of rotation, two or more bar dipole magnets that are arranged spaced apart from the axis of rotation and spaced apart from each other, the North-South axis of the magnets being substantially parallel to the supporting surface or space and substantially radial to the axis of rotation, wherein the North-South directions of all magnets are symmetrical with respect to the axis of rotation (i.e. all pointing towards or away from the axis of rotation);

e6) the device comprises no optional magnet provided on the axis of rotation and comprises, on either side of the axis of rotation, one or more pairs of bar dipole magnets that are arranged spaced apart from the axis of rotation and spaced apart from each other, the North-South axis of all magnets being substantially parallel to the supporting surface or space and substantially radial to the axis of rotation, and each pair of magnets being formed by two magnets with opposite North-South directions pointing towards each other or away from each other, respectively, and wherein the innermost magnets of the innermost pairs of magnets on either side have either e6-1) symmetric North South directions with respect to the axis of rotation, both pointing either away or towards the axis of rotation; or e6-2) asymmetric North-South direction with respect to the axis of rotation, one pointing away and one towards the axis of rotation; or e7) the device either e7-1) comprises the optional bar dipole magnet on the axis of rotation and one or more magnets on either side of the axis of rotation, the North-South axis of all magnets being substantially parallel to the supporting surface and the North-South axis of the magnets on either side of the axis of rotation is essentially radial to the axis of rotation; or e7-2) the device does not comprise the optional bar dipole magnet on the axis of rotation and comprises two or more magnets on either side of the axis of rotation that are arranged spaced apart from the axis of rotation, the North-South axis of all magnets being substantially parallel to the supporting surface or space and substantially radial to the axis of rotation, wherein in both instances the North-South directions of the magnets arranged on one side of the axis of rotation are asymmetric to the North-South directions of the magnets arranged on the other side of the axis of rotation with respect to the axis of rotation (i.e. pointing towards the axis of rotation on one side and away from the axis of rotation on the other side), such that the North-South directions are in line from the outermost magnet on one side to the outermost magnet on the other side, the magnet on the axis of rotation in case e7-1 being aligned in this line;

e8) the device comprises, on either side of the axis of rotation two or more bar dipole magnets all having their North-South axis substantially perpendicular to the supporting surface or space and substantially parallel to the axis of rotation, and optionally a bar dipole magnet arranged on the axis of rotation and also having its North-South axis substantially perpendicular to the supporting surface or space and substantially parallel to the axis of rotation; the North-South direction of adjacent magnets being opposite with respect to the supporting surface or space, and the magnets being spaced apart from each other; or e9) the device comprises, on either side of the axis of rotation two or more bar dipole magnets all having their North-South axis substantially parallel to the supporting surface or space and substantially radial to the axis of rotation, and optionally a bar dipole magnet arranged on the axis of rotation and also having its North-South axis substantially parallel to the supporting surface or space and substantially perpendicular to the axis of rotation; the North-South directions of adjacent magnets pointing in opposite directions, and the magnets being spaced apart from each other;

f) a magnetic-field-generating device, wherein two or more loop-shaped dipole magnets are provided such that their North-South axis are perpendicular to the supporting surface or space, the two or more loop-shaped magnets being arranged nested, spaced apart and surrounding one central area, the magnets being axially magnetized, and adjacent loop-shaped magnets have opposite North-South directions pointing either to or away from the supporting surface or space, the device further comprising a bar dipole magnet provided in the central area surrounded by the loop-shaped magnets, the bar dipole magnet having its North South axis substantially perpendicular to the supporting surface and parallel to the North-South axis of the loop-shaped magnets, the North-South direction of the bar dipole magnet being opposite to the North-South direction of the innermost loop-shaped magnet, the device optionally further comprising a pole piece on the side opposite to the supporting surface or space and in contact with the central bar dipole magnet and the loop-shaped magnets;

g) a magnetic-field-generating device, comprising a permanent magnetic plate that is magnetized perpendicular to the plane of the plate and having projections and impressions, the projections and impressions being arranged to form nested loop-shaped projections and impressions surrounding a central area, the projections and impressions forming opposite magnetic poles; and h) a magnetic-field-generating device which comprises a plurality of bar dipole magnets provided around an axis of rotation, the magnets on either side of the axis of rotation being two or more bar dipole magnets all having their North-South axis either substantially parallel or perpendicular to the supporting surface or space, and optionally a bar dipole magnet arranged on the axis of rotation and also having its North-South axis substantially parallel or perpendicular to the supporting surface; respectively, the North-South directions of adjacent magnets pointing in the same or in opposite directions, and the magnets being spaced apart from each other or in direct contact with each other, the magnets optionally being provided on a ground plate.

16. A printing assembly comprising the magnetic-field-generating devices recited in item 9-15, which optionally is a rotating printing assembly.

17. Use of the magnetic-field-generating devices recited in any of 9-15 for producing the OEL recited in any one of items 1 to 8.

18. A process for producing an optical effect layer (OEL) comprising the steps of:

a) applying on a supporting surface or a substrate surface a coating composition comprising a binder material and a plurality of non-spherical magnetic or magnetizable particles, said coating composition being in a first (fluid) state, b) exposing the coating composition in a first state to the magnetic field of a magnetic-field-generating device, preferably one as defined in any of items 9-15, thereby orienting at least a part of the non-spherical magnetic or magnetizable particles in a plurality of a nested loop-shaped areas surrounding one central area such that the longest axis of the particles in each of the cross-sectional areas of the looped-shaped areas follow a tangent of either a negatively curved or a positively curved part of hypothetical ellipses or circles; and c) hardening the coating composition to a second state so as to fix the magnetic or magnetizable non-spherical particles in their adopted positions and orientations.

19. The process according to item 18, wherein the hardening step c) is done by UV-Vis light radiation curing.

20. An optical effect layer according to any one of items 1-8, which is obtainable by the process of item 18 or item 19.

21. An optical effect layer coated substrate (OEC) comprising one or more optical effect layers according to any one of items 1 to 8 or 20 on a substrate.

22. A security document, preferably a banknote or an identity document, comprising an optical effect layer recited in any one of items 1 to 8 or 20.

23. Use of the optical effect layer recited in any one of items 1 to 8 or 20 or of the optical effect coated substrate recited in item 21 for the protection of a security document against counterfeiting or fraud or for a decorative application.

BRIEF DESCRIPTION OF DRAWINGS

The optical effect layer (OEL) comprising a plurality of loop-shaped areas according to the present invention and its production are now described in more detail with reference to the drawings and to particular embodiments, wherein FIG. 1A schematically illustrates a toroidal body and the variation of orientation of non-spherical magnetic or magnetizable particles in an area forming a loop-shaped closed body, which, in a cross-section extending from the centre of the central area (i.e. the centre of the whole in the toroidal body), follow either a tangent of negatively curved part (FIG. 1B) or a positively curved part (FIG. 1C) of a hypothetical ellipse having its centre above or below the area forming a loop-shaped body in that cross-section.

FIGS. 2A-2C contain three views of the same security element comprising two loop shapes, each in the form of a ring, wherein FIG. 2A shows a photograph of an optical effect layer comprising a security element having two loop shapes;

FIG. 2B illustrates the variation of the orientation of non-spherical magnetic or magnetizable particles with respect to the OEL plane in a cross-section along the indicated line in FIG. 2A, and FIG. 2C shows three electron micrographs of cross-sections of the optical effect layer of FIG. 2A cut perpendicular to its top surface, wherein the micrographs were taken at the locations A, B, and C, respectively. Each micrograph shows the substrate (at the bottom), which is covered by the optical effect layer comprising oriented non-spherical magnetic or magnetizable particles forming two loop shapes;

DEFINITIONS

Figure 1A:
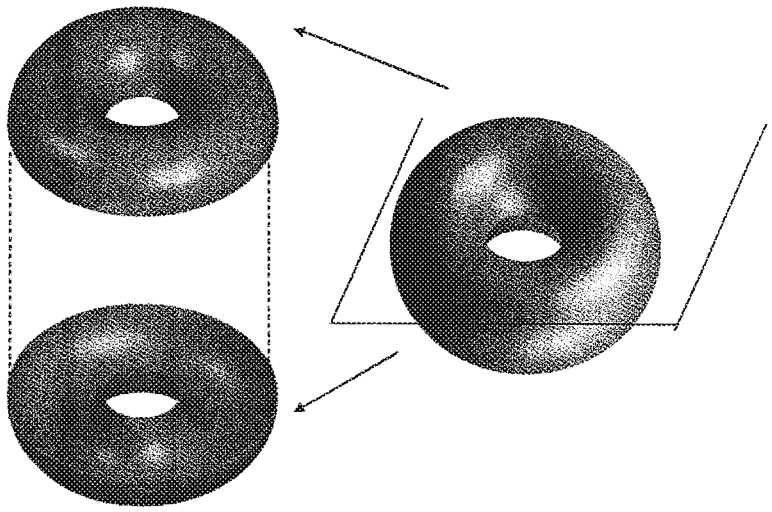

The following definitions are to be used to interpret the meaning of the terms discussed in the description and recited in the claims.

As used herein, the indefinite article "a" indicates one as well as more than one and does not necessarily limit its referent noun to the singular.

As used herein, the term "about" means that the amount or value in question may be the specific value designated or some other value in its neighborhood. Generally, the term "about" denoting a certain value is intended to denote a range within .+−0.5% of the value. As one example, the phrase "about 100" denotes a range of 100.+−0.5, i.e. the range from 95 to 105. Generally, when the term "about" is used, it can be expected that similar results or effects according to the invention can be obtained within a range of .+−0.5% of the indicated value.

As used herein, the term "and/or" means that either all or only one of the elements of said group may be present. For example, "A and/or B" shall mean "only A, or only B, or both A and B". In the case of "only A", the term also covers the possibility that B is absent, i.e. "only A, but not B".

The term "substantially parallel" refers to deviating less than 20.degree. from parallel alignment and the term "substantially perpendicular" refers to deviating less than 20.degree. from perpendicular alignment. Preferably, the term "substantially parallel" refers to not deviating more than 10.degree. from parallel alignment and the term "substantially perpendicular" refers to not deviating more than 10.degree. from perpendicular alignment.

The term "at least partially" is intended to denote that the following property is fulfilled to a certain extent or completely. Preferably, the term denotes that the following property is fulfilled to at least 50% or more, more preferably at least 75%, even more preferably at least 90%. It may be preferable that the term denotes "completely".

The terms "substantially" and "essentially" are used to denote that the following feature, property or parameter is either completely (entirely) realized or satisfied or to a major degree that does adversely affect the intended result. Thus, depending on the circumstances, the term "substantially" or "essentially" preferably means e.g. at least 80%, at least 90%, at least 95%, or 100%.

The term "comprising" as used herein is intended to be non-exclusive and open-ended. Thus, for instance a coating composition comprising a compound A may include other compounds besides A. However, the term "comprising" also covers the more restrictive meanings of "consisting essentially of" and "consisting of", so that for instance "a coating composition comprising a compound A" may also (essentially) consist of the compound A.

The term "coating composition" refers to any composition which is capable of forming an optical effect layer (OEL) of the present invention on a solid substrate and which can be applied preferentially but not exclusively by a printing method. The coating composition comprises at least a plurality of non-spherical magnetic or magnetizable particles and a binder. Due to their non-spherical shape, the particles have non-isotropic reflectivity.

The term "optical effect layer (OEL)" as used herein denotes a layer that comprises at least a plurality of oriented non-spherical magnetic or magnetizable particles and a binder, wherein the orientation of the non-spherical magnetic or magnetizable particles is fixed within the binder.

As used herein, the term "optical effect coated substrate (OEC)" is used to denote the product resulting from the provision of the OEL on a substrate. The OEC may consist of the substrate and the OEL, but may also comprise other materials and/or layers other than the OEL. The term OEC thus also covers security documents, such as banknotes.

The term "loop-shaped area" denotes an area within the OEL providing the optical effect or optical impression of a loop-shaped body re-combining with itself. The area takes the form of a closed loop surrounding one central area. The "loop-shape" can have a round, oval, ellipsoid, square, triangular, rectangular or any polygonal shape. Examples of loop shapes include a circle, a rectangle or square (preferably with rounded corners), a triangle, a pentagon, a hexagon, a heptagon, an octagon etc. Preferably, the area forming a loop does not cross itself. The term "loop-shaped body" is used to denote the optical effect or optical impression that is obtained by orienting non-spherical magnetic or magnetizable particles in the loop-shaped area such that to a viewer the optical impression of a three-dimensional loop-shaped body is provided. The term "nested loop-shaped areas" is used to denote an arrangement of loop-shaped areas each providing the optical effect or optical impression of a loop-shaped body, wherein "nested" means that one of the loop-shaped areas is at least partly surrounding another loop shape, and the "nested" loop-shaped areas surround a common central area. Preferably, the term "nested" means that one or more outer loop-shaped areas surround one or more inner loop-shaped areas completely. A particularly preferred embodiment of "nested" is "concentric", wherein one or more outer loop-shaped areas completely surround one or more inner loop shapes and define a common central area without crossing each other. In a further preferred embodiment, the plurality of "nested" loop-shaped areas takes the form of concentric circles.

The term "a security element comprising a plurality of nested loop-shaped bodies" refers to a security element wherein the orientation of non-spherical magnetic or magnetizable particles within the OEL is such that there are two or more nested loop-shaped areas and wherein within these areas the orientation of the non-spherical magnetic or magnetizable particles is such that an observable light reflection in a specific direction (generally perpendicular to the OEL surface) is obtained, thereby providing the optical effect of a plurality of nested loop-shaped bodies. This typically means that, in a cross section extending from the center of the central area to the outer boundary of the loop-shaped areas, in the central part of an area that is part of a loop shaped area (e.g. the central part of the layer L in FIGS. 1*b* and 1*c* or the central part of the areas (1) in the lower part of FIG. 21A), the longest axis of the non-spherical magnetic or magnetizable particles is oriented to be substantially parallel to the plane to the surface of the OEL. The two or more nested loop-shaped bodies are typically arranged such that one of the loop-shaped bodies completely surrounds the other(s), respectively, as shown for example in FIG. 3*b*, where there are two loop-shaped bodies in the form of two rings wherein one of the rings completely surrounds the other. Preferably, the plurality of loop-shaped bodies are of identical or essentially identical form, such as two or more rings, two or more squares, two or more hexagons, two or more heptagons, two or more octagons, etc.

The term "width of a loop-shaped area" is used to denote the width of a loop-shaped area in a cross-section perpendicular to the OEL and extending from the centre of the central area to the outer boundary of the outermost loop-shaped area, as represented by the width of the area (1) in FIG. 21.

The term "security element" is used to denote an image or graphic element that can be used for authentication purposes. The security element can be an overt and/or a covert security element.

The term "magnetic axis" or "North-South axis" denotes a theoretical line connecting and extending through the North and South pole of a magnet. The line does not have a certain direction. Conversely, the term "North-South direction" denotes the direction along the North-South axis or magnetic axis from the North pole to the South pole. In the context of magnetic field generating devices wherein plural magnets are provided rotatable about an axis of rotation and the magnetic North-South axis is radial to the axis of rotation, the expression "symmetric magnetic North-South direction" means that the orientation of the North-South direction is symmetric with respect to the axis of rotation as center of symmetry (i.e. the North-South direction of all of the plural magnets either points away from the axis of rotation or the North-South direction of all of the plural magnets towards it). In the context of magnetic field generating devices wherein plural magnets are provided rotatable about an axis of rotation and the magnetic North-South axis is radial to the axis of rotation and parallel to the supporting surface or substrate surface, the expression "asymmetric magnetic North-South direction" means that the orientation of the North-South direction is asymmetric with respect to the axis of rotation as center of symmetry (i.e. the North-South direction of one of the magnet points towards and the North-South direction of the other magnet points away from the axis of rotation).

DETAILED DESCRIPTION

In one aspect, the present invention relates to an OEL that is typically provided on a substrate. The OEL comprises a plurality of non-spherical magnetic or magnetizable particles that have non-isotropic reflectivity. The non-spherical magnetic or magnetizable particles are dispersed in a binder material and, in nested loop-shaped areas surrounding a common central area, have a specific orientation for providing the optical effect or -optical impression of a plurality of nested loop-shaped bodies. The orientation is achieved by orienting the particles in accordance with an external magnetic field, as will be explained in more detail in the following. That is, the present invention provides an optical effect layer (OEL) comprising a plurality of non-spherical magnetic or magnetizable particles, which are dispersed in a coating composition comprising a binder material, the OEL comprising two or more areas each having a loop shape (also referred to as loop-shaped areas), the loop-shaped areas being nested around a common central area that is surrounded by the innermost loop-shaped area, wherein, in each of the areas forming a loop-shaped area, at least a part of the plurality of non-spherical magnetic or magnetizable particles are oriented such that, in a cross-section perpendicular to the OEL and extending from the centre of the central area to the outer boundary of the outermost loop-shaped area, the longest axis of the particles in each of the cross-sectional areas of the looped-shaped areas follow a tangent of either a negatively curved or a positively curved part of hypothetical ellipses or circles. Herein, a part of the non-spherical magnetic or magnetizable particles in the loop-shaped areas are oriented such that their longest axis is substantially parallel to the plane of the OEL.

The orientation of the non-spherical magnetic or magnetizable particles is not uniform over the whole volume of the OEL. Instead, there are two or more nested loop-shaped areas within the OEL wherein the particles are oriented such that an observable reflectivity into a given second direction is obtained when light is irradiated from a first direction onto the OEL. Typically, the orientation of the non-spherical magnetic or magnetizable particles within the areas each forming a loop shape is such that a maximum reflectivity perpendicular to the surface of the OEL is obtained when light is irradiated from a direction perpendicular to the OEL surface. This typically means that within the loop-shaped areas at least a part of the particles are oriented such that their longest axis is substantially parallel to the plane or surface of the OEL.

Figure 3A:
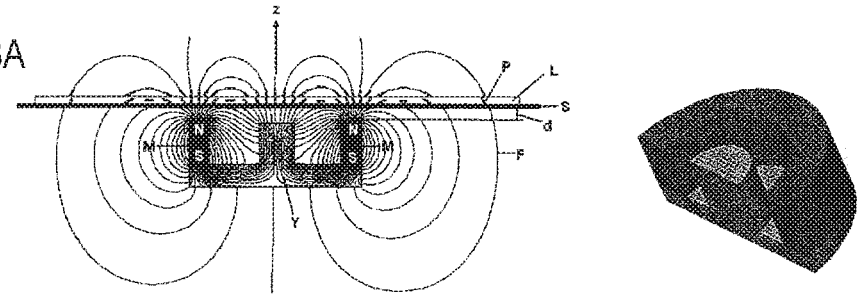
FIG. 3A schematically depicts an embodiment of a magnetic-field-generating device according to one embodiment of the present invention, the device comprising a supporting surface (S) for receiving a substrate on which the optical effect layer is to be provided, a dipole magnet (M) in the form of a hollow loop-shaped body (a ring), which is magnetized such that the North-South axis of the magnet is perpendicular to the plane of the loop (ring), and an inverted T-shaped iron yoke (Y). The assembly of magnet (M) and the iron yoke (Y) as well as the three-dimensional magnetic field, as illustrated by the field lines (F), of the magnet (M) in space are rotationally-symmetric with respect to a central vertical axis (z)
Figure 3B:
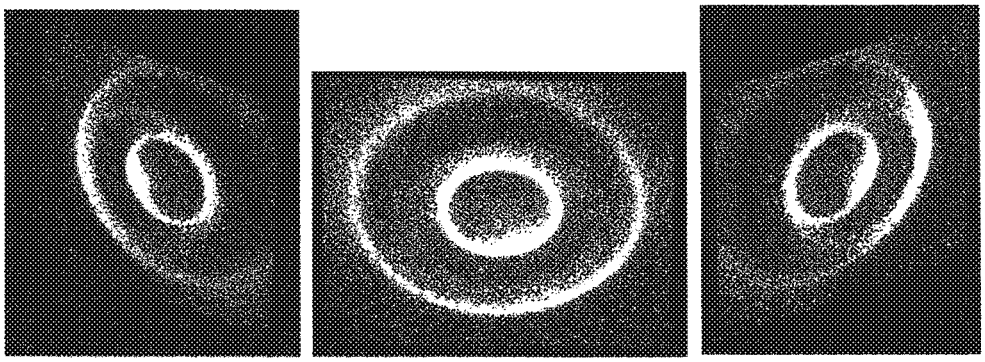
FIG. 3B shows a photograph of a security element of the present invention comprising two loop shapes (two rings), formed using the magnetic-field-generating device shown in FIG. 3A.

These areas form a plurality of nested loop-shaped areas. The plurality (i.e. two or more, such as three, four, five, six or more) of loop-shaped areas are preferably arranged such that one of the loop-shaped areas is completely surrounded by one or more other loop shapes without crossing it or them, such as shown in FIG. 3B, wherein one loop shape (ring) is surrounded by another loop shape (another ring). For three loop shapes, preferably the arrangement is such that the innermost loop shape is completely surrounded by a middle and an outermost loop shape, and the middle shape is interposed between the innermost and the outermost loop shape, again without crossing. This principle is of course applicable to also greater number of loop shapes, as shown for instance in FIG. 15B for five rings.

It is particularly preferable that the plurality of loop-shaped areas arranged in this manner have substantially identical shape. This means that e.g. in case of three loop-shaped areas there are for instance three circles, three rectangles, three triangles, three hexagons etc. wherein an inner loop shape is surrounded by an outer loop shape.

The shape of the OEL and in particular the orientation of the non-spherical magnetic or magnetizable particles within the loop-shaped areas of the OEL will now be described with reference to FIG. 21, which schematically illustrates an OEL of the present invention. Notably, FIG. 21 is not to scale.

In the top left of FIG. 21, a plan view of an OEL comprising two loop-shaped bodies formed by loop-shaped areas (1) provided on a support (S) in the form of ellipsoids is shown. At the top, the optical impression of two loop-shaped bodies is seen in a plan view of the OEL. The loop-shaped areas (1) surround a common central area (2) having a center (3).

In the lower part of FIG. 21, a cross-sectional view perpendicular to the plane of the OEL and extending from the center (3) of the central area (2) to the outer boundary of the outermost loop-shaped area, i.e. along the line (4), is shown. Of course, the line (4) is not present in reality on the OEL, but merely illustrates the position of the cross sectional view as also referred to in claim 1. In the cross-sectional view, it becomes apparent that the OEL (L) in the shown embodiment is provided on a supporting surface (S), preferably on a substrate. In the cross-sectional view of the OEL (L), the areas (1) forming part of a loop shape contain non-spherical magnetic or magnetizable particles (5), which, when viewed in the cross sectional view along the line (4), in each area (1) forming part of a loop shaped area, are oriented such as to follow a tangent of a negatively curved part of hypothetical ellipses or circles (6), Of course, also the opposite alignment, following a positively curved part, is possible. Notably, a part of the non-spherical magnetic or magnetizable particles (preferably in a section about the center of a loop-shaped area (1) when viewed in the cross-section illustrated in FIG. 21 and referred to in claim 1) are oriented such that their longest axis is substantially parallel to the plane of the OEL and/or the substrate surface. In a cross-sectional view along the line (4) or as referred to in claim 1, the hypothetical ellipses or circles typically have their respective centres above or below (in FIG. 21 below) each of the areas each forming part of a loop-shaped area, and preferably along a vertical line extending from about the middle of an area (1) forming the loop-shaped area.

Further, in the cross-sectional view preferably the diameter of a hypothetical circle or the longest or shortest axis of a hypothetical ellipse is about the width of the respective area forming part of a loop shape (the width of the areas (1) in the lower part of FIG. 21), so that at the inner and outer boundaries of each of the areas (1) the orientation of the longest axis of the non-spherical particles is substantially perpendicular to the plane of the OEL and gradually changes so as to become substantially parallel to the plane of the supporting surface or of the substrate in the centre of the area (1) forming part of a loop-shaped area providing the optical impression of a loop-shaped body. In the event that, in such a cross-sectional view, the orientation of the non-spherical magnetic or magnetizable particles in a given loop-shaped area follows a tangent to the negatively or positively curved part of a hypothetical circle having its center along a line extending perpendicular from the OEL and from about the center of the width of the loop-shaped area, the rate of change of the orientation would be constant, since the curvature of a circle is constant. If however the orientation of the particles follows a tangent to (a positively or negatively curved part of) an ellipse, the rate of the change in orientation of the non-spherical magnetic or magnetizable particles would not be constant (because the curvature of an ellipse is not constant) so that e.g. around the center of the width of a loop-shaped area only a small change in orientation of substantially parallel oriented particles is observed, which then more rapidly changes towards a substantially perpendicular orientation at the boundaries of the loop-shaped area in the cross-sectional view illustrated in FIG. 21.

This relationship regarding the position of the centre and the diameter of the hypothetical ellipse or circle not only applies to the embodiment shown in FIG. 21, but to all loop-shaped areas forming the optical impression of loop-shaped bodies present in the OELs of the present invention, while of course different positions and/or diameters may be applicable to different loop-shaped bodies formed in one OEL. Notably, the areas of the OEL (L) not forming part of nested loop-shaped areas (i.e. the areas inside and outside the areas (1) in FIG. 21) may also contain non-spherical magnetic or magnetizable pigments (not shown in FIG. 21), which may have a specific or random orientation, as will be further explained below. Further, the non-spherical magnetic or magnetizable particles (5) may fill the complete volume and may be arranged in several layers in the OEL (L), while FIG. 21 only schematically represents some of the particles in their respective orientation.

In the OEL, the non-spherical magnetic or magnetizable particles are dispersed in a coating composition comprising a hardened binder material that fixes the orientation of the non-spherical magnetic or magnetizable particles. The hardened binder material is at least partially transparent to electromagnetic radiation of one or more wavelengths in the range of 200 nm to 2500 nm. Preferably, the hardened binder material is at least partially transparent to electromagnetic radiation of one or more wavelengths in the range of 200-800 nm, more preferably in the range of 400-700 nm. Herein, the term "one or more wavelengths" denotes that the binder material may be transparent to only one wavelength in the given wavelength range, or may be transparent to several wavelengths in the given range. Preferably, the binder material is transparent to more than one wavelength in a given range, and more preferably to all wavelengths in a given range. Thus, in a more preferred embodiment, the hardened binder material is at least partly transparent to all wavelengths in the range of about 200-about 2500 nm (or 200-800 nm, or 400-700 nm), and even more preferably the hardened binder material is fully transparent to all wavelengths in these ranges.

Herein, the term "transparent" denotes that the transmission of electromagnetic radiation through a layer of 20 μm of the hardened binder material as present in the OEL (not including the non-spherical magnetic or magnetizable particles, but all other optional components of the OEL in case such components are present) is at least 80%, more preferably at least 90%, even more preferably at least 95%. This can be determined by measuring the transmittance of a test piece of the hardened binder material (not including the non-spherical magnetic or magnetizable particles) in accordance with well-established test methods, e.g. DIN 5036-3 (1979-11).

The non-spherical magnetic or magnetizable particles described herein preferably have a non-isotropic reflectivity with respect to an incident electromagnetic radiation for which the hardened binder material is at least partially transparent. As used herein, the term "non-isotropic reflectivity" denotes that the proportion of incident radiation from a first angle that is reflected by a particle into a certain (viewing) direction (a second angle) is a function of the orientation of the particles, i.e. that a change of the orientation of the particle with respect to the first angle can lead to a different magnitude of the reflection to the viewing direction.

Further preferably, each of the plurality of non-spherical magnetic or magnetizable particles described herein have a non-isotropic reflectivity with respect to incident electromagnetic radiation in some parts or in the complete wavelength range between about 200 and about 2500 nm, more preferably between about 400 and about 700 nm, such that a change of the particle's orientation results in a change of reflection by that particle.

In the OEL of the present invention, the non-spherical magnetic or magnetizable particles are provided in such a manner as to form a dynamic security element providing an optical effect or optical impression of at least a plurality of nested loop-shaped bodies.

Herein, the term "dynamic" denotes that the appearance and the light reflection of the security element changes depending on the viewing angle. Put differently, the appearance of the security element is different when viewed from different angles, i.e. the security element exhibits a different appearance (e.g. from a viewing angle of about 22.5° with respect to the surface of the substrate on which the OEL is provided to a viewing angle of about 90° with respect to the surface of the substrate on which the OEL is provided), which is caused by the orientation of the non-spherical magnetic or magnetizable particles having non-isotropic reflectivity and/or the properties of the non-spherical magnetic or magnetizable particles as such having a viewing angle dependent appearance (such as optically variable pigments described later).

Figure 22:
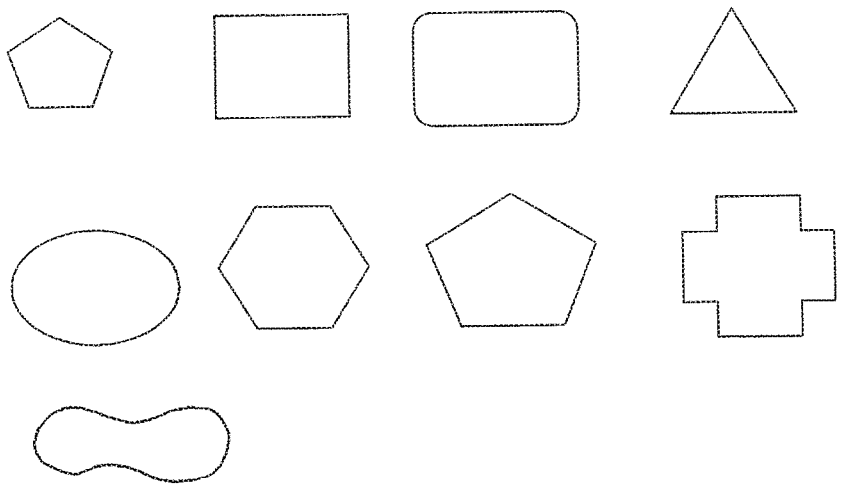
FIG. 22 shows examples of loop shapes.

The term "loop-shaped area" denotes that the non-spherical magnetic or magnetizable particles are provided such that the security element confers to the viewer the visual or optical impression of a loop-shaped body re-combining with itself, forming a closed loop surrounding one common central area. Depending on the illumination, one or more shapes may appear to the viewer. The "loop-shaped body" can have the shape of a round, ellipsoid, square, triangular, rectangular or any polygonal shape. Examples of loop-shapes include a circle, a rectangle or square (preferably with rounded corners), a triangle, a (regular or irregular) pentagon, a (regular or irregular) hexagon, a (regular or irregular) heptagon, an (regular or irregular) octagon, any polygonal shape, etc. Preferably, the loop-shaped bodies do not cross each other (as for instance in a double loop or in a shape wherein multiple rings overlap with each other, such as in the Olympic rings). Examples of loop-shapes are also shown in FIG. 22. In the present invention, the OEL provides the optical impression of two or more nested loop-shaped bodies, as defined above.

In the present invention, the optical effect or optical impression of nested loop-shaped bodies is formed by the orientation of the non-spherical magnetic or magnetizable particles within the OEL, illustrated for one embodiment in FIG. 21. That is, the loop-shaped form is not achieved by applying, such as for example by printing, the coating composition comprising the binder material and the non-spherical magnetic or magnetizable particles in loop shape, but by aligning the non-spherical magnetic or magnetizable particles according to a magnetic field such that, in a loop-shaped area of the OEL, the particles are oriented such as to provide reflectivity, while in areas of the OEL not forming part of a loop-shaped area the particles are oriented to provide no or only little reflectivity. The loop-shaped areas thus represent portions of the overall area of the OEL, which—besides the loop-shaped areas—also contain one or more portions wherein the non-spherical magnetic or magnetizable particles are either not aligned at all (i.e. have a random orientation) or are aligned such that they do not contribute to the impression of an image having a loop-shaped form. This can be achieved by orienting at least a part of the particles in this portion so that their longest axis is substantially perpendicular to the plane of the OEL.

Herein, a particle orientation providing light reflection is typically an orientation wherein the non-spherical particle has its longest axis oriented such as to be substantially parallel to the plane of the OEL and the substrate surface (if the OEL is provided on a substrate), and an orientation providing no or only little light reflection is typically an orientation wherein the longest axis of the non-spherical particle is such as to be substantially perpendicular to the plane of the OEL or the substrate surface if the OEL is provided on a substrate. This is because typically the OEL is regarded from a position in which a plan view on the OEL is observed (i.e. from a position perpendicular to the plane of the OEL), so that non-spherical magnetic or magnetizable particles having their longest axis oriented such as to be substantially parallel to the plane of the OEL provide light reflection in this direction when viewed under diffuse light conditions or under irradiation from a direction substantially perpendicular to the plane of the OEL.

Preferably the non-spherical magnetic or magnetizable particles are prolate or oblate ellipsoid-shaped, platelet-shaped or needle-shaped particles or mixtures thereof. Thus, even if the intrinsic reflectivity per unit surface area (e.g. per $\mu m^2$) is uniform across the whole surface of such particle, due to its non-spherical shape, the reflectivity of the particle is non-isotropic as the visible area of the particle depends on the direction from which it is viewed. In one embodiment, the non-spherical magnetic or magnetizable particles having non-isotropic reflectivity due to their non-spherical shape may have a further intrinsic non-isotropic reflectivity, such as for instance in optically variable magnetic or magnetizable pigments, due to the presence of layers of different reflectivity and refractive indexes. In this embodiment, the non-spherical magnetic or magnetizable particles comprise non-spherical magnetic or magnetizable particles having intrinsic non-isotropic reflectivity, such as non-spherical optically variable magnetic or magnetizable pigments.

Suitable examples of non-spherical magnetic or magnetizable particles described herein include without limitation particles comprising a ferromagnetic or a ferrimagnetic metal such as cobalt, iron, or nickel; a ferromagnetic or ferrimagnetic alloy of iron, manganese, cobalt, iron or nickel; a ferromagnetic or ferrimagnetic oxide of chromium, manganese, cobalt, iron, nickel or mixtures thereof; as well as the mixtures thereof. Ferromagnetic or ferrimagnetic oxides of chromium, manganese, cobalt, iron, nickel or mixtures thereof may be pure or mixed oxides. Examples of magnetic oxides include without limitation iron oxides such as hematite ($Fe_2O_3$), magnetite ($Fe_3O_4$), chromium dioxide ($CrO_2$), magnetic ferrites ($MFe_2O_4$), magnetic spinels ($MR_2O_4$), magnetic hexaferrites ($MFe_{12}O_{19}$), magnetic orthoferrites ($RFeO_3$), magnetic garnets $M_3R_2(AO_4)_3$, wherein M stands for a two-valent and R for a three-valent, and A for a four-valent metal ion, and "magnetic" for ferro- or ferrimagnetic properties.

Optically variable elements are known in the field of security printing. Optically variable elements (also referred in the art as colorshifting or goniochromatic elements) exhibit a viewing-angle or incidence-angle dependent color, and are used to protect banknotes and other security documents against counterfeiting and/or illegal reproduction by commonly available color scanning, printing and copying office equipment.

Preferably, at least a part of the plurality of non-spherical magnetic or magnetizable particles described herein is constituted by non-spherical optically variable magnetic or magnetizable pigments. Such optically variable magnetic or magnetizable pigments are preferably prolate or oblate ellipsoid-shaped, platelet-shaped or needle-shaped particles, or mixtures thereof.

The plurality of non-spherical magnetic or magnetizable particles may comprise non-spherical optically variable magnetic or magnetizable pigments and/or non-spherical magnetic or magnetizable particles having no optically variable properties.

The OEL providing the optical effect or optical impression of a plurality of nested loop-shaped bodies is formed by orienting (aligning) the plurality of non-spherical magnetic or magnetizable particles according to the field lines of a magnetic field in a plurality of nested loop-shaped areas of the OEL, leading to the appearance of highly dynamic viewing-angle dependent nested loop-shaped bodies. If at least a part of the plurality of non-spherical magnetic or magnetizable particles described herein is constituted by non-spherical optically variable magnetic or magnetizable pigments, an additional effect is obtained, since the color of non-spherical optically variable pigments noteworthy depends on the viewing-angle or incidence-angle with respect to the plane of the pigment, thus resulting in a combined effect with the viewing-angle dependent dynamic loop-shaped effect. The use of magnetically oriented non-spherical optically variable pigments in the loop-shaped areas enhances the visual contrast of the bright zones and improves the visual impact of the loop-shaped elements in document security and decorative applications. The combination of the dynamic loop shapes with the colour change observed for optically variable pigments, obtained by using a magnetically oriented non-spherical optically variable pigment, results in a margin of different colour in the loop-shaped bodies, which is easily verified by the unaided eye. Thus, in a preferred embodiment of the present invention, the non-spherical magnetic or magnetizable particles in the loop-shaped areas are constituted at least in part by magnetically oriented non-spherical optically variable pigments.

In addition to the overt security provided by the colorshifting property of the non-spherical optically variable magnetic or magnetizable pigments, which allows easily detecting, recognizing and/or discriminating the OEL or OEC (such as a security document) carrying the OEL according to the present invention from their possible counterfeits with the unaided human senses, e.g. because such features may be visible and/or detectable while still being difficult to produce and/or to copy, the colorshifting property of the optically variable pigments may be used as a machine readable tool for the recognition of the OEL. Thus, the optically variable properties of the optically variable pigments may simultaneously be used as a covert or semi-covert security feature in an authentication process wherein the optical (e.g. spectral) properties of the optically variable pigments are analyzed.

The use of non-spherical optically variable magnetic or magnetizable pigments enhances the significance of the obtained OEL as a security element in document security applications, because such materials (i.e. optically variable magnetic or magnetizable pigments) are reserved to the security document printing industry and are not commercially available to the public.

As mentioned above, preferably at least a part of the plurality of non-spherical magnetic or magnetizable non-spherical particles is constituted by non-spherical optically variable magnetic or magnetizable pigments. These can more preferably be selected from the group consisting of magnetic thin-film interference pigments, magnetic cholesteric liquid crystal pigments and mixtures thereof.

Magnetic thin film interference pigments are known to those skilled in the art and are disclosed e.g. in U.S. Pat. No. 4,838,648; WO 2002/073250 A2; EP-A 686 675; WO 2003/000801 A2; U.S. Pat. No. 6,838,166; WO 2007/131833 A1 and in the thereto related documents. Due to their magnetic characteristics, they are machine readable, and therefore coating compositions comprising magnetic thin film interference pigments may be detected for example with specific magnetic detectors. Therefore, coating compositions comprising magnetic thin film interference pigments may be used as a covert or semi-covert security element (authentication tool) for security documents.

Preferably, the magnetic thin film interference pigments comprise pigments having a five-layer Fabry-Perot multilayer structure and/or pigments having a six-layer Fabry-Perot multilayer structure and/or pigments having a seven layer Fabry-Perot multilayer structure. Preferred five-layer Fabry-Perot multilayer structures consist of absorber/dielectric/reflector/dielectric/absorber multilayer structures wherein the reflector and/or the absorber is also a magnetic layer. Preferred six-layer Fabry-Perot multilayer structures consist of absorber/dielectric/reflector/magnetic/dielectric/absorber multilayer structures. Preferred seven-layer Fabry Perot multilayer structures consist of absorber/dielectric/ref lector/magnetic/reflector/dielectric/absorber multilayer structures such as disclosed in U.S. Pat. No. 4,838,648; and more preferably a seven-layer Fabry-Perot absorber/dielectric/ref lector/magnetic/reflector/dielectric/absorber multilayer structure. Preferably, the reflector layers described herein are selected from the group consisting of metals, metal alloys and combinations thereof, preferably selected from the group consisting of reflective metals, reflective metal alloys and combinations thereof, and more preferably from the group consisting of aluminum (Al), chromium (Cr), nickel (Ni), and mixtures thereof and still more preferably aluminum (Al). Preferably, the dielectric layers are independently selected from the group consisting of magnesium fluoride ($MgF_2$), silicium dioxide ($SiO_2$) and mixtures thereof, and more preferably magnesium fluoride ($MgF_2$). Preferably, the absorber layers are independently selected from the group consisting of chromium (Cr), nickel (Ni), alloys comprising nickel (Ni), iron (Fe) and/or cobalt (Co), and mixtures thereof. Preferably, the magnetic layer is preferably selected from the group consisting of nickel (Ni), iron (Fe) and cobalt (Co) and alloys and mixtures thereof. It is particularly preferred that the magnetic thin film interference pigments comprise a seven-layer Fabry-Perot absorber/dielectric/ref lector/magnetic/reflector/dielectric/absorber multilayer structure consisting of a $Cr/MgF_2/Al/Ni/Al/MgF_2/Cr$ multilayer structure.

Magnetic thin film interference pigments described herein are typically manufactured by vacuum deposition of the different required layers onto a web. After deposition of the desired number of layers, e.g. by PVD, the stack of layers is removed from the web, either by dissolving a release layer in a suitable solvent or by stripping the material from the web. The so-obtained material is then broken down to flakes which have to be further processed by grinding, milling or any suitable method. The resulting product consists of flat flakes with broken edges, irregular shapes and different aspect ratios. Further information on the preparation of magnetic thin film interference pigments can be found e.g. in EP-A 1 710 756, which is hereby incorporated by reference.

Suitable magnetic cholesteric liquid crystal pigments exhibiting optically variable characteristics include without limitation monolayered cholesteric liquid crystal pigments and multilayered cholesteric liquid crystal pigments Such pigments are disclosed for example in WO 2006/063926 A1, U.S. Pat. Nos. 6,582,781 and 6,531,221. WO 2006/06392 A1 discloses monolayers and pigments obtained therefrom with high brilliance and colorshifting properties with additional particular properties such as magnetizability. The disclosed monolayers and pigments, which are obtained therefrom by comminuting said monolayers, comprise a three-dimensionally crosslinked cholesteric liquid crystal mixture and magnetic nanoparticles. U.S. Pat. Nos. 6,582,781 and 6,410,130 disclose platelet-shaped cholesteric multilayer pigments which comprise the sequence $A^1/B/A^2$, wherein $A^1$ and $A^2$ may be identical or different and each comprises at least one cholesteric layer, and B is an interlayer absorbing all or some of the light transmitted by the layers $A^1$ and $A^2$ and imparting magnetic properties to said interlayer. U.S. Pat. No. 6,531,221 discloses platelet-shaped cholesteric multilayer pigment which comprise the sequence A/B and if desired C, wherein A and C are absorbing layers comprising pigments imparting magnetic properties, and B is a cholesteric layer.

In addition to the non-spherical magnetic or magnetizable particles (which may or may not comprise or consist of non-spherical optically variable magnetic or magnetizable pigments), also non-magnetic or non-magnetizable particles may be contained in the OEL in areas outside and/or inside the nested loop-shaped areas. These particles may be colour pigments known in the art, having or not having optically variable properties. Further, the particles may be spherical or non-spherical and may have isotropic or non-isotropic optical reflectivity.

In the OEL, the non-spherical magnetic or magnetizable particles described herein are dispersed in a binder material. Preferably, the non-spherical magnetic or magnetizable particles are present in an amount from about 5 to about 40 weight percent, more preferably about 10 to about 30 weight percent, the weight percentages being based on the total dry weight of the OEL, comprising the binder material, the non-spherical magnetic or magnetizable particles and other optional components of the OEL.

As described previously, the hardened binder material is at least partially transparent to electromagnetic radiation of one or more wavelengths in the range of 200-2500 nm, more preferably in the range of 200-800 nm, even more preferably in the range of 400-700 nm. The binder material is thus, at least in its hardened or solid state (also referred to as second state below), at least partially transparent to electromagnetic radiation of one or more wavelengths in the range of about 200 nm to about 2500 nm, i.e. within the wavelength range which is typically referred to as the "optical spectrum" and which comprises infrared, visible and UV portions of the electromagnetic spectrum such that the particles contained in the binder material in its hardened or solid state and their orientation-dependent reflectivity can be perceived through the binder material.

More preferably, the binder material is at least partially transparent in the range of visible spectrum between about 400 nm to about 700 nm. Incident electromagnetic radiation, e.g. visible light, entering the OEL through its surface can then reach the particles dispersed within the OEL and be reflected there, and the reflected light can leave the OEL again for producing the desired optical effect. If the wavelength of incident radiation is selected outside the visible range, e.g. in the near UV-range, then the OEL may also serve as a covert security feature, as then typically technical means will be necessary to detect the (complete) optical effect generated by the OEL under respective illuminating conditions comprising the selected non-visible wavelength in this case, it is preferable that the OEL and/or the loop-shaped elements contained therein comprises luminescent pigments. The infrared, visible and UV portions of the electromagnetic spectrum approximately correspond to the wavelength ranges between 700-2500 nm, 400-700 nm, and 200-400 nm respectively.

If the OEL is to be provided on a substrate, it is, for the application of the coating composition on a substrate in order to form the OEL, necessary that the coating composition comprising at least the binder material and the non-spherical magnetic or magnetizable particles is in form that allows processing of the coating composition, e.g. by printing, in particular copperplate intaglio printing, screen printing, gravure printing, flexography printing or roller coating, to thereby apply the coating composition to the substrate, such as a paper substrate or those described hereafter. Further, after application of the coating composition on a surface, preferably a substrate, the non-spherical magnetic or magnetizable particles are oriented by applying a magnetic field. Hereby, the non-spherical magnetic or magnetizable particles are oriented along the field lines at least in a plurality of nested loop-shaped areas, wherein the particles are oriented such as to provide the desired light reflection (typically such that at least a part of the particles are oriented with their magnetic axis for magnetic particles and their longest axis for magnetizable particles parallel to the plane of the OEL/the substrate surface). Herein, the non-spherical magnetic or magnetizable particles are oriented in nested loop-shaped areas of the coating composition on the supporting surface of a magnetic field generating device or on a substrate such that, to a viewer regarding the substrate from a direction normal to the plane of the substrate, the optical impression of a plurality of nested loop-shaped bodies is formed. Subsequently or simultaneously with the step of orienting/aligning the non-spherical magnetic or magnetizable particles by applying a magnetic field, the orientation of the particles is fixed. The coating composition must thus noteworthy have a first state, i.e. a liquid or pasty state, wherein the coating composition is wet or soft enough, so that the non-spherical magnetic or magnetizable particles dispersed in the coating composition are freely movable, rotatable and/or orientable upon exposure to a magnetic field, and a second hardened (e.g. solid) state, wherein the non-spherical particles are fixed or frozen in their respective positions and orientations.

Such a first and second state is preferably provided by using a certain type of coating composition. For example, the components of the coating composition other than the magnetic or magnetizable particles may take the form of an ink or coating composition such as those which are used in security applications, e.g. for banknote printing.

The aforementioned first and second state can be provided by using a material that shows a great increase in viscosity in reaction to a stimulus such as for example a temperature change or an exposure to an electromagnetic radiation. That is, when the fluid binder material is hardened or solidified, said binder material converts into the second state, i.e. a hardened or solid state, where the particles are fixed in their current positions and orientations and can no longer move nor rotate within the binder material.

As known to those skilled in the art, ingredients comprised in an ink or coating composition to be applied onto a surface such as a substrate and the physical properties of said ink or coating composition are determined by the nature of the process used to transfer the ink or coating composition to the surface. Consequently, the binder material comprised in the ink or coating composition described herein is typically chosen among those known in the art and depends on the coating or printing process used to apply the ink or coating composition and the chosen hardening process. Alternatively, a polymeric thermoplastic binder material or a thermoset may be employed. Unlike thermosets, thermoplastic resins can be repeatedly melted and solidified by heating and cooling without incurring any important changes in properties. Typical examples of thermoplastic resin or polymer include without limitation polyamides, polyesters, polyacetals, polyolefins, styrenic polymers, polycarbonates, polyarylates, polyimides, polyether ether ketones (PEEK), polyetherketeoneketones (PEKK), polyphenylene based resins (e.g. polyphenylenethers, polyphenylene oxides, polyphenylene sulfides), polysulphones and mixtures of these.

After application of the coating composition on a supporting surface of a magnetic-field-generating device or a substrate, and orientation of the magnetic or magnetizable particles, the coating composition is hardened (i.e. turned to a solid or solid-like state) in order to fix the orientation of the particles.

The hardening can be of purely physical nature, e.g. in cases where the coating composition comprises a polymeric binder material and a solvent and is applied at high temperatures. Then, the particles are oriented at high temperature by the application of a magnetic field, and the solvent is evaporated, followed by cooling of the coating composition. Thereby the coating composition is hardened and the orientation of the particles is fixed.

Alternatively and preferably, the "hardening" of the coating composition involves a chemical reaction, for instance by curing, which is not reversed by a simple temperature increase (e.g. up to 80° C.) that may occur during a typical use of a security document. The term "curing" or "curable" refers to processes including the chemical reaction, cross-linking or polymerization of at least one component in the applied coating composition in such a manner that it turns into a polymeric material having a greater molecular weight than the starting substances. Preferably, the curing causes the formation of a three-dimensional polymeric network.

Such a curing is generally induced by applying an external stimulus to the coating composition (i) after its application on a supporting surface or a substrate, and (ii) subsequently or simultaneously with the orientation of the magnetic or magnetizable particles. Therefore, preferably the coating composition is an ink or coating composition selected from the group consisting of radiation curable compositions, thermal drying compositions, oxidatively drying compositions, and combinations thereof. Particularly preferably, the coating composition is an ink or coating composition selected from the group consisting of radiation curable compositions.

Preferable radiation curable compositions include compositions that may be cured by UV-visible light radiation (hereafter referred as UV-Vis-curable) or by E-beam radiation (hereafter referred as EB). Radiation curable compositions are known in the art and can be found in standard textbooks such as the series "Chemistry & Technology of UV & EB Formulation for Coatings, Inks & Paints", published in 7 volumes in 1997-1998 by John Wiley & Sons in association with SITA Technology Limited.

According to one particularly preferred embodiment of the present invention, the ink or coating composition described herein is a UV-Vis-curable composition. UV-Vis curing advantageously allows very fast curing processes and hence drastically decreases the preparation time of the OEL according to the present invention and articles and documents comprising said OEL. Preferably, the UV-Vis-curable composition comprises one or more compounds selected from the group consisting of radically curable compounds, cationically curable compounds and mixtures thereof. Cationically curable compounds are cured by cationic mechanisms typically including the activation by radiation of one or more photoinitiators which liberate cationic species, such as acids, which in turn initiate the curing so as to react and/or cross-link the monomers and/or oligomers to thereby harden the coating composition. Radically curable compounds are cured by free radical mechanisms typically including the activation by radiation of one or more photoinitiators, thereby generating radicals which in turn initiate the polymerization so as to harden the coating composition.

The coating composition may further comprise one or more machine readable materials selected from the group consisting of magnetic materials, luminescent and/or phosphorescent materials, electrically conductive materials, infrared-absorbing materials and mixtures thereof. As used herein, the term "machine readable material" refers to a material which exhibits at least one distinctive property which is not perceptible by the naked eye, and which can be comprised in a layer so as to confer a way to authenticate said layer or article comprising said layer by the use of a particular equipment for its authentication.

The coating composition may further comprise one or more coloring components selected from the group consisting of organic and inorganic pigments and organic dyes, and/or one or more additives. The latter include without limitation compounds and materials that are used for adjusting physical, rheological and chemical parameters of the coating composition such as the viscosity (e.g. solvents, thickeners and surfactants), the consistency (e.g. anti-settling agents, fillers and plasticizers), the foaming properties (e.g. antifoaming agents), the lubricating properties (waxes, oils), UV stability (photosensitizers and photostabilizers), the adhesion properties, the antistatic properties, the storage stability (polymerization inhibitors) etc. Additives described herein may be present in the coating composition in amounts and in forms known in the art, including in the form of so-called nano-materials where at least one of the dimensions of the additives is in the range of 1 to 1000 nm.

Following or simultaneously with the application of the coating composition on a supporting surface of a magnetic-field-generating device or a substrate, the non-spherical magnetic or magnetizable particles are oriented by the use of an external magnetic field for orienting them according to a desired orientation pattern in areas corresponding to two or more loop shapes. Thereby, a permanent magnetic particle is oriented such that its magnetic axis is aligned with the direction of the external magnetic field line at the particle's location. A magnetizable particle without an intrinsic permanent magnetic field is oriented by the external magnetic field such that the direction of its longest dimension is aligned with an external magnetic field line at the particle's location. The above applies analogously in the event that the particles should have a layer structure including a layer having magnetic or magnetizable properties.

Upon applying a magnetic field, the non-spherical magnetic or magnetizable particles adopt an orientation in the layer of the coating composition in such a manner that a security element (an OEL) providing an optical effect or optical impression that includes at least a plurality of nested loop-shaped bodies is produced, which is visible from at least one surface of the OEL (see e.g. FIGS. 3B, 6E, 15B, 15C and 24). Consequently, the dynamic loop-shaped element can be seen by an observer as a reflection zone that exhibits a dynamic visual motion effect upon tilting of the OEL, said loop-shaped element appearing to move in a different plane than the rest of the OEL. Subsequently or simultaneously with the orientation of the non-spherical magnetic or magnetizable particles, the coating composition is hardened to fix the orientation, e.g. by irradiation with UV-Vis light in the case of a UV-Vis-curable coating composition.

Under a given direction of incident light, e.g. vertical (perpendicular to the OEL surface), the zone of highest reflectivity, i.e. of specular reflection at non-spherical magnetic or magnetizable particles, of an OEL (L) comprising the particles with fixed orientation changes location as a function of the viewing (tilt) angle: looking at the OEL (L) from the left side, loop-shaped bright zones are seen at location 1, looking at the layer from the top, loop-shaped bright zones are seen at location 2, and looking at the layer from the right side, loop-shaped bright zones are seen at location 3. Upon changing the viewing direction from left to right, the loop-shaped bright zones appear thus to move as well from left to right. It is also possible to obtain the opposite effect, that upon changing the viewing direction from left to right, the loop-shaped bright zones appear to move from right to left. Depending on the sign of the curvature of the non-spherical magnetic or magnetizable particles present in the nested loop-shaped areas of the OEL, which may be negative (see FIG. 1B) or positive (see FIG. 1C), the dynamic loop-shaped bodies are observable as moving towards the observer (in the case of a positive curve, FIG. 1C) or moving away from the observer (negative curve, FIG. 1B) in relation to a movement performed by the observer relative to the OEL. Notably, the position of the observer is above the OEL in FIG. 1. Such a dynamic optical effect or optical impression is observed if the OEL is tilted, and, due to the loop-shape the effect can be observed regardless of the tilting direction of e.g. a banknote on which the OEL is provided. For instance, the effect can be observed when a banknote carrying the OEL is tilted from left to right and also up and down.

Figure 21A:
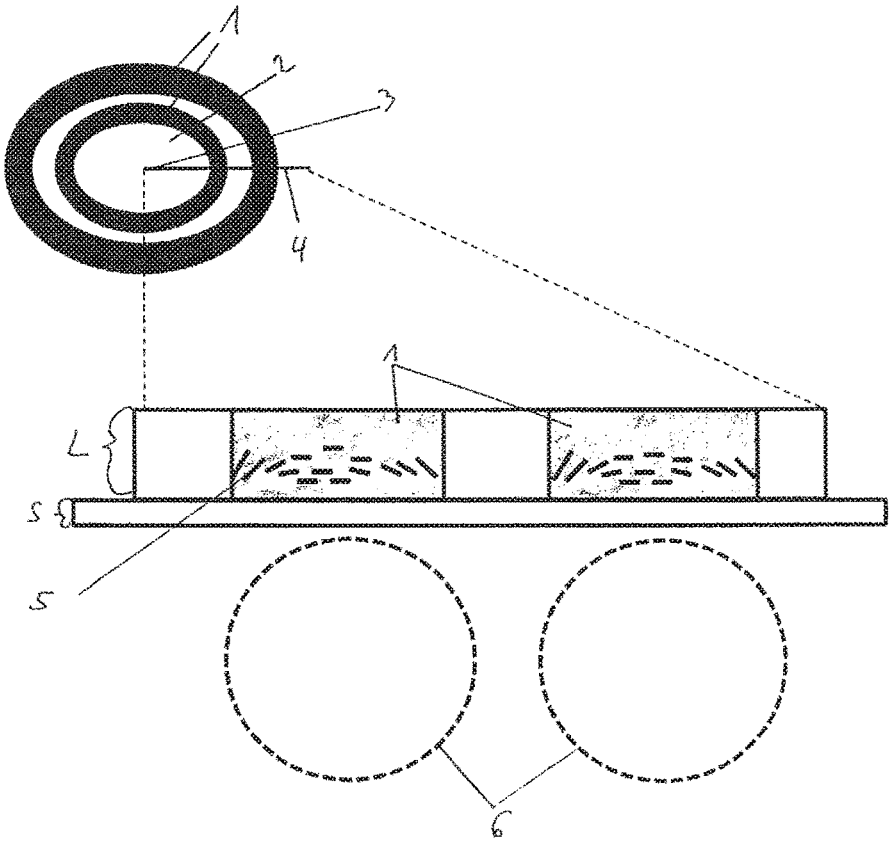
FIG. 21A, 21B illustrate the orientation of non-spherical magnetic or magnetizable particles in loop-shaped areas of embodiments of the OEL.
Figure 21B:
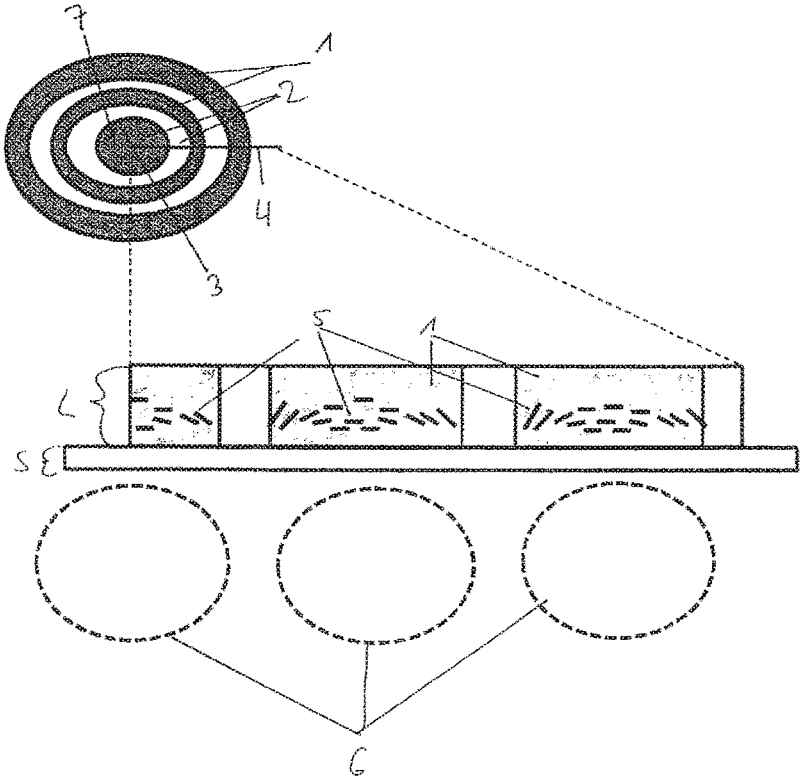

The nested loop-shaped areas of the OEL comprise the non-spherical magnetic or magnetizable particles and define a common central area. The outer loop shape(s) surround the common central area and one or more inner loop-shaped areas, preferably such that the nested loop-shaped areas do not cross each other. As shown in FIG. 21, in each of loop-shaped areas of the OEL and in a cross section perpendicular to the OEL plane and extending from the center of the central area to the outer boundary of the outermost loop-shaped area, the non-spherical magnetic or magnetizable particles in each of the loop-shaped areas follow a tangent of either the negatively curved or the positively curved part of a hypothetical ellipse or circle (illustrated by circles in FIG. 21A and by ellipses in FIG. 21B). In such a cross-sectional view, the ellipse or circle for each loop-shaped area preferably has its center located along a line extending perpendicular from about the center of the width of the respective loop-shaped area, and/or the diameter of each of the circles and/or the longest or shortest axis of each of the ellipses is about the same as the width of the respective area forming a loop shape. Such an orientation may also be expressed such that the orientation of the longest axis of the non-spherical magnetic or magnetizable particles follows the surface of a hypothetical semi-toroidal body lying in the plane of the OEL, as illustrated in FIG. 1.

Preferably, the orientation of the non-spherical particles in all of the plurality of loop shapes follow the same curved part of the surface of a hypothetical semi-toroidal body lying in the plane of the OEL (i.e. all following the tangent of a positively curved part of a hypothetical ellipse or circle, or all following a tangent of the negatively curved part of a hypothetical ellipse or circle).

Figure 2A:
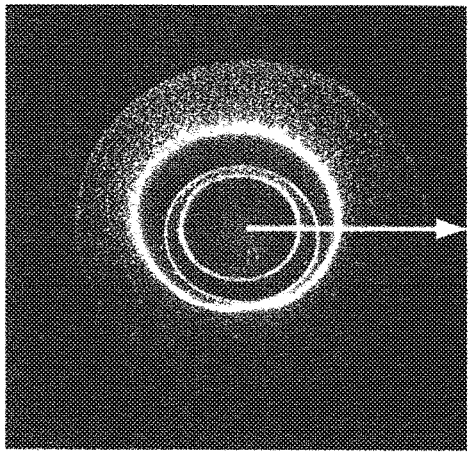
Figure 2B:
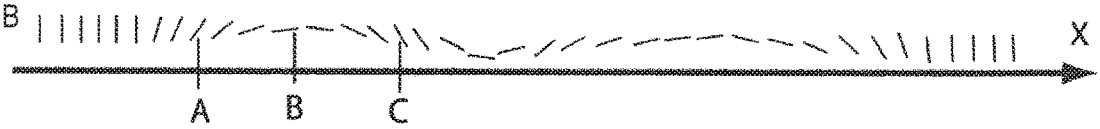
Figure 2C:
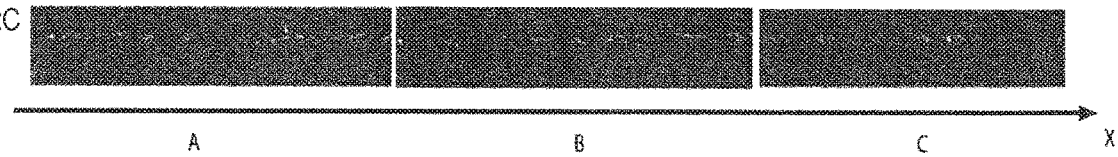

In another preferred embodiment, the orientation of the non-spherical magnetic or magnetizable particles in respective loop-shaped areas is alternating, such that for instance the orientation of the non-spherical particles in the first (innermost), third, fifth etc. of the nested loop-shaped areas each follow a tangent of the negatively curved parts of theoretical ellipses or circles, and wherein the orientation of the non-spherical magnetic or magnetizable particles in the second, fourth etc. of the nested loop-shaped areas each follows a tangent of the positively curved parts of theoretical ellipses or circles. Of course, also the opposite orientation is possible. Further, again, each of the hypothetical ellipses or circles have their respective centers preferably along hypothetical lines extending perpendicular from the plane of the OEL at positions that correspond to about the center of the width of an area forming a loop shape in a cross-sectional view perpendicular to the OEL surface, and preferably the circles and ellipses have a diameter or a longest or shortest axis, respectively, corresponding to the width of the respective area, as shown for the width of two loop-shaped areas in FIGS. 21A and 21B. The orientation of the particles in such an alternating arrangement is also illustrated in FIG. 2A, wherein the positions A, B, and C correspond to the innermost of the nested loop-shaped areas, which is followed by a similar orientation on the right hand side of the figure, forming the third loop-shaped area. In both the innermost and the third loop-shaped area, the orientation of the particles follows a tangent to the negatively curved part of hypothetical ellipses having their center along a line extending from the middle of the respective area (the width) and having a diameter corresponding to the width of the area. In between the innermost and the third loop-shaped area, the particles in the second loop-shaped area (at the center of FIG. 2B) follow a tangent to the positively curved part of hypothetical ellipses having their center along a line extending from the middle of the respective area (the width). By providing such an alternating arrangement, a high contrast and a very striking optical effect can be obtained.

The area in the in the common central area surrounded by the nested loop-shaped areas can be free of the magnetic or magnetizable particles, and in this case the void typically is not part of the OEL. This can be achieved by not providing the coating composition in the void when forming the OEL in the printing step.

Alternatively and preferably, however, the common central area is part of the OEL and is not omitted when providing the coating composition to the substrate. This allows for an easier manufacture of the OEL, since the coating composition can be applied to a greater part of the substrate. In such a case, there are also non-spherical magnetic or magnetizable particles present in the common central area. These can have a random orientation, providing no particular effect but a small light reflection. However, preferably the non-spherical magnetic or magnetizable particles present in the common central area are oriented such that their longest axis is substantially perpendicular to the plane of the OEL, thereby providing no or only very little light reflection.

The non-spherical magnetic or magnetizable particles outside the outermost of the plurality of nested loop-shaped areas can also be substantially perpendicular to the plane of the OEL, or can be randomly oriented.

Figure 1B:
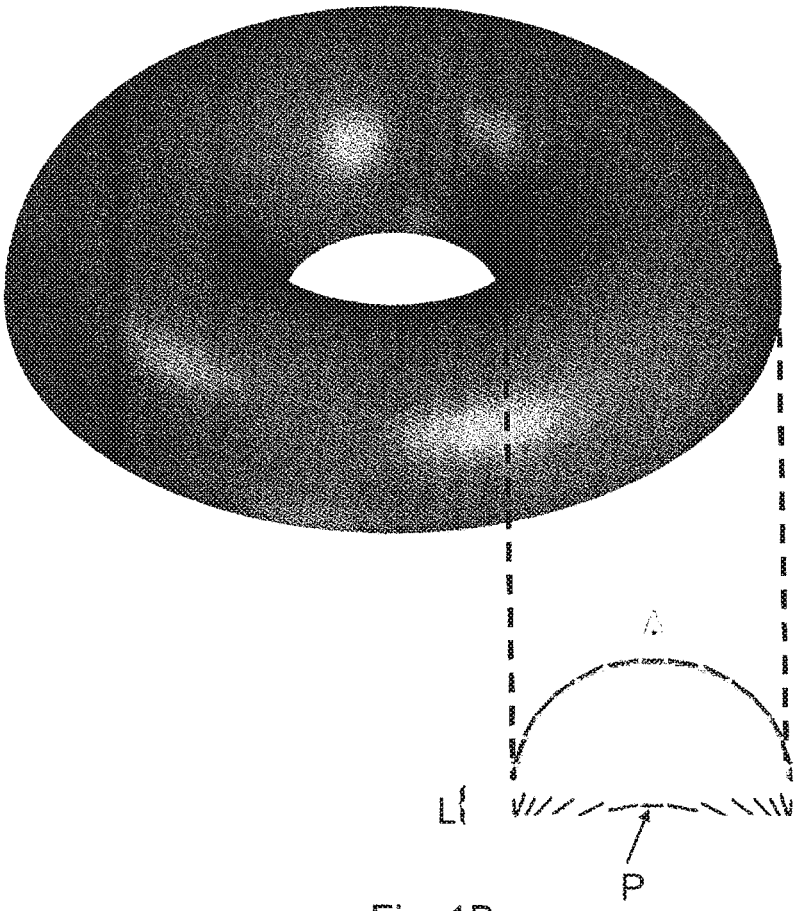
Figure 1C:
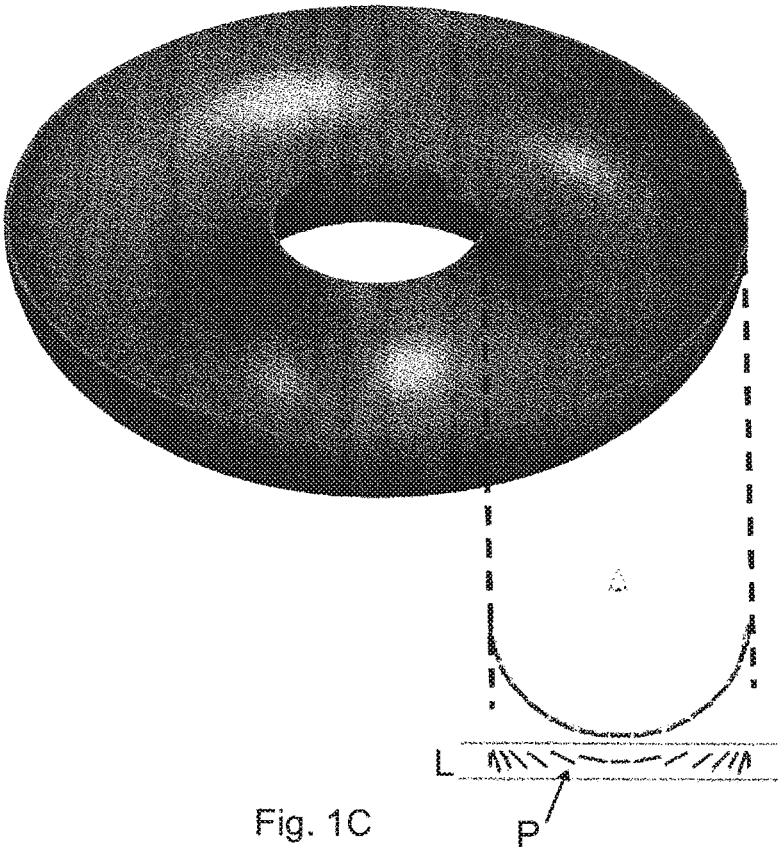

FIG. 1B depicts non-spherical magnetic or magnetizable particles (P) in an OEL (L) wherein the particles are fixed in the binder material, said particles following the negatively curved part of a hypothetical ellipse (represented by a semi-toroidal body). FIG. 1C depicts non-spherical magnetic or magnetizable particles in an OEL, wherein the particles follow the positively curved part of the surface of the hypothetical ellipse (represented by a semi-toroidal body).

In FIGS. 1 and 21, the non-spherical magnetic or magnetizable particles are preferably dispersed throughout the whole volume of the OEL, while for the purpose of discussing their orientation within the OEL in respect to the plane of the OEL, preferably provided on a substrate, it is assumed that the particles are all located within a same or similar planar cross-sections the OEL. These non-spherical magnetic or magnetizable particles are graphically depicted, each by a short line representing its longest diameter appearing within its cross-section shape. In reality and as shown in FIG. 14A, of course, some of the non-spherical magnetic or magnetizable particles may partially or fully overlap each other when viewed on the OEL.

The total number of non-spherical magnetic or magnetizable particles in the OEL may be appropriately chosen in function of the desired application; however, to make up a surface-covering pattern generating a visible effect, several thousands of particles, such as about 1,000-10,000 particles, are generally required in a volume corresponding to one square millimeter of OEL surface.

The plurality of non-spherical magnetic or magnetizable particles, which together produce the optical effect, may correspond to all or only to a subset of the total number of particles in the OEL. For example, the non-spherical magnetic or magnetizable particles in the nested loop-shaped areas of the OEL, producing the optical effect of nested loop-shaped bodies, may be combined with other particles contained in the binder material, which may be conventional or special color pigment particles.

In a particularly preferred embodiment of the present invention, the OEL described herein may further comprise a so-called "protrusion", which is surrounded by the innermost loop-shaped element and partly fills the central area defined thereby. The protrusion provides the illusion of a three-dimensional object, such as a half-sphere, present in the central area. The three-dimensional object seemingly extends from the OEL surface to the viewer (in a similar manner as looking on an upright standing or inverted bowl, depending on whether the particles follow a negative or a positive curve), or seemingly extends from the OEL away from the viewer. In these cases, the OEL comprises non-spherical magnetic or magnetizable particles in the central area, which are, in the region around the centre of the central area, oriented such as to have their longest axis substantially parallel to the plane of the OEL, forming the effect of the protrusion. The central area of the innermost dynamic loop-shaped body is thus filled with a central effect image element that can be a solid circle of a half-sphere, e.g. in the case the loop-shaped bodies form a circles, or which can have a triangular basis in the case the case of a triangular loop-bodies. In such embodiments, at least a part of the outer peripheral shape of the protrusion is similar to the shape of the innermost of the nested loop-shaped bodies, and the outer periphery of the protrusion preferably follows the form of the innermost of the nested loop-shaped bodies (i.e. the protrusion has the shape of a solid circle or provides the optical effect or optical impression of a filled hemisphere when the loop-shaped areas are round, or is solid triangle or a triangular pyramid in case the loop-shaped areas are triangles). According to one embodiment of the present invention, at least a part of the outer peripheral shape of the protrusion is similar to the shape of the innermost loop-shaped body and preferably, the loop-shaped body has the form of a ring, and the protrusion has the shape of a solid circle or half-sphere. Particularly preferably, the outer peripheral shape of the protrusion is similar to the shape of the all loop-shaped bodies, such as in a solid circle surrounded by several (such as 2, 3, 4, 5, 6, 7 or more) rings. A possible realization of such an embodiment is illustrated in FIG. 21B. As shown on the top of FIG. 21B, the common central area (2) is filled with a protrusion. In a cross sectional view along a line (4) extending from the centre (3) of the common central area (2) surrounded by the loop-shaped areas providing the optical effect or optical impression of two loop-shaped bodies (1), the orientation in the loop-shaped areas is the same as described above. In the area forming the protrusion in the central area, the orientation of the non-spherical magnetic or magnetizable particles (5) follows a tangent of the positively curved or the negatively curved part of a hypothetical ellipse or circle, the ellipse or circle preferably having its centre along a line perpendicular to the cross-section (i.e. vertical in FIG. 21B) and located such as to extend through about the centre (3) of the common central area surrounded by the innermost loop-shaped area (in the bottom of FIG. 21B, only the part of the protrusion from the centre to its boundary is shown). Further, the longest or shortest axis of the hypothetical ellipse or the diameter of the hypothetical circle is preferably about the same as the diameter of the protrusion, so that the orientation of the longest axis of the non-spherical particles at the centre of the protrusion is substantially parallel to the plane of the OEL, and substantially perpendicular to the plane of the OEL at the boundary of the protrusion. Again, in the common central area forming the protrusion, the rate of change in orientation may be constant in such a cross-sectional view (the orientation of the particles follows a tangent to a circle) or may vary (the orientation of the particles follows a tangent of an ellipse). Also, preferably the change in orientation of the non-spherical magnetic or magnetizable particles in the protrusion follows the same direction as in the loop-shaped areas (following either a positive or a negative curvature), or the change in orientation follows alternating directions in the protrusion, the second, fourth, sixth etc. of the nested loop-shaped areas and the first, third, fifth etc of the nested loop-shaped areas.

Preferably, there is the optical impression of a gap between the inner boundary of the innermost loop-shaped body and the outer boundary of the protrusion. The optical impression of such a gap can be achieved by orienting the non-spherical magnetic or magnetizable particles in the area between the inner boundary of the loop-shaped area and the outer boundary of the protrusion substantially perpendicular to the plane of the OEL, or by orienting the non-spherical magnetic or magnetizable particles in the area between the inner boundary of the loop-shaped area and the outer boundary of the protrusion substantially with an opposite sign curve as compared to the curve of protrusion and of the innermost loop-shaped element. Further, the protrusion preferably occupies about at least 20% of the area defined by the inner boundary of the innermost of the nested loop-shaped areas, more preferably about at least 30%, and most preferably about at least 50%.

Next, referring to FIGS. 3-20 and 23A-25, a description will be given of the magnetic-field-generating devices of the present invention, which are capable of orienting the non-spherical magnetic or magnetizable particles in the OEL to provide light reflection in nested loop-shaped areas, thereby forming the OEL providing the optical impression of a plurality of nested loop-shaped bodies of the present invention. Alternatively, the magnetic-field-generating devices described herein may be used to provide a partial OEL, i.e. a security feature displaying part or parts of loop-shapes such as for example ½ circles, ¼ circles, etc.

In the broadest aspect, the magnetic field generating device of the present invention comprises a plurality of elements selected from magnets and pole pieces and comprising at least one magnet, the plurality of elements being either (i) located below a supporting surface or a space configured to receive a substrate acting as supporting surface or (ii) forming a supporting surface, and being configured such as to be capable of providing a magnetic field wherein magnetic field lines run substantially parallel to said supporting surface or space in two or more areas above said supporting surface or space, and wherein i) the two or more areas form nested loop-shaped areas surrounding a central area; and/or ii) the plurality of elements comprise a plurality of magnets, and the magnets are arranged rotatable around an axis of rotation such that the areas with field lines running substantially parallel to the supporting surface or space combine upon rotation around the axis of rotation, thereby forming, upon rotation around the axis of rotation, a plurality of nested loop-shaped areas surrounding one central area. The magnetic-field-generating devices of the present invention thus can generally be classified into static magnetic-field-generating devices (option i)) and rotational magnetic-field-generating devices (option ii)). In the static magnetic-field-generating devices, the loop-shaped areas of the OEL, in which the orientation of the non-spherical magnetic or magnetizable particles is to be effected, are reflected in the design of the magnetic-field-generating device. Put differently, in the static magnetic-field-generating devices, no movement of the magnetic-field-generating device relative to the coating composition comprising the non-spherical magnetic or magnetizable particles is necessary for orienting the non-spherical magnetic or magnetizable particles in the nested loop-shaped areas, and the orientation of the non-spherical magnetic or magnetizable particles in the nested loop-shaped areas is achieved by bringing the coating composition or a support carrying the coating composition in a first state into contact with or close to the static magnetic-field-generating device. Conversely, in the rotational magnetic-field-generating devices, the loop shape of the nested loop-shaped areas is not as such reflected in the design of the magnets of the magnetic-field-generating device, but instead the orientation of the non-spherical magnetic or magnetizable particles in the loop shape areas of the OEL is effected by a loop-shaped movement of the magnets of the magnetic-field-generating devices relative to the support or a supporting surface of a magnetic-field-generating device carrying the coating composition in a first state.

In one embodiment, the magnetic-field-generating devices of the present invention typically comprise a supporting surface, above or on which a layer (L) of the coating composition in a fluid state (prior to hardening) and comprising the plurality of non-spherical magnetic or magnetizable particles (P) is provided. This supporting surface is positioned at a given distance (d) from the poles of the magnet(s) (M) and is exposed to the average magnetic field of the device.

Such a supporting surface may be a part of a magnet that is part of the magnetic-field-generating device. In such an embodiment, the coating composition can be directly applied to the supporting surface (the magnet), on which the orientation of the non-spherical magnetic or magnetizable particles takes place. After orienting or simultaneous with the orientation, the binder material is converted to a second state (e.g. by irradiation in case of a radiation curable composition), forming a hardened film that can be peeled off the supporting surface of the magnetic-field-generating device. Thereby, an OEL in the form of a film or sheet can be produced, wherein the oriented non-spherical particles are fixed in a binder material (typically a transparent polymeric material in this case).

Alternatively, the supporting surface of the magnetic-field-generating device of the present invention is formed by a thin (typically less than 0.5 mm thickness, such as 0.1 mm thickness) plate made from a non-magnetic material, such as a polymeric material or a metal plate made from a non-magnetic material, such as for example aluminum. Such a plate forming the supporting surface is provided above the one or more magnets of the magnetic-field-generating device. Then, the coating composition can be applied to the plate (the supporting surface), followed by orientation and hardening of the coating composition, forming an OEL in the same manner as described above.

Of course, in both embodiments above (in which the supporting surface is either part of a magnet or is formed by a plate above a magnet), also a substrate (made e.g. from paper or from any other substrate described hereafter) on which the coating composition is applied can be provided on the supporting surface, followed by orientation and hardening. Notably, the coating composition can be provided on the substrate before the substrate with the applied coating composition is placed on the supporting surface, or the coating composition can be applied on the substrate at a point in time where the substrate is already placed on the supporting surface. In either case, the OEL may be provided on a substrate, which is a preferred embodiment of the present invention.

However, if the OEL is to be provided on a substrate, the substrate can also take the role of a supporting surface, replacing the plate. In particular if the substrate is dimensionally stable, it may not be necessary to provide e.g. a plate for receiving the substrate, but the substrate may be provided on or above the magnet without a supporting plate interposed therebetween at a space of the magnetic field generating that is configured to receive a substrate (i.e. the space that would otherwise be taken by the supporting plate). In the following description, the term "supporting surface", in particular with regard to the orientation of magnets in respect thereof, may in such embodiments therefore relate to a position or plane that is taken by the substrate surface without an intermediate plate being provided, i.e. wherein the substrate replaces the supporting surface. In the following, the term "supporting surface" may therefore be replaced by "substrate" or "space configured for receiving a substrate" in order to describe such embodiments. For reasons of conciseness, this is not explicitly stated in each instance.

An embodiment of a static magnetic-field-generating device according to the present invention is one wherein a loop-shaped axially magnetized dipole magnet is provided such that the North-South axis is perpendicular to the supporting surface or space, wherein the loop-shaped magnet surrounds a central area, and the device further comprises a pole piece that is provided below the loop-shaped axially magnetized dipole magnet with respect to the supporting surface or the space and that closes one side of the loop formed by the loop-shaped magnet, and wherein the pole piece forms one or more projections extending into the space surrounded by the loop-shaped magnet and being spaced apart therefrom, wherein a1) the pole piece forms one projection that extends into the central area surrounded by the loop-shaped magnet, wherein the projection is laterally spaced apart from the loop-shaped magnet and fills a part of the central area. A possible realization of such a device is schematically depicted in FIG. 3A. Described differently, the device comprises a loop-shaped dipole magnet (M) (a ring in FIG. 3A) positioned at a periphery of the device, which is magnetized in axial direction (i.e. the North-South direction points towards or away from the supporting surface or substrate (S) carrying the coating composition in a first state, forming the layer (L). The device further comprises a pole piece, in this case an inverted T-shaped iron yoke (Y), which is provided below the loop-shaped magnet and closes one side of the loop opposite the side where the supporting surface (S) carrying the coating composition in a first state is to be provided. A pole piece denotes a structure composed of a material having high magnetic permeability, preferably a permeability between about 2 and about 1,000,000 $NA^{-2}$ (Newton per square Ampere), more preferably between about 5 and about 50,000 $NA^{-2}$ and still more preferably between about 10 and about 10,000 $NA^{-2}$. The pole piece serves to direct the magnetic field produced by a magnet. Preferably, the pole piece described herein comprises or consists of an inverted T-shaped iron yoke (Y). The pole piece further extends from this side in the center of the space surrounded by the loop-shaped magnet (M). In a cross-sectional view, the device thus has the shape of a tilted E, as shown in the left part of FIG. 3*a*, with the top and bottom line of the E being formed by the loop-shaped magnet (M) and the remainder of the E-structure by pole piece (Y). The device and the three-dimensional field of the magnet (M) in space are rotationally-symmetric with respect to a central vertical axis (z).

As derivable from the field lines in FIG. 3A, the device leads to the orientation of the non-spherical magnetic or magnetizable particles (P) such as to provide the impression of two loop-shaped closed bodies each in the form of a ring.

Further, it is immediately evident that the field lines at a given position on the supporting surface or substrate (S), which determine the orientation of the magnetic or magnetizable particles (P), vary with the distance (d) of the supporting surface or substrate (S) from the magnet of the magnetic-field generating device. In the present invention, the distance (d) between the supporting surface or the substrate surface (S) on the side facing the magnetic-field-generating device and the closest surface of a magnet of the magnetic-field-generating device is generally in the range between 0 to about 5 millimeters, preferably between about 0.1 and about 5 millimeters, and is selected such as to produce the appropriate dynamic loop-shaped element, according to the design needs. The supporting surface may be a supporting plate which has preferably a thickness equals the distance (d), which allows for a mechanically solid assembly of the magnetic-field-generating device, without intermediate central areas. The supporting surface may be a supporting plate made of a non-magnetic material, such as a polymeric material or a non-magnetic metal, e.g. aluminum. If the distance (d) is too big, the orientation of the non-spherical magnetic or magnetizable particles in the loop-shaped element may not confer the impression of well-defined loop-shaped bodies, i.e. the visual effect or visual impression may be blurred, and it may be difficult to distinguish between or to resolve different loop shapes or loop-shaped bodies. This problem does not occur if there is direct contact with the magnetic-field-generating device, yet it may be preferable for production purposes to have a tiny gap (e.g. less 3 mm, preferably less than 1 mm) between the magnetic-field-generating device and the substrate in order to avoid contact of the substrate—or the coating composition in a first state present thereon—with the magnetic-field-generating device, in particular if the magnetic-field-generating device is positioned on the same side of the substrate on which the coating composition is applied (in order to obtain an orientation of the particles in the loop-shaped areas that follows a tangent to a positively curved part of a hypothetical ellipse, in particular a hypothetical circle as shown in FIG. 1C). Of course, the above applies not only to the magnetic-field-generating device shown in FIG. 3A, but to all static and rotational magnetic-field-generating devices of the present invention.

FIG. 3B shows photographs of the resulting OEL, comprising two nested loop-shaped bodies in the form of concentric rings surrounding a common central area. The photograph in the middle of FIG. 3B shows a plan view of the OEL, and the photographs on the left and right side of FIG. 3B show the OEL when viewed from a direction left or right to the normal of the OEL, respectively. As seen in these figures, the optical effect or optical impression is dynamic, i.e. the rings seem to perform a movement upon a change of the viewing angle: In the photograph on the left, the distance between the inner and the outer ring appears to be smaller on the left side of the inner ring than on the right side of the inner ring, whereas the opposite effect is observed if the OEL is viewed from the other side, as in the right hand photograph of FIG. 3B.

Figure 4:
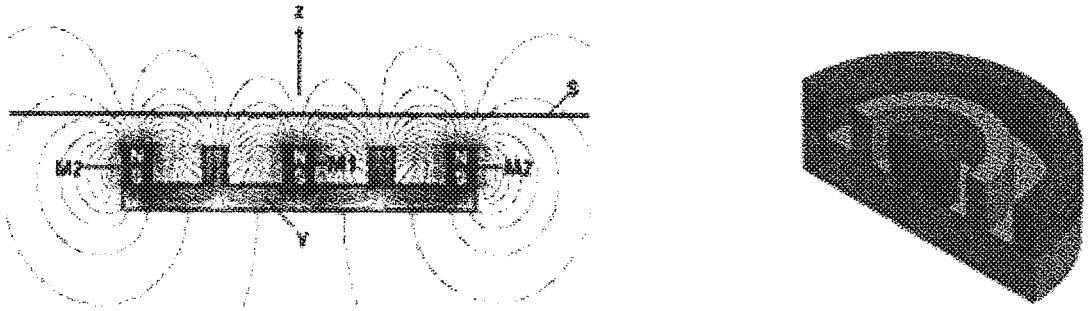
FIG. 4 schematically depicts an embodiment of a magnetic-field-generating device according to another embodiment of the present invention, the device comprising i) a bar dipole magnet (M1), which is magnetized such as to have its North-South axis perpendicular to the supporting surface (S), ii) a dipole magnet in the form of a loop-shaped hollow body (M2), which is also magnetized such as to have its North-South axis perpendicular to the supporting surface (S), and iii) an inverted double-T-shaped iron yoke (Y).

In another embodiment of the present invention related to a magnetic field generating device wherein a loop-shaped axially magnetized dipole magnet is provided such that the North-South axis is perpendicular to the supporting surface or space, wherein the loop-shaped magnet surrounds a central area, and the device further comprises a pole piece that is provided below the loop-shaped axially magnetized dipole magnet with respect to the supporting surface or the space and that closes one side of the loop formed by the loop-shaped magnet, and wherein the pole piece forms one or more projections extending into the space surrounded by the loop-shaped magnet and being spaced apart therefrom, wherein a2) the pole piece forms one loop-shaped projection and surrounds a central bar dipole magnet having the same North-South direction as the loop-shaped magnet, the projection and the bar dipole magnet being spaced apart from each other. One possible realization of such a device is schematically illustrated in FIG. 4. The device is similar to the one of FIG. 3 in that is also comprises a loop-shaped ring magnet (M2) at the periphery of the device, which is magnetized in axial direction (i.e. the North-South direction points towards or away from the support carrying the coating composition in a first state). Also, the device has pole piece (an iron yoke (Y)) positioned below, i.e. opposite to the side where the supporting surface or substrate (S) carrying the coating composition in a first state, is to be provided, in a form corresponding to the loop shape of the magnet (M) and closing one side of the loop. The pole piece also extends from this side in the central area surrounded by the loop-shaped magnet, yet, unlike in FIG. 3, this extension of the pole piece is not solid, but defines another inner loop. Within this inner loop formed by the extension of the pole piece, a bar dipole magnet (M1) having the same orientation of the magnetic North-South direction is positioned. In a cross-sectional view (left in FIG. 4), the pole piece take a double inverted T shape.

Again, in the embodiment depicted in FIG. 4, the magnetic-field-generating device and the magnetic field generated thereby are rotationally symmetric to a central vertical axis (z). Further, as derivable from the field lines shown in FIG. 4, such a device will lead to the orientation of the non-spherical magnetic or magnetizable particles as defined in claim 1 in three loop-shaped (ring-shaped in FIG. 4) areas of the OEL provided on the supporting surface or substrate (S), leading to the visual impression of three nested rings surrounding one central area.

Figure 5:
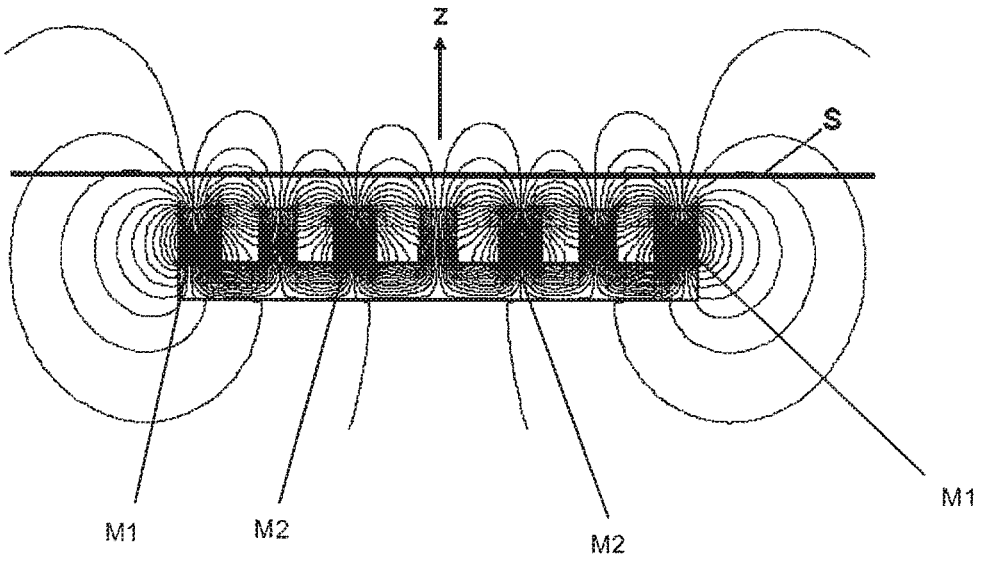
FIG. 5 schematically depicts the cross-section of a magnetic-field-generating device according to a further embodiment of the present invention, comprising a first (M1) and second (M2) dipole magnet each in the form of a loop-shaped body (i.e. each of the magnets forms a ring, and the magnet M2 is fully embedded (nested) within the ring of magnet M1), which are each magnetized such as to have their North-South axis perpendicular to the supporting surface (S), and a pole piece (an inverted triple-T-shaped iron yoke (Y))

An alternative embodiment of a static magnetic-field generating device of the present invention is one wherein a loop-shaped axially magnetized dipole magnet is provided such that the North-South axis is perpendicular to the supporting surface or space, wherein the loop-shaped magnet surrounds a central area, and the device further comprises a pole piece that is provided below the loop-shaped axially magnetized dipole magnet with respect to the supporting surface or the space and that closes one side of the loop formed by the loop-shaped magnet, and wherein the pole piece forms one or more projections extending into the space surrounded by the loop-shaped magnet and being spaced apart therefrom, wherein a3) the pole piece forms two or more spaced-apart projections, either all of these or all but one of these are loop-shaped, and, depending on the number of projections, one or more additional axially magnetized loop-shaped magnets having the same North South direction as the first axially magnetized loop-shaped magnet is/are provided in the space formed between the spaced-apart loop-shaped projections, the additional magnets being spaced apart from the loop-shaped projections, and wherein the central area surrounded by the loop-shaped projections and the loop-shaped magnets is partly filled with either a central bar dipole magnet having the same North-South direction as the surrounding loop-shaped magnets or with a central projection of the pole piece, such that as viewed from the supporting surface or the space, an alternating arrangement of spaced-apart loop-shaped pole piece projections and loop-shaped axially magnetized dipole magnets is formed, surrounding one central area, wherein the central area is filled either with a bar dipole magnet or a central projection as set out above. A possible embodiment of such a device is illustrated in FIG. 5. The device is similar to the one of FIGS. 3 and 4 in that it also comprises loop-shaped ring magnet (M1) at the periphery of the device, which is magnetized in axial direction (i.e. the North-South direction points towards or away from the support carrying the coating composition in a first state, not shown in FIG. 5). Also, the device has pole piece (an iron yoke (Y)) positioned below, i.e. opposite the side where the supporting surface or substrate (S) carrying the coating composition in a first state is to be provided, in a form corresponding to the loop shape of the magnet (M1) and closing one side of the loop. Similarly as seen in the right hand part of FIG. 4, the pole piece of the device of FIG. 5 extends from the side of the closed loop, forming an (internal) loop within the space defined by the loop-shaped magnet (M1). Within this internal loop defined by the extension of the pole piece (Y), there is provided another loop-shaped magnet (M2), defining an innermost space. The pole piece then also extends to the space inside this innermost space in a similar manner as shown in FIG. 3. In a cross-sectional view, the pole piece takes an inverted triple-T-shape.

As derivable from the field lines shown in FIG. 5, such a device will lead to the orientation of the non-spherical magnetic or magnetizable particles in four nested loop-shaped (ring-shaped in FIG. 5) areas on the supporting surface or substrate (S), leading to the visual impression of four nested rings surrounding one central area.

From the description of the devices above and as illustrated in FIGS. 3, 4 and 5, it is immediately evident that similar devices can be used for achieving an orientation of non-spherical magnetic or magnetizable particles in a larger number of nested loop-shaped areas on a substrate by modifying the structure of a central part (being either an extension of a pole piece, or a bar dipole magnet having its magnetic axis essentially perpendicular to the substrate surface such as the magnet M1 in FIG. 4) and alternately providing loop-shaped magnets or loop-shaped extensions of the pole piece, respectively, thereby forming e.g. five, six, seven or eight nested loop-shaped areas.

It is also evident that an orientation of the non-spherical magnetic or magnetizable particles in areas on the substrate defining different loop shapes from a circle or ring (e.g. triangles, squares, pentagons, hexagons, heptagons or octagons) can be achieved by modifying the shape of the loop-shaped magnets and of the loop-shaped pole piece (Y) in these devices.

In the embodiments illustrated in FIGS. 3 to 5, except for bar dipole magnet in the center (such as shown in FIG. 4), loop-shaped (ring) magnets are used. However, it is possible to obtain similar effects using bar magnets if the shape of the pole piece is adapted accordingly. Examples of such further embodiments of the magnet-field generating device of the present invention are shown in FIGS. 6A to 6D.

Figure 6A:
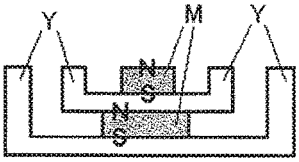
FIG. 6A-6D schematically depict further embodiments of a magnetic-field-generating device according to embodiments of the present invention.
Figure 6C:
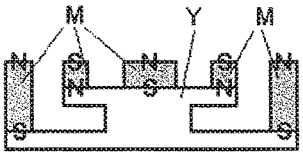
Figure 6B:
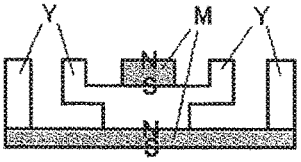
Figure 6D:
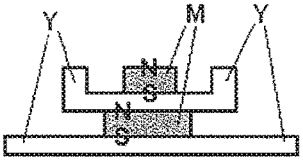

FIGS. 6A, 6B and 6D illustrate possible realizations of an embodiment of the magnetic field generating device of the present invention, wherein the device comprises two or more bar dipole magnets and two or more pole pieces, wherein the device comprises an equal number of pole pieces and bar dipole magnets, wherein the bar dipole magnets have their North-South axis substantially perpendicular to the supporting surface or space, have the same North-South direction and are provided in different distances from the supporting surface or space, preferably along one line extending perpendicular from the supporting surface or space, and spaced apart from each other; and the pole pieces being provided in the space between the bar dipole magnets and in contact therewith, wherein the pole pieces form one or more projections which, in loop-shaped form, surround a central area in which the bar dipole magnet located next to the supporting surface or space is located.

Specifically, in FIG. 6A, there is one central bar dipole magnet having an axial North-South orientation. Under the central (upper) bar dipole magnet there is arranged an upper pole piece that, spaced apart, laterally surrounds the bar dipole magnet, forming a closed loop shape wherein one side of the loop is closed. Instead of left or right to the laterally surrounding part of the pole piece, such as in FIGS. 4 and 5, a lower bar dipole magnet having a same North-South orientation to the central (upper) bar dipole magnet is arranged below the upper pole piece. The upper pole piece is in contact with one of the poles of the upper bar dipole magnet and the (opposite) pole of the lower bar dipole magnet. Further, a lower pole piece is provided below the lower bar dipole magnet, which also in a loop-shaped form, laterally and spaced apart, surrounds the lower bar dipole magnet and also the upper pole piece. Also, there is a lateral space defined between the loop-shaped form of the lower pole piece and the loop-shaped form of the upper pole piece.

The field lines caused by the magnetic-field-generating device illustrated in FIG. 6A extend from the North pole of the central magnet to the extension of the upper pole piece surrounding the upper bar dipole magnet, and from the extension of the upper pole piece surrounding the upper bar dipole magnet to the extension of the lower pole piece that, laterally and spaced apart, surrounds the lower bar dipole magnet, the upper pole piece and the central magnet, as shown in FIG. 6A. Hence, the non-spherical magnetic or magnetizable particles are oriented along the field lines, which include regions that are substantially parallel to the support surface in the areas between the central (upper) bar dipole magnet and the extension of the upper pole piece surrounding it, and between the extension of the upper pole piece surrounding the central magnet and the extension of the lower pole piece surrounding the central magnet (i.e. in the area above the space defined between the two pole pieces). Hence, this device is capable of orienting the non-spherical magnetic or magnetizable particles in two nested loop-shaped areas.

An alternative, but similar arrangement is illustrated in FIG. 6B. Here, the lower part of lower pole piece in FIG. 6A is replaced by a plate-shaped magnet (a flat bar dipole magnet). The configuration in FIG. 6B allows the orientation of the non-spherical magnetic or magnetizable particles in three loop-shaped areas, two inner loop-shaped areas in a similar manner as in FIG. 6A, and a further loop-shaped area caused by the field lines extending from the loop-shaped most external of the (outer) pole piece surrounding the upper (inner) pole piece to the bottom of the lower plate-shaped bar magnet (the South pole of the lower magnet in FIG. 6B).

Figure 6E:
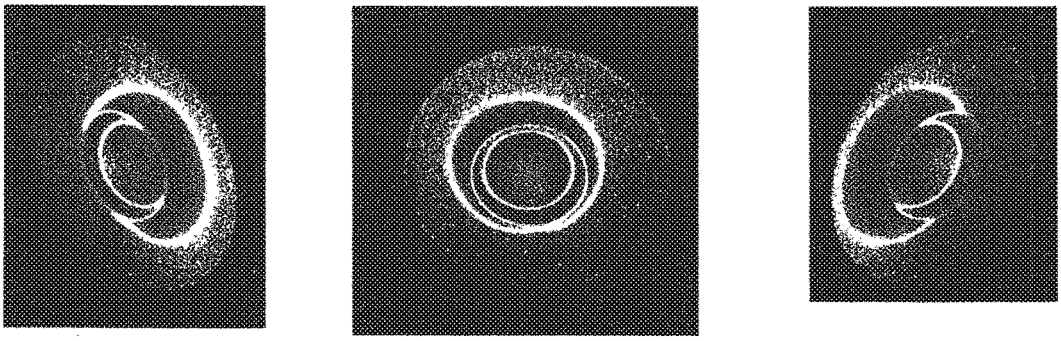
FIG. 6E shows three photographs of the optical effect layer obtained using the device shown in FIG. 6D.

FIG. 6D illustrates a further alternative arrangement of the magnetic-field-generating device. Essentially, the magnets and the pole piece have the same configuration as in FIG. 6A, yet the extension of the lower pole piece laterally surrounding, in a loop shape and spaced apart, the upper pole piece, the upper central magnet and the lower magnet is missing. In consequence, the origin and destination of the field lines have a different distance from the support surface carrying the coating composition in a first state, leading to a very interesting three-dimensional effect, as demonstrated in FIG. 6E. FIG. 6E shows an OEL obtained using a device having the configuration illustrated in FIG. 6D. The OEL shows confers the impression of three nested rings, wherein the inner and the outer ring extend from the surface of the OEL, and wherein the intermediate ring appears to be submerged below the surface. In the inner and outer rings, the orientation of the longest axis of the non-spherical magnetic or magnetizable pigments follows a tangent of a negatively curved part of circle, and in the intermediate ring, the orientation of the longest axis of the non-spherical magnetic or magnetizable pigments follows a tangent of a positively curved part of circle. Further, the change in orientation of the particles forming the impression of the outer ring is less rapid (i.e. the curvature appears to be smaller, or, in other words, the radius of the theoretical circle to a tangent of which the orientation of the particles follows is greater).

Figure 24:
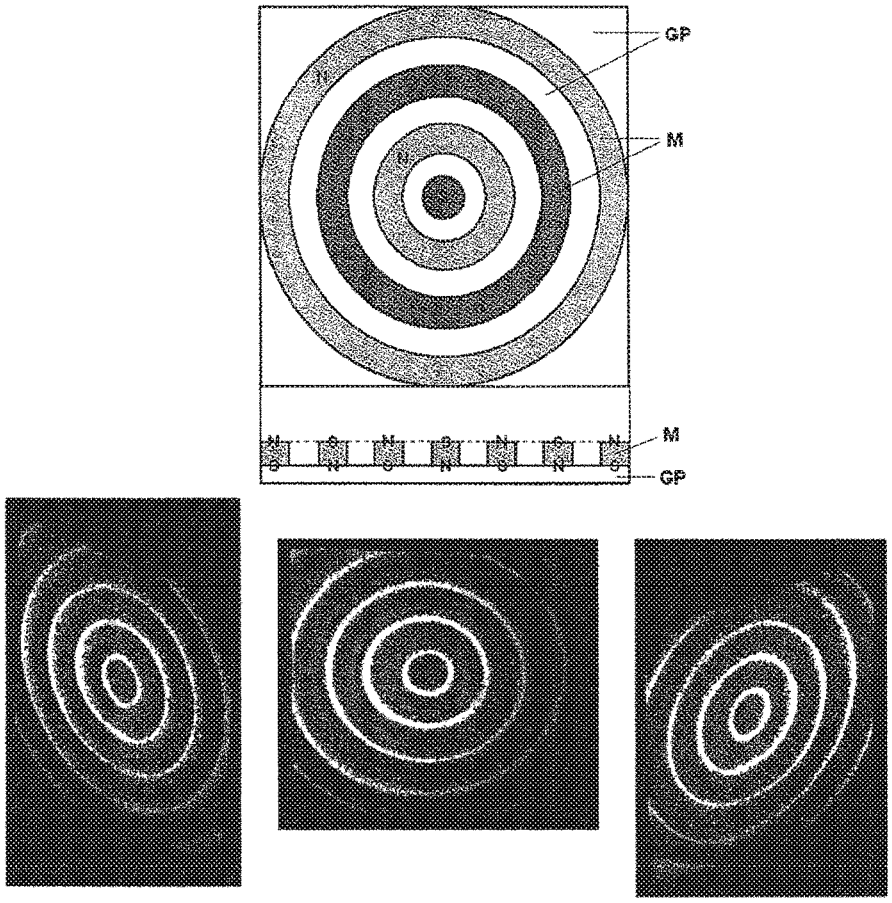
FIG. 24 schematically depicts a further embodiment of a magnetic-field-generating device according to the present invention having a ground plate.

In another embodiment, the present invention relates to a magnetic-field-generating device, wherein two or more loop-shaped dipole magnets are provided such that their North-South axis are perpendicular to the supporting surface or space, the two or more loop-shaped magnets being arranged nested, spaced apart and surrounding one central area, the magnets being axially magnetized, and adjacent loop-shaped magnets have opposite North-South directions pointing either to or away from the supporting surface or space, the device further comprising a bar dipole magnet provided in the central area surrounded by the loop-shaped magnets, the bar dipole magnet having its North South axis substantially perpendicular to the supporting surface and parallel to the North-South axis of the loop-shaped magnets, the North-South direction of the bar dipole magnet being opposite to the North-South direction of the innermost loop-shaped magnet. Such a device is illustrated in FIG. 24. The device may optionally further comprise a pole piece on the side opposite to the supporting surface or space and in contact with the central bar dipole magnet and the loop-shaped magnets. Such a device is illustrated in FIG. 6C.

Figure 7A:
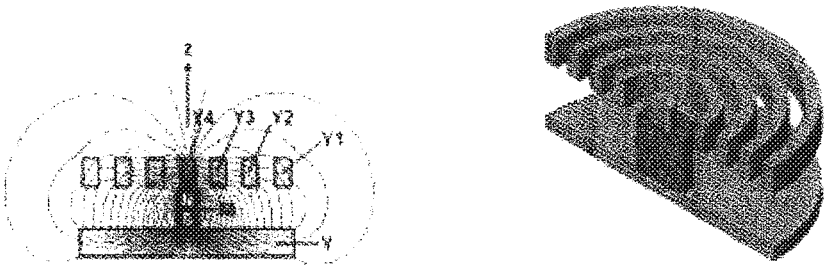
FIG. 7A-7D schematically depict further embodiments of a magnetic-field-generating device according to embodiments of the present invention.

FIG. 6C shows the combination of an axially magnetized bar dipole magnet (M) in the center, and two axially magnetized dipole magnets in loop-shaped form with a single pole piece (iron yoke (Y)). The orientation of the magnet's magnetic direction is alternating from the center to the periphery of the loop-shaped magnetic-field-generating device In another embodiment, the present invention relates to a magnetic field generating device comprising one bar dipole magnet located below the supporting surface or space and having its North-South direction perpendicular to said supporting surface or space, one or more loop-shaped pole pieces arranged above the magnet and below the supporting surface or space, which, for a plurality of loop-shaped pole pieces, are arranged spaced apart and coplanar nested, the one or more pole pieces laterally surrounding a central area under which the magnet is located, the device further comprising a first pole piece having a plate-like basis of about the same size and about the same outer peripheral shape as the outermost loop-shaped pole piece, the plate-like pole piece being arranged below the magnet such that its outer peripheral shape is superimposed with the periphery of outermost of the loop-shaped pole pieces in direction from the supporting surface or space, and which is in contact with one of the poles of the magnet; and a central pole piece in contact with the respectively other pole of the magnet, the central pole piece having the outer peripheral shape of a loop, partly filling the central area and being laterally and spaced apart from and surrounded by the one or more loop-shaped pole pieces. A possible realization of such a device is schematically depicted in FIG. 7A. The first pole piece may also be supplemented by one or more projections extending from the plate-like basis, which laterally and spaced apart surround the central magnet, as schematically illustrated in FIGS. 7B and 7D.

The device may further comprise a second plate like pole piece having the outer peripheral shape of a loop, which is provided at a position above and in contact with one pole of the magnet and below and in contact with the one or more loop-shaped pole pieces and below and in contact with the central pole piece, so that the central pole piece is no longer in direct contact with the pole of the magnet, the second plate-like pole piece being of about the same size and shape as the first plate-like pole piece. A possible realization of such a device is schematically depicted in FIG. 7C.

Figure 7B:
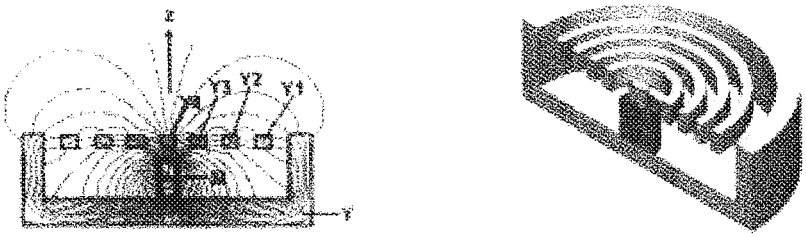

It was found that the magnetic field of the poles of a bar dipole magnet (M) can be channeled through a set of coplanar nested, loop-shaped pole pieces, such as iron yokes (Y1, Y2, Y3, Y4), having magnetic gaps reflecting the loop shape between them (annular iron yokes in FIGS. 7A and 7B). The magnetic fields at the locations of said gaps are appropriate for producing nested annular effect image elements of different size.

FIG. 7A shows a device comprising a bar dipole magnet (M) magnetized in axial direction and disposed with one magnetic pole on an iron plate (Y). A set of coplanar nested, annular iron yokes (Y1, Y2, Y3, Y4) is disposed at the other magnetic pole (N) of the bar dipole magnet (M). FIG. 7B shows a device, wherein the iron plate (Y) is substituted by a U-shaped iron yoke (Y), thereby forming a pole piece whose loop-shaped basis is supplemented by one or more projections extending from the plate-like basis, which laterally and spaced apart surround the central magnet.

Figure 7C:
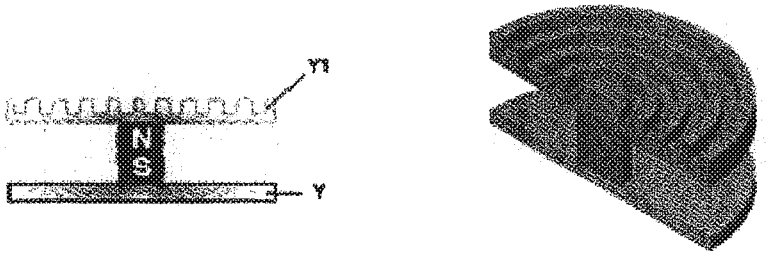
Figure 7D:
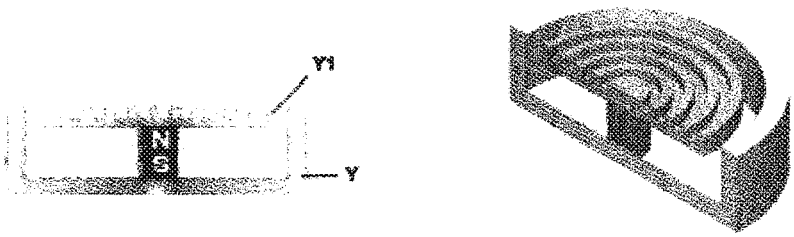

As shown in FIGS. 7C and 7D, the set of coplanar nested loop-shaped pole pieces (iron yokes) can be supplemented with a second plate like pole piece having the outer peripheral shape of a loop, which is provided at a position (i) above and in contact with one pole of the magnet and (ii) below and in contact with the one or more loop-shaped pole pieces and the central pole piece, so that the central pole piece is no longer in direct contact with the pole of the magnet, the second plate-like pole piece being of about the same size and shape as the first plate-like pole piece. In combination, this corresponds to an engraved plate, as shown at the top of FIGS. 7C and 7D. Such an engraved plate in particular, and also the pole pieces used in the present invention in general, may be made from iron (iron yokes), but can also be made from a plastic material in which magnetic particles are dispersed, as used in FIGS. 7C and 7D. This is therefore an alternative embodiment of the magnetic field generating devices of the present invention which also comprise at least one pole piece.

FIGS. 3 to 7 show embodiments of static magnetic-field-generating devices of the present invention. In the following, embodiments of the rotational magnetic-field-generating devices will be described, as illustrated in FIGS. 8-20 and 23A-23F and 24. As known by the man skilled in the art, the speed and the number of rotation per minutes used for the rotatable magnetic-field-generating devices described herein is adjusted so that to orient the non-spherical magnetic or magnetizable particles as described herein, i.e. to follow a tangent of either a negatively curved or a positively curved part of a hypothetical ellipse.

A common feature of all rotational magnetic-field-generating devices of the present invention is that they comprise one or more magnets that are provided rotatable around an axis of rotation and spaced apart from the axis of rotation (z). Further, the axis of rotation is provided substantially perpendicular to the plane in which the supporting surface or substrate (S) is provided when orienting the non-spherical magnetic or magnetizable particles. When an uneven number of magnet(s) is used and for reasons of mechanical balance, an additional dummy piece having about the same size/weight and provided at about the same distance from the axis of rotation may be used.

In the following description of the rotational magnetic-field-generating devices, the orientation of the magnetic North-South direction of a magnet that is provided spaced apart from the axis of rotation is expressed with respect to the axis of rotation, so that either the magnetic axis of such a magnet is parallel to the axis of rotation (the North-South direction is pointing either towards the substrate surface or away from it), or the magnetic axis is substantially radial to the axis of rotation and substantially parallel to the supporting surface on which the coating composition or a substrate comprising the coating composition is to be provided (or with respect to a space configured for receiving the substrate acting as supporting surface), and the North-South direction either points towards or away from the axis of rotation. In the context of magnetic field generating devices wherein plural magnets are provided rotatable about an axis of rotation and the magnetic North-South axis is radial to the axis of rotation, the expression "symmetric magnetic North-South direction" means that the orientation of the North-South direction is symmetric with respect to the axis of rotation as center of symmetry (i.e. the North-South direction of all of the plural magnets either points away from the axis of rotation or the North-South direction of all of the plural magnets towards it). In the context of magnetic field generating devices wherein plural magnets are provided rotatable about an axis of rotation and the magnetic North-South axis is radial to the axis of rotation and parallel to the supporting surface or substrate surface, the expression "asymmetric magnetic North-South direction" means that the orientation of the North-South direction is asymmetric with respect to the axis of rotation as center of symmetry (i.e. the North-South direction of one of the magnet points towards and the North-South direction of the other magnet points away from the axis of rotation).

The rotational magnetic-field-generating devices can further be divided in rotational magnetic-field-generating devices that are capable of orienting the non-spherical magnetic or magnetizable particles present in a coating composition in a first state on a substrate such that, in a plurality of nested loop-shaped areas, the non-spherical magnetic or magnetizable particles are oriented such as to provide the optical appearance of a plurality of nested loop-shaped bodies surrounding one central area wherein the central area is seemingly "empty", and those rotational magnetic-field-generating devices wherein the central area comprises a "protrusion". The protrusion provides the impression of a three-dimensional object, such as a half-sphere, present in the central area surrounded by the loop-shaped bodies. The three-dimensional object seemingly extends from the OEL surface to the viewer (in a similar manner as looking on an upright standing or inverted bowl, depending on whether the particles follow a negative or a positive curve), or extends from the OEL surface away from the viewer. In these cases, the OEL comprises non-spherical magnetic or magnetizable particles in the central area that are oriented substantially parallel to the plane of the OEL, providing a reflection zone.

In cases where the central area is seemingly empty, the central area defined by the innermost of the nested loop-shaped bodies is either free of non-spherical magnetic or magnetizable particles, or the central area comprises such particles in either a random orientation or preferably in such an orientation that the longest axis of the particles is substantially perpendicular to the plane of the OEL. In the latter case, the particles typically provide only little reflectivity.

In case where the central area comprises a "protrusion", there is a region in the central area—typically in the center of the central area—wherein the particles are oriented such that their longest axis is substantially parallel to the plane of the OEL, thereby providing a reflection zone. Notably, there is preferably the optical impression of a gap between the "protrusion" and the innermost loop-shaped body. This can be achieved by either the absence of particles in this area, but is very typically and preferably achieved by orienting the particles in this area such that their longest axis is substantially perpendicular to the plane of the OEL/the substrate surface. Most preferably, the particles inside the central area forming the center of the protrusion and the particles in the center of the width of the loop-shaped area forming the optical appearance of the innermost loop-shaped body are oriented substantially parallel to the substrate surface and the plane of the OEL, and the orientation of the particles between these areas gradually changes from substantially parallel to substantially perpendicular, and again to substantially parallel along a line extending from the center of the central area to the center of the area defining the innermost loop-shaped body, as illustrated in part in FIG. 21B (not showing the area between the loop-shaped area and the central area wherein a substantially perpendicular orientation of the particles is present). Such an orientation of the particles can be achieved by the rotational magnetic-field-generating devices capable of forming a "protrusion" described below.

Figure 8:
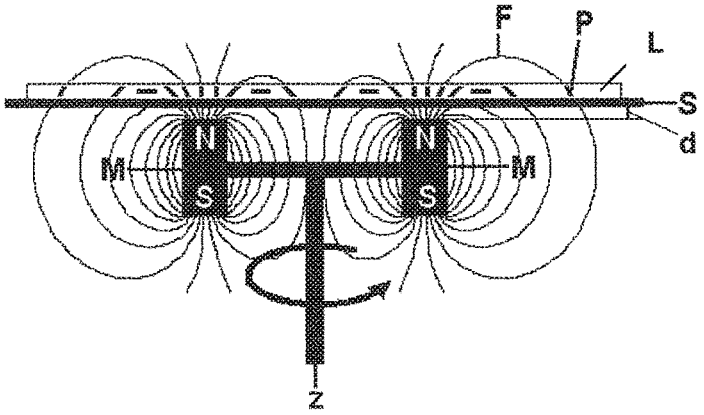
FIG. 8 schematically depicts a further embodiment of a magnetic-field-generating device according to the present invention.
Figure 9:
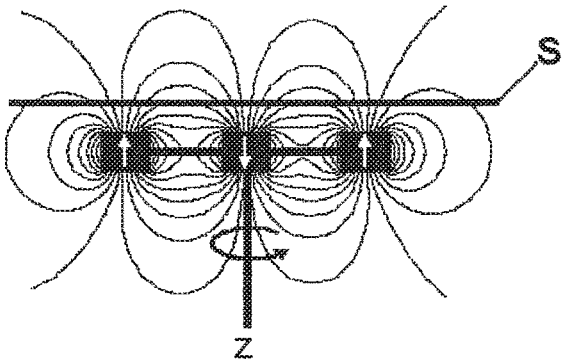
FIG. 9 schematically depicts a further embodiment of a magnetic-field-generating device according to the present invention.
Figure 10:
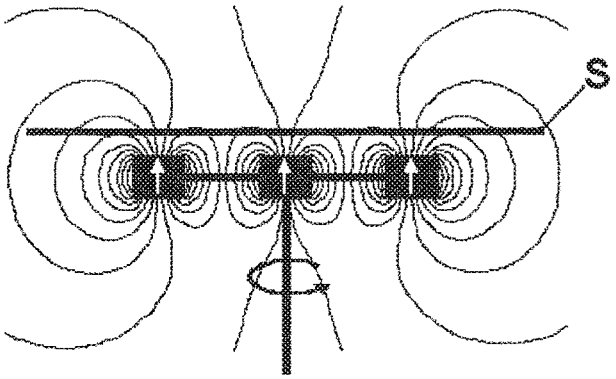
FIG. 10 schematically depicts a further embodiment of a magnetic-field-generating device according to the present invention.
Figure 11:
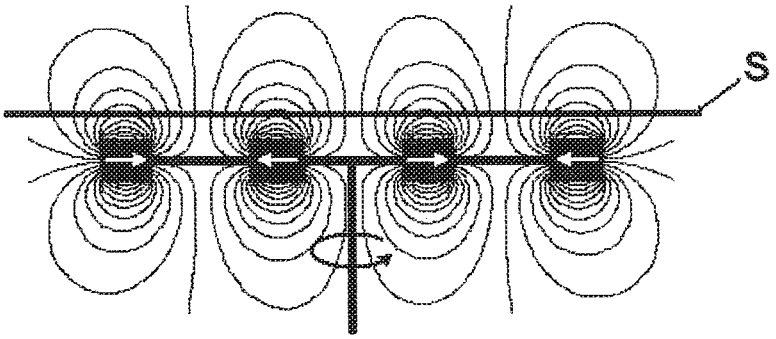
FIG. 11 schematically depicts a further embodiment of a magnetic-field-generating device according to the present invention.
Figure 12:
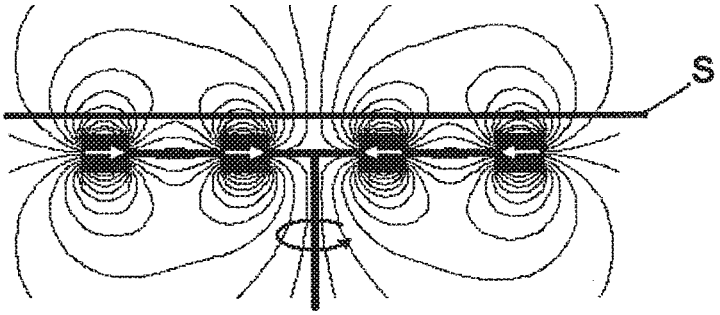
FIG. 12 schematically depicts a further embodiment of a magnetic-field-generating device according to the present invention.
Figure 13:
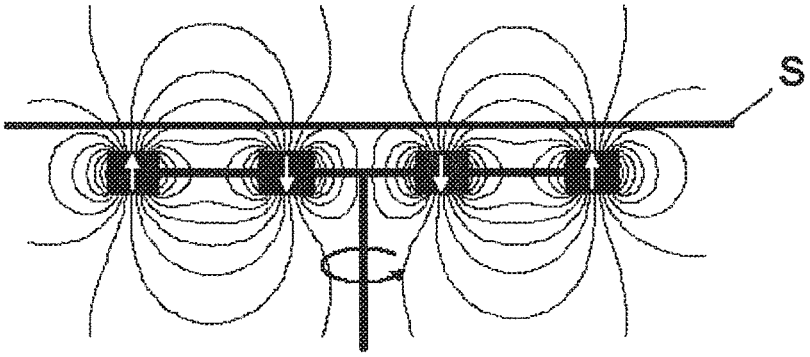
FIG. 13 schematically depicts a further embodiment of a magnetic-field-generating device according to the present invention.
Figure 14:
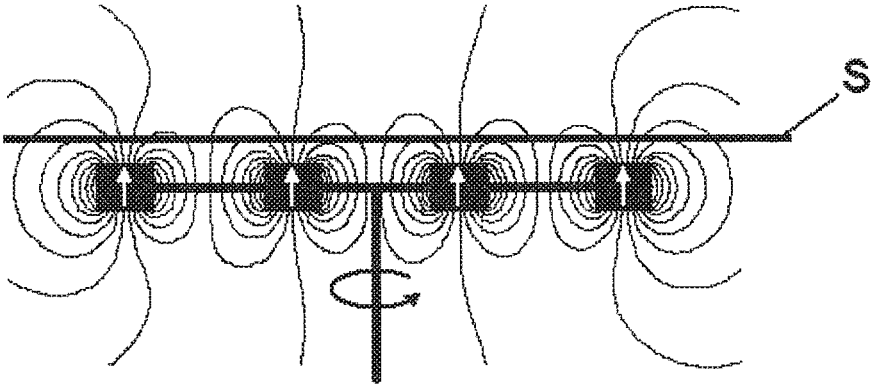
FIG. 14 schematically depicts a further embodiment of a magnetic-field-generating device according to the present invention.
Figure 16:
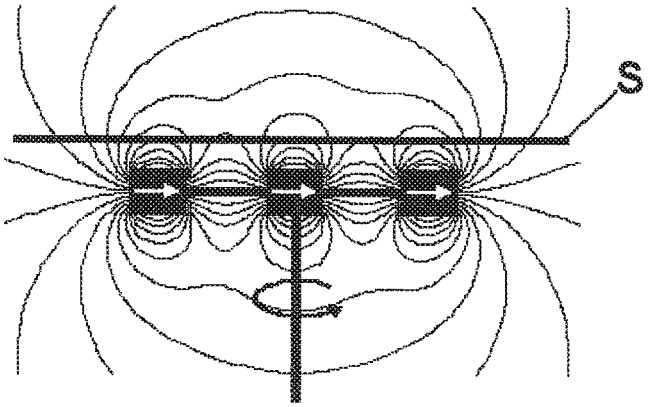
FIG. 16 schematically depicts a further embodiment of a magnetic-field-generating device according to the present invention.
Figure 17:
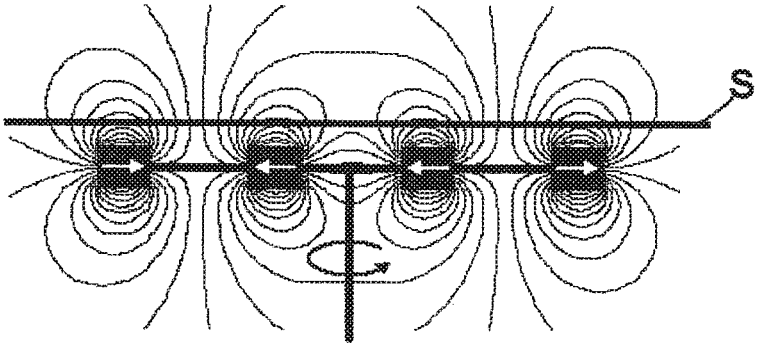
FIG. 17 schematically depicts a further embodiment of a magnetic-field-generating device according to the present invention.
Figure 18:
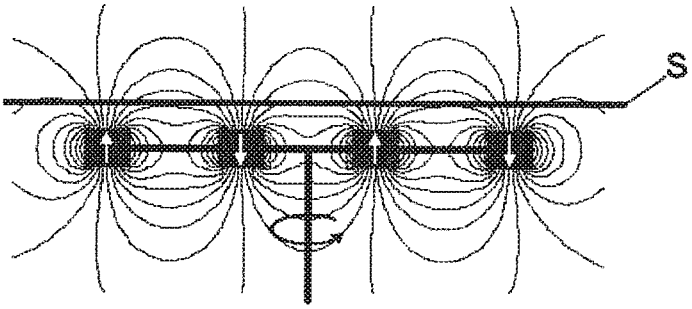
FIG. 18 schematically depicts a further embodiment of a magnetic-field-generating device according to the present invention.
Figure 19:
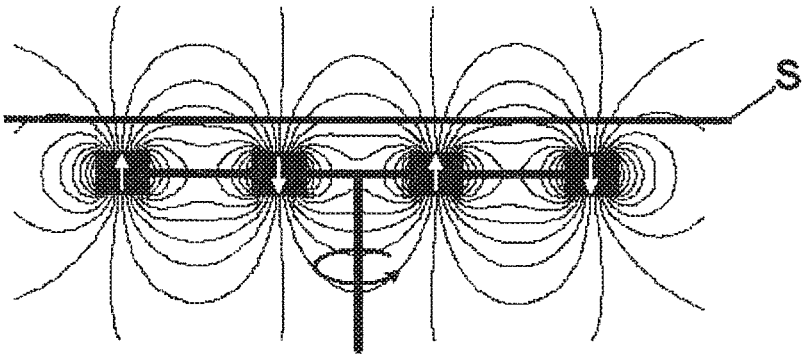
FIG. 19 schematically depicts a further embodiment of a magnetic-field-generating device according to the present invention.
Figure 20:
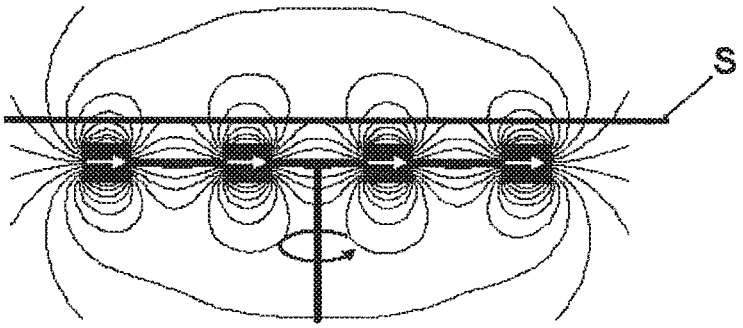
FIG. 20 schematically depicts a further embodiment of a magnetic-field-generating device according to the present invention.
Figure 23A:
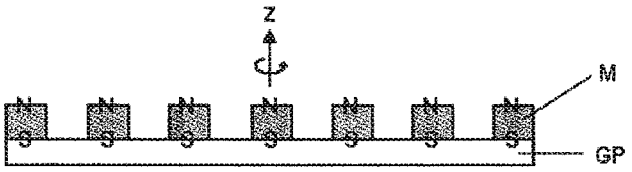
FIGS. 23A-23F schematically depict further embodiments of a magnetic-field-generating device according to the present invention having a ground plate.
Figure 23B:
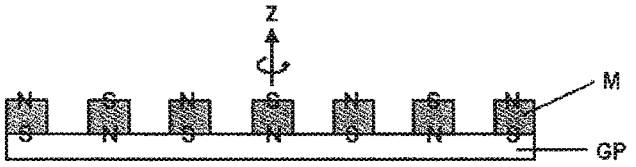
Figure 23C:
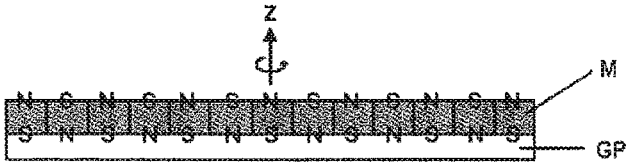
Figure 23D:
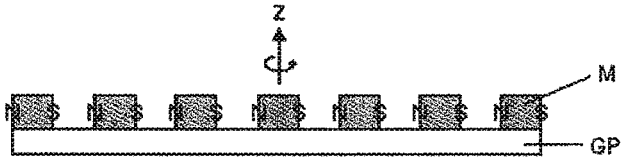
Figure 23E:
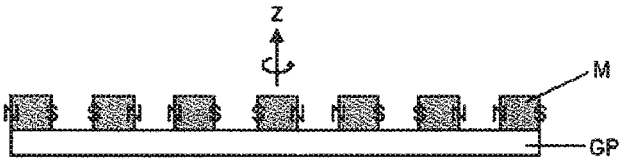
Figure 23F:
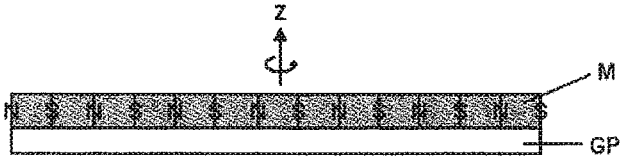

In embodiments of the present invention, the rotational magnetic field generating device comprises two or more bar dipole magnets that are arranged below the supporting surface or space configured for receiving a substrate, and which are arranged such as to be rotatable around an axis of rotation that is perpendicular to the supporting surface or space, the two or more bar dipole magnets being spaced apart from the axis of rotation and from each other and provided symmetrically on opposite sides of the axis of rotation, the device optionally further comprising one bar dipole magnet that is arranged below the supporting surface or space and on the axis of rotation, wherein either e1) the device comprises, on either side of the axis of rotation, one or more bar dipole magnets all having their North-South axis substantially perpendicular to the supporting surface or space and substantially parallel to the axis of rotation, the North-South direction of all magnets being identical with respect to the supporting surface or space, and the magnets being spaced apart from each other [as illustrated in FIGS. 8 and 14], the device optionally comprising one bar dipole magnet that is arranged below the supporting surface or space and on the axis of rotation, the North-South axis thereof being substantially perpendicular to the supporting surface or space and substantially parallel to the axis of rotation, and the North-South direction of which is either identical to the North South direction of the magnets that are arranged rotatable around the axis and spaced apart therefrom [as illustrated in FIGS. 10, 23A] or opposite thereto [as illustrated in FIG. 9];

e2) no optional bar dipole magnet on the axis of rotation is present and the device comprises, on either side of the axis of rotation, two or more bar dipole magnets arranged spaced apart from each other and from the axis of rotation, the North-South axis of the magnets being substantially perpendicular to the supporting surface or space and substantially parallel to the axis of rotation, and wherein the magnets provided on either side of the axis have alternating North-South directions, and the innermost magnets with regard to the axis of rotation either have symmetric [FIG. 13] or opposite North-South directions [as illustrated in FIG. 18];

e3) no optional bar dipole magnet on the axis of rotation is present and the device comprises, on either side of the axis of rotation, two or more bar dipole magnets arranged spaced apart from each other and from the axis of rotation, the North-South axis of the magnets being substantially perpendicular to the supporting surface or space and substantially parallel to the axis of rotation, and wherein the magnets provided on either side of the axis have symmetric North-South directions with respect to the axis of rotation and the magnets provided on different sides of the axis of rotation have opposite North-South directions [as illustrated in FIG. 19];

e4) the device comprises, on either side of the axis of rotation, one or more bar dipole magnets that are arranged spaced apart from the axis of rotation and, if more than one magnet is present on one side, spaced apart from each other, the North-South axis of the magnets being substantially parallel to the supporting surface or space and substantially radial to the axis of rotation, and the North-South directions of the one or more magnets on one side of the axis or rotation points towards the axis of rotation, while the North-South directions of the one or magnets on the other side of the axis or rotation points away from the axis of rotation, so that the respective North-South directions are in line from the outermost magnet on one side to the outermost magnet on the other side of the axis of rotation (i.e. the North-South directions of the innermost magnets are asymmetric with respect to the axis of rotation and the magnets are arranged such that the North-South directions of all magnets point essentially in the same direction), wherein further either e4-1) no optional magnet is provided on the axis of rotation and at least two magnets are provided on either side of the axis of rotation [FIG. 20]; or e4-2) an optional magnet is provided on the axis of rotation, the magnets on either side being arranged spaced apart therefrom, the magnet on the axis of rotation being a bar dipole magnet having its North-South axis substantially parallel to the supporting surface and its North-South direction pointing in the same direction as the magnets provided on either side of the axis or rotation (i.e. in line with the North-South directions of the magnets arranged spaced apart from the axis of rotation, from the outermost magnet on one side to the outermost magnet on the other side of the axis of rotation) [as illustrated in FIG. 16];

e5) the device comprises no optional magnet provided on the axis of rotation and comprises, on either side of the axis of rotation, two or more bar dipole magnets that are arranged spaced apart from the axis of rotation and spaced apart from each other, the North-South axis of the magnets being substantially parallel to the supporting surface or space and substantially radial to the axis of rotation, wherein the North-South directions of all magnets are symmetrical with respect to the axis of rotation (i.e. all pointing towards or away from the axis of rotation) [as illustrated in for one embodiment in FIG. 12];

e6) the device comprises no optional magnet provided on the axis of rotation and comprises, on either side of the axis of rotation, one or more pairs of bar dipole magnets that are arranged spaced apart from the axis of rotation and spaced apart from each other, the North-South axis of all magnets being substantially parallel to the supporting surface or space and substantially radial to the axis of rotation, and each pair of magnets being formed by two magnets with opposite North-South directions pointing towards each other or away from each other, respectively, and wherein the innermost magnets of the innermost pairs of magnets on either side have either e6-1) symmetric North South direction with respect to the axis of rotation, both pointing either away or towards the axis of rotation [as illustrated in FIG. 11]; or e6-2) asymmetric (opposite) North-South direction with respect to the axis of rotation, one pointing away and one towards the axis of rotation [as illustrated in FIG. 17]; or e7) the device either:

e7-1) comprises the optional bar dipole magnet on the axis of rotation and one or more magnets on either side of the axis of rotation, the North-South axis of all magnets being substantially parallel to the supporting surface and the North-South axis of the magnets on either side of the axis of rotation is essentially radial to the axis of rotation; or e7-2) the device does not comprise the optional bar dipole magnet on the axis of rotation and comprises two or more magnets on either side of the axis of rotation that are arranged spaced apart from the axis of rotation, the North-South axis of all magnets being substantially parallel to the supporting surface or space and substantially radial to the axis of rotation, wherein in both instances the North-South directions of the magnets arranged on one side of the axis of rotation are asymmetric to the North-South directions of the magnets arranged on the other side of the axis of rotation with respect to the axis of rotation (i.e. pointing towards the axis of rotation on one side and away from the axis of rotation on the other side), such that the North-South directions are in line from the outermost magnet on one side to the outermost magnet on the other side, the magnet on the axis of rotation in case e7-1 being aligned in this line [as illustrated in FIGS. 15 and 23D];

e8) the device comprises, on either side of the axis of rotation two or more bar dipole magnets all having their North-South axis substantially perpendicular to the supporting surface or space and substantially parallel to the axis of rotation, and optionally a bar dipole magnet arranged on the axis of rotation and also having its North-South axis substantially perpendicular to the supporting surface or space and substantially parallel to the axis of rotation; the North-South direction of adjacent magnets being opposite with respect to the supporting surface or space, and the magnets being spaced apart (FIG. 23B) from each other; or e9) the device comprises, on either side of the axis of rotation two or more bar dipole magnets all having their North-South axis substantially parallel to the supporting surface or space and substantially radial to the axis of rotation, and optionally a bar dipole magnet arranged on the axis of rotation and also having its North-South axis substantially parallel to the supporting surface or space and substantially perpendicular to the axis of rotation; the North-South directions of adjacent magnets pointing in opposite directions, and the magnets being spaced apart [as illustrated in FIG. 23E] from each other. Herein, the "adjacent" magnets are the magnets that are placed next to each other.

FIG. 8 schematically depicts an embodiment of a magnetic-field-generating device comprising two bar dipole magnet magnets (M) spaced apart from an axis of rotation (z), the magnets having their magnetic axis substantially perpendicular to the supporting surface or substrate (S) and substantially parallel to the axis of rotation, and the same magnetic North-South direction pointing away from the supporting surface (S). As apparent from the field lines (F) shown in FIG. 8, the magnetic or magnetizable particles (P) in the coating layer (L) of the coating composition in a first state, which are present in the areas to the left and right of each magnet, are oriented to be substantially parallel to the supporting surface (S). Upon rotating the magnets around the rotation axis (z), two loop-shaped bodies (rings in FIG. 8) are formed. As also derivable from the field lines, the particles present in the central area on the axis of rotation are either not oriented at all or rather oriented to have their longest axis substantially perpendicular to the supporting surface (S), so that no protrusion is formed.

Of course, in another embodiment the arrangement in FIG. 8 can be altered by reverting the North-South direction of the magnets, or by providing further magnets around the axis of rotation in the same orientation of the North-South direction, e.g. three, four, five or six magnets. This allows reducing the extent of rotation that is necessary to form a closed loop.

FIG. 9 illustrates another embodiment of a magnetic-field-generating device of the present invention, wherein three bar dipole magnets are provided in the device. Two of the three bar dipole magnets are located apart from and opposite with respect to the axis of rotation and have the same magnetic North-South direction (substantially perpendicular to the supporting surface (S)/substantially parallel to the axis of rotation, for instance both pointing towards the supporting surface (S)). The third bar dipole magnet is positioned on the axis of rotation and has its North-South direction in the opposite direction to the two magnets that are provided spaced apart. As apparent from the field lines, an orientation of the particles essentially parallel to the plane of the OEL layer/the substrate surface is obtained in the areas between the center magnet and the two outer magnets and in the areas beyond the two spaced apart magnets when seen from the axis of rotation). Accordingly, the device of FIG. 9 allows producing a security element conferring the impression of two nested rings surrounding an (empty) central area.

FIG. 10 illustrates another embodiment of a magnetic-field-generating device of the present invention which is similar to the one shown in FIG. 9, the only difference being that the North-South direction of the central magnet provided on the axis of rotation is not opposite to the North-South direction of the spaced apart magnets, but that all three magnets have the same North-South direction (perpendicular to and pointing towards the supporting surface (S), parallel to the axis of rotation). As apparent from the field lines, the particles in six areas of the cross section view are oriented to be substantially parallel to the plane of the OEL, which combine with each other upon rotation, forming three nested loop-shaped areas. That is, in the area left and right from the central magnet an orientation parallel to the OEL plane is achieved, forming upon rotation the innermost loop-shaped area, in the area right to the magnet shown on the left and in the area to the left of the magnet shown on the right, upon rotation a middle loop-shaped area is formed, and in the area left from the magnet shown on the left and right from the magnet shown on the right an outer loop-shaped area is formed. Accordingly, the device of FIG. 9 allows producing a security element conferring the impression of three nested rings surrounding an (empty) central area.

FIG. 11 illustrates another embodiment of a magnetic-field-generating device of the present invention. Here, two pairs of magnets having opposite magnetic North-South directions to each other are provided on either side of the rotational axis. All of the magnets are provided spaced apart from the axis of rotation, and the two inner magnets of a pair have symmetric North-South directions with respect to the axis of rotation (both pointing away from the axis of rotation), the two outer magnets of a pair have the symmetric North-South directions with respect to the axis of rotation (both pointing toward the axis of rotation). Each of the four magnets has it magnetic axis substantially parallel to the supporting surface (S) and radial to the axis of rotation. Upon rotation around the axis of rotation, the device allows orienting the particles in two loop-shaped areas in the OEL, forming the impression of the nested rings surrounding an (empty) central area. Of course, it is possible to provide further pairs of magnets with the same orientation on either side of the axis of rotation.

FIG. 12 illustrates another embodiment of a magnetic-field-generating device of the present invention. Similar to the embodiment shown in FIG. 11, two pairs of magnets are provided spaced apart the axis of rotation with their magnetic axis substantially parallel to the supporting surface (S) and radial to the axis of rotation. Contrary to the embodiment illustrated in FIG. 11, here all magnets have symmetric North-South directions with respect to the axis of rotation (i.e. pointing towards the axis of rotation).

The device illustrated in FIG. 12 shows an interesting effect in that an area wherein a substantially parallel orientation of the particles is not only achieved directly above each of the four magnets, but also between the magnets on each side of the axis of rotation due to the magnets having the same North South direction. Thereby, a pole of the outer magnet (e.g. a North pole) is provided such as to face the opposite pole of the inner magnet (e.g. a South pole). This leads to a magnetic field having field lines that run substantially parallel to the surface S above the magnets in an area between the magnets. However, the area in which a parallel orientation of the particles is achieved by this field is significantly smaller than the area above each of the magnets, which affects the "thickness" or line width of the loop-shaped bodies. Accordingly, the device illustrated in FIG. 12 leads, upon rotation around, to the formation of an OEL conferring the visual impression of three nested rings surrounding one (empty) central area, wherein the thickness or line width of the outer and the inner ring is perceivably greater than that of the middle ring. This effect is also observed in related magnetic-field-generating devices of the present invention, and is nicely perceivable e.g. in FIG. 15B.

FIG. 13 illustrates another embodiment of a magnetic-field-generating device of the present invention. It demonstrates a four bar dipole magnets device, wherein all of the magnets are located apart the axis of rotation. Each of them has its magnetic axis substantially perpendicular to the supporting surface and substantially parallel to the axis of rotation. The North-South directions of the inner magnets are the same and opposite to the North South directions of the outer magnets, seen from the axis of rotation. Upon rotation around the axis of rotation, an orientation of the particles parallel to the plane of the OEL in three loop-shaped areas is achieved. One of the loop shapes (the middle loop shape) is formed by combination, upon rotation, of the areas between the magnets on each side. The width of this area, and consequently the apparent "thickness" of the loop-shaped closed body appearing in the OEL, can be adjusted by adjusting the distance between the magnets on either side of the axis of rotation, and/or by modifying the distance d. However, as outlined above, a too big distance d may lead to a blurred appearance of the loop-shaped body and/or a loss of contrast. The inner and the outer loop shape are formed by combination, upon rotation around z, of the areas between the innermost magnets and the axis of rotation, and by combination, upon rotation, of the areas beyond the outer magnets (seen from the axis of rotation).

FIG. 14 illustrates another embodiment of a magnetic-field-generating device of the present invention. The device of this embodiment is similar to the one of the embodiment illustrated in FIG. 13, the only difference being that the magnets all have identical North-South directions substantially parallel to the axis of rotation and substantially perpendicular to the supporting surface or substrate (S). The device allows for the formation of a security element conferring the optical impression of four loop-shaped bodies surrounding an (empty) central area.

Figure 15A:
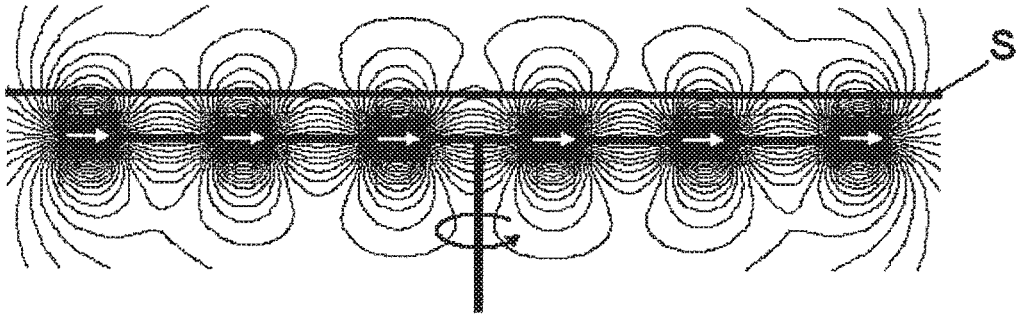
FIG. 15A schematically depicts a further embodiment of a magnetic-field-generating device according to the present invention.

FIG. 15A illustrates another embodiment of a magnetic-field-generating device of the present invention. The device comprises 6 magnets spaced apart from the axis of rotation, three on each side. When seen from one magnet to another, the North-South directions of all magnets are identical, while, when seen with respect to the axis of rotation, the North-South direction of one set of three magnets on one side of the axis of rotation points towards the axis of rotation, while the North-South direction of the other set of three magnets points away from the axis of rotation (i.e. the orientation of the magnets on either side is asymmetric with respect to the axis of rotation). Each North pole of one magnet is facing the South pole of the next magnet along the axis of rotation.

The device illustrated in FIG. 15A is related to the device shown in FIG. 12 in that the magnets provided on one side of the axis of rotation have the same North South direction (compare only the left side of FIG. 12 with only the left side of FIG. 15A). A further difference is that the set of magnets on one side of the axis of rotation is extended by one magnet, i.e. there are three magnets on either side. Again, an area of substantially parallel orientation of the particles with respect to the plane of the OEL/the surface S is present directly above each of the magnets, and also between each of the magnets. Upon rotation, each of these areas combines with itself along the rotational path, forming a loop-shaped area that corresponds to the loop-shaped body. Since the area of parallel orientation is greater directly above the magnets than between the magnets, alternating loop shapes of different "thickness" or line width are formed upon rotation. Thus, the device illustrated in FIG. 15A leads to the formation of five nested loop-shaped bodies, of which (seen from the central area) the first, third and fifth have a greater thickness than the second and fourth.

Further, by the field lines between the magnets provided next to the axis of rotation, an area of substantially parallel alignment with regard to the surface S is formed directly on the axis of rotation, leading to the formation of a "protrusion". Hence, the device illustrated in FIG. 15A allows the formation of an OEL conferring the optical impression of five nested rings with alternating thickness surrounding a protrusion.

It is immediately evident that the device of FIG. 15A can be easily supplemented by further magnet on each side. The addition of one magnet on each side increases the number of loop-shaped bodies (rings) by two, so that the device can be easily modified to provide the optical appearance of 7, 9, 11 or 13 nested rings surrounding a central area that is filled with a "protrusion". Of course, by reducing the number of magnets, also two or three loop-shaped bodies surrounding an area with a protrusion can be provided, as illustrated in FIG. 20 (identical to the device of FIG. 15A except for the reduced number of magnets).

Figure 15B:
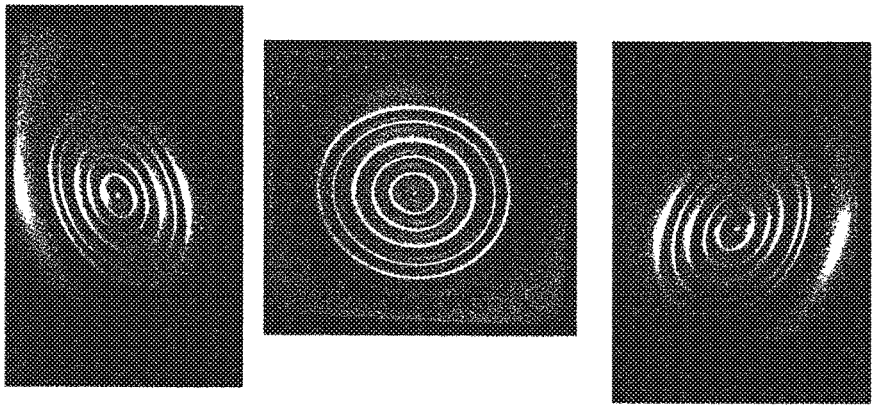
FIG. 15B shows a photograph of a security element comprising a plurality of loop-shapes formed with the device shown in FIG. 15A at a distance d between the magnets in 15A and the surface of the supporting surface S receiving the substrate of 0 mm, i.e. the supporting surface S is provided in direct contact with the magnet.
Figure 15C:
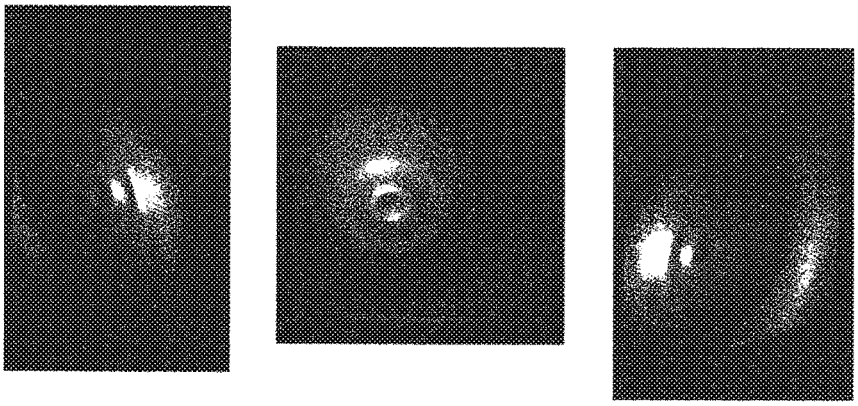
FIG. 15C shows a photograph of a security element comprising a plurality of loop-shapes formed with the device shown in FIG. 15A at a distance d between the magnets in FIG. 15A and the surface of the supporting surface S receiving the substrate of 1.5 mm.

FIG. 15B shows a photograph of an OEL produced using the device of FIG. 15A. FIG. 15C illustrates the effect of a modification of the distance d, being 0 mm in FIG. 15B and 1.5 mm in FIG. 15C. As explained earlier, a too big distance d leads to a blurring and a loss of contract, so that the individual loop-shaped bodies can no longer be distinguished from each other. However, also an OEL as shown in FIG. 15C provides a distinct optical appearance and a three-dimensional effect caused by an overlap of the magnetic field lines, so that also a slightly higher distance d can be used in practice. In fact, it would be difficult for a counterfeiter to re-construct not only the magnetic-field-generating device used for the production of such an OEL, but also to find the right distance d. Accordingly, a distance d of 0.5 mm or more or 1.0 mm or more may be preferable for certain applications.

FIG. 16 illustrates another embodiment of a magnetic-field-generating device of the present invention. The device comprises three magnets, two of which are spaced apart from the axis of rotation and one being provided on the axis of rotation. Similarly as in FIG. 15A, the North-South direction of the magnets is identical from one magnet to the other, so that a North pole (or South pole) of a magnet spaced apart faces the South pole (or North pole, respectively) of the magnet provided on the axis of rotation. Put differently, the magnets spaced apart have asymmetric North-South directions with respect to the axis of rotation (one towards and one away from the axis of rotation), and the North-South direction of the magnet provided on the axis of rotation is the same as that of the magnet having its North-South direction pointing towards the axis of rotation.

The device is related to the one shown in FIG. 15A, the main difference—except for the reduced number of magnets—being that a magnet is provided on the axis of rotation. Thus, in the area directly above the magnet on the axis of rotation, an area of substantially parallel orientation of the particles with respect to the surface S is formed. This area is bigger as the corresponding area in FIG. 15A, since it is formed above a magnet (and not between two magnets). Thus, the "protrusion" in the central area surrounded by the innermost loop-shaped body in the OEL (i.e. at the location above the center of rotation) formed by the device of FIG. 16 is bigger than the protrusion at the corresponding location in an OEL produces by the device as illustrated in FIG. 15A. Thus, the device of FIG. 16 leads to the orientation of the particles such as to form an OEL conferring the impression of two nested loop-shaped bodies (rings) surrounding a central area that is filled with a "protrusion".

As for the device of FIG. 15A, it is also immediately evident that the device shown in FIG. 16 can be easily modified by adding further magnets, thereby increasing the number of loop-shaped bodies. Also, loop-shaped bodies with alternating "thicknesses" will be formed. Thus, by adding further magnets having the suitable orientation (as shown in FIG. 15A) the corresponding devices can be used for preparing OELs providing the optical appearance of e.g. four, six, eight or ten nested loop-shaped bodies (typically having alternating "thicknesses") surrounding a central area filled with a "protrusion".

FIG. 17 illustrates another embodiment of a magnetic-field-generating device of the present invention. The device is related to the one illustrated in FIG. 11, the only difference being that the North-South direction of each of the two magnets on the right side has been reversed. While the magnets are arranged on each side of the axis of rotation such that they have respectively opposite North-South directions, the reversal of the orientation of the North-South axis of the magnets on only one side of the axis of rotation (as compared to FIG. 11) leads to an arrangement wherein the North-South directions of the two inner magnets point in the same direction when seen from one to the other (but are of course asymmetric with respect to the axis of rotation, i.e. one pointing away and one towards the axis of rotation) and the North-South directions of the two outer magnets point in the same direction when seen from one to the other (but are of course asymmetric with respect to the axis of rotation, i.e. one pointing away and one towards the axis of rotation). This arrangement leads to the formation of an area directly on the axis of rotation allowing a substantial parallel alignment of the particles by the field lines extending between the two inner magnets (similar as in FIG. 15A). Thus, while the device illustrated in FIG. 11 provides an OEL having the optical appearance of two nested loop-shaped bodies surrounding an empty central area, the device illustrated in FIG. 17 provides an OEL having the optical appearance of two nested loop-shaped bodies surrounding a central area that is filled with a protrusion.

FIG. 18 illustrates another embodiment of a magnetic-field-generating device of the present invention. The device comprises four magnets, two on each side of the axis of rotation. All magnets have their magnetic axis substantially parallel to the axis of rotation and substantially perpendicular to the surface S. The North-South direction of the two inner magnets is different (one pointing towards the surface S, the other away), and the North-South direction a magnet spaced further apart from the axis of rotation is respectively opposite to the North-South direction of the inner magnet provided on the same side of the axis of rotation.

FIG. 18 nicely illustrates that symmetrical magnetic fields can be formed by an alternating arrangement of magnets having their magnetic axis parallel to the axis of rotation and perpendicular to the surface S, wherein each magnet is interposed between two other magnets having an opposite North-South direction. In such an arrangement, an area of parallel orientation of the non-spherical magnetic or magnetizable particles with respect to the plane of the OEL/the surface S is formed between each of the magnets, forming a reflection zone. Conversely, directly above the magnets, a substantially perpendicular orientation of the particles is achieved, showing substantially no reflection. Since there is no magnet provided on the axis of rotation, and consequently an area of substantially parallel alignment of the particles with respect to the plane of the OEL is formed at this position, there is a protrusion formed at the central area in the OEL prepared using the device shown in FIG. 18. Further, the device leads to the formation of two loop-shaped bodies surrounding the central area that contains the protrusion.

Of course, it goes without saying that the device of FIG. 18 can be easily modified by providing a magnet on the axis of rotation, having an opposite North-South direction in comparison to the adjacent magnets, so that no protrusion is formed, and/or by increasing the number of magnets on each side, forming three, four, five, six, seven or eight loop-shaped bodies. Further, interestingly the magnetic fields in such devices between the magnets are very similar or identical, so that loop shapes with apparently identical "thicknesses" can be formed.

FIG. 19 illustrates a further embodiment of a magnetic-field-generating device of the present invention. The device comprises four bar dipole magnets which are all located apart the axis of rotation, two on each side, wherein each of the magnets has its magnetic axis substantially perpendicular to the surface S and substantially parallel to the axis of rotation. The orientation of the North-South direction is the same within each pair of magnets on each side, and opposite on different sides of the axis of rotation (up towards the surface S in both magnets on one side, and down in both magnets on the other side). Since the North-South axis of the two inner magnets is opposite, an area capable of orienting the particles to be substantially parallel to the plane of the OEL is formed between the two magnets and on the axis of rotation, allowing the formation of a protrusion. Further, three nested loop-shaped bodies are formed within the OEL upon rotation around the axis of rotation, caused by the magnetic field lines extending to either side of the outer magnets (forming the two outer loop-shaped bodies upon rotation) and by the field lines of the two inner magnets extending outwards (towards the outer magnets).

FIG. 20 shows an embodiment of a magnetic-field-generating device that is similar to the device of FIG. 15A except for the reduced number of magnets. Accordingly, a separate discussion of the embodiment can be omitted.

In the above rotational embodiments of the magnetic-field-generating device, the magnets are arranged rotatable around an axis of rotation by being fixed radially to a bar extending from the axis of rotation. However, it is of course also possible to achieve a rotational arrangement of magnets differently, e.g. by providing the magnets on a ground plate. In such an arrangement, the magnetic-field-generating device may comprises a plurality of bar dipole magnets provided around an axis of rotation, the magnets on either side of the axis of rotation being two or more bar dipole magnets all having their North-South axis either substantially parallel or perpendicular to the supporting surface or space configured for receiving a substrate, and optionally a bar dipole magnet arranged on the axis of rotation and also having its North-South axis substantially parallel or perpendicular to the supporting surface; respectively, the North-South directions of adjacent magnets pointing in the same or in opposite directions, and the magnets being spaced apart from each other (see FIGS. 23A, 23B, 23D and 23E) or in direct contact with each other [see FIGS. 23C and 23F], the magnets being optionally provided on a ground plate.

FIGS. 23A-23F show illustrative embodiments of such arrangements, which otherwise correspond with regard to the magnet configuration and the respective field lines to some of the other rotational magnetic-field-generating devices described above.

In FIG. 23A, an arrangement of magnets (M) is disposed on a ground plate (GP). Each magnet noteworthy produces an arc-shaped section of magnetic field lines, with areas wherein the field lines run parallel to the plane of the arrangement of magnets between each of the magnets. Rotating said arrangement of magnets (M) around an axis (z) perpendicular to the plane in which the magnets are arranged, dynamically produces an average magnetic field in space, which is capable to orient magnetic or magnetizable particles in a layer.

The magnets (M) in the arrangement of magnets need not to be of the same size, nor equidistant from each other, nor need the resulting nested annular areas of arc-shaped sections of magnetic field lines to have same cross-sections and distances from each other. This of course not only applies to the embodiments shown in FIGS. 23A-23F, but also to all other devices of the present invention, in particular the rotational devices. However, preferably the magnets all have about the same size and about the same distance from each other.

FIG. 24 shows a set of two or more nested annular area magnets (M) of alternate magnetic polarity, which may be disposed on a ground plate (GP). Each pair of North- and South-Poles on the surface of said magnets (M) statically produces a loop-shaped (annular) area of arc-shaped magnetic field lines, capable to orient magnetic or magnetizable particles in a layer, so as to produce nested annular effect image elements of different size.

The static annular areas of arc-shaped magnetic field lines need not to be nested, nor circular, nor of the same size, nor of the same form, nor equidistant from each other. In fact, any form and combination of forms is possible in the static embodiment of the magnetic orienting device.

Figure 25:
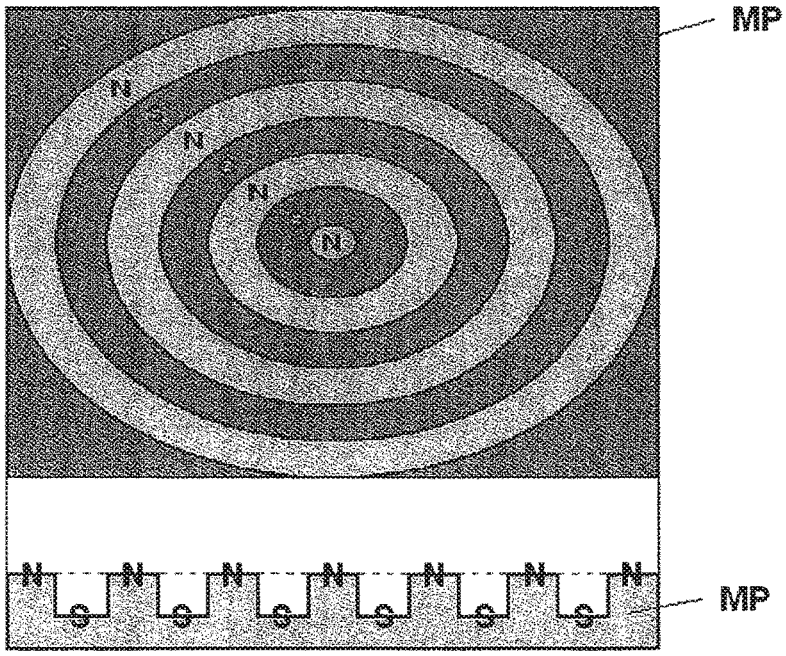
FIG. 25 schematically depicts a further embodiment of a magnetic-field-generating device according to the present invention.

In another embodiment, the present invention relates to a magnetic-field-generating magnetic field generating device comprising a permanent magnetic plate that is magnetized perpendicular to the plane of the plate and having projections and impressions, the projections and impressions being arranged to form nested loop-shaped projections and impressions surrounding a central area, the projections and impressions forming opposite magnetic poles. Such a device is illustrated in FIG. 25 and may be produced by any method that is capable of providing the desired structure, such as by engraving or honing of a permanent magnetic plate, for example by physical means, laser ablation or chemical means. Alternatively, a device is illustrated in FIG. 25 and may be produced by injection molding or by a casting process.

FIG. 25 shows a device having a set of two or more concentrically loop-shaped (annular) magnets, wherein the alternating sequence of magnetic North- and South-poles is produced through the engraving of one of the pole faces of a permanent magnetic plate (MP), magnetized perpendicularly to its extended surface. Such embodiment as engraved permanent-magnetic plate is particularly advantageous in case of non-circular shapes, because an engraving of arbitrary form is easily realized in a permanent-magnetic composite material of a permanent-magnetic powder comprised in a rubber- or plastic-type matrix.

The magnets of the magnetic-field-generating devices described herein may comprise or consist of any permanent-magnetic (hard-magnetic) material, for example of Alnico alloy, barium- or strontium-hexaferrite, cobalt alloys, or rare-earth-iron alloys such as neodymium-iron-boron alloy. Particularly preferred are, however, easily workable permanent-magnetic composite materials that comprise a permanent-magnetic filler, such as strontium-hexaferrite ($SrFe_{12}O_{19}$) or neodymium-iron-boron ($Nd_2Fe_{14}B$) powder, in a plastic- or rubber-type matrix.

Also described herein are rotating printing assemblies comprising the magnetic-field-generating devices for producing the OEL described herein, said magnetic-field-generating devices being fitted and/or inserted on the printing cylinder as a part of the rotating printing machine. In such a case, the magnetic-field-generating device is correspondingly designed and adapted to the cylindrical surface of the rotating unit in order to assure a smooth contact with the surface to be imprinted.

Also described herein are processes for producing the OEL described herein, said processes comprising the steps of:

a) applying on a supporting surface or substrate surface (which may or may not be present on a supporting surface) a coating composition in a first (fluid) state comprising a binder material and a plurality of non-spherical magnetic or magnetizable particles described herein, b) exposing the coating composition in a first state to the magnetic field of a magnetic-field-generating device, preferably one as described hereabove, thereby orienting at least a part of the non-spherical magnetic or magnetizable particles in a plurality of nested loop-shaped areas surrounding one central area such that the longest axis of the particles in each of the cross-sectional areas of the loop-shaped areas follow a tangent of either a negatively curved or a positively curved part of hypothetical ellipses or circles; and c) hardening the coating composition to a second state so as to fix the magnetic or magnetizable non-spherical particles in their adopted positions and orientations.

The applying step a) is preferably a printing process selected from the group consisting of copperplate intaglio printing, screen printing, gravure printing, flexography printing and roller coating and more preferably from the group consisting of screen printing, gravure printing and flexography printing. These processes are well-known to the skilled man and are described for example in Printing Technology, J. M. Adams and P. A. Dolin, Delmar Thomson Learning, $5^{th}$ Edition.

While the coating composition comprising the plurality of non-spherical magnetic or magnetizable particles described herein is still wet or soft enough so that the non-spherical magnetic or magnetizable particles therein can be moved and rotated (i.e. while the coating composition is in a first state), the coating composition is subjected to a magnetic field to achieve orientation of the particles. The step of magnetically orienting the non-spherical magnetic or magnetizable particles comprises a step of exposing the applied coating composition, while it is "wet" (i.e. still liquid and not too viscous, that is, in a first state), to a determined magnetic field generated at or above a supporting surface of the magnetic-field-generating device described herein, thereby orienting the non-spherical magnetic or magnetizable particles along the field lines of the magnetic field such as to form an orientation pattern in loop-shape. In this step, the coating composition is brought sufficiently close to or in contact with the supporting surface of the magnetic-field-generating device.

When bringing the coating composition close to the supporting surface of the magnetic-field-generating device and the loop-shaped element is to be formed on one side of a substrate, the side of the substrate carrying the coating composition may face the supporting side of the device, or the side of the substrate not carrying the coating composition may face the supporting side. In the event that the coating composition is applied onto only one surface of the substrate or is applied on both sides, and a side on which the coating composition is applied is oriented such as to face the supporting surface of the device, it is preferred that no direct contact with the supporting surface is established (the substrate is only brought sufficiently close to, but not in contact with, the supporting surface of the device).

Noteworthy, the coating composition may practically be brought into contact with the supporting surface of the magnetic-field-generating device. Alternatively, a tiny air gap, or an intermediate separating layer may be provided. In a further and preferred alternative, the method may be performed such that the substrate surface not carrying the coating composition may be brought close to or in direct contact with the one or more magnet (i.e. the magnet(s) form the supporting surface).

If desired, a primer layer may be applied to the substrate prior to the step a). This may enhance the quality of a magnetically transferred particle orientation image or promote adhesion. Examples of such primer layers may be found in WO 2010/058026 A2.

The step of exposing the coating composition comprising the binder material and the plurality of non-spherical magnetic or magnetizable particles to a magnetic field (step b)) can be performed either simultaneously with the step a) or subsequently to the step a). That is, steps a) and b) may be performed simultaneously or subsequently.

The processes for producing the OEL described herein comprise, concomitantly to step (b) or subsequently to step (b), a step of hardening (step c)) the coating composition so as to fix the non-spherical magnetic or magnetizable particles in their adopted positions and orientations, thereby transforming the coating composition to a second state. By this fixing, a solid coating or layer is formed. The term "hardening" refers to processes including the drying or solidifying, reacting, curing, cross-linking or polymerizing the binder components in the applied coating composition, including an optionally present cross-linking agent, an optionally present polymerization initiator, and optionally present further additives, in such a manner that an essentially solid material that strongly adheres to the substrate surface is formed. As mentioned hereabove, the hardening step (step c)) may be performed by using different means or processes depending on the binder material comprised in the coating composition that also comprises the plurality of non-spherical magnetic or magnetizable particles.

The hardening step generally may be any step that increases the viscosity of the coating composition such that a substantially solid material adhering to the supporting surface is formed. The hardening step may involve a physical process based on the evaporation of a volatile component, such as a solvent, and/or water evaporation (i.e. physical drying). Herein, hot air, infrared or a combination of hot air and infrared may be used. Alternatively, the hardening process may include a chemical reaction, such as a curing, polymerizing or cross-linking of the binder and optional initiator compounds and/or optional cross-linking compounds comprised in the coating composition. Such a chemical reaction may be initiated by heat or IR irradiation as outlined above for the physical hardening processes, but may preferably include the initiation of a chemical reaction by a radiation mechanism including without limitation Ultraviolet-Visible light radiation curing (hereafter referred as UV-Vis curing) and electronic beam radiation curing (E-beam curing); oxypolymerization (oxidative reticulation, typically induced by a joint action of oxygen and one or more catalysts, such as cobalt-containing and manganese-containing catalysts); cross-linking reactions or any combination thereof.

Radiation curing is particularly preferred, and UV-Vis light radiation curing is even more preferred, since these technologies advantageously lead to very fast curing processes and hence drastically decrease the preparation time of any article comprising the OEL described herein. Moreover, radiation curing has the advantage of producing an instantaneous increase in viscosity of the coating composition after exposure to the curing radiation, thus minimizing any further movement of the particles. In consequence, any loss of information after the magnetic orientation step can essentially be avoided. Particularly preferred is radiation-curing by photo-polymerization, under the influence of actinic light having a wavelength component in the UV or blue part of the electromagnetic spectrum (typically 300 nm to 550 nm; more preferably 380 nm to 420 nm; "UV-visible-curing"). Equipment for UV-visible-curing may comprise a high-power light-emitting-diode (LED) lamp or an arc discharge lamp, such as a medium-pressure mercury arc (MPMA) or a metal-vapor arc lamp, as the source of the actinic radiation. The hardening step (step c)) can be performed either simultaneously with the step b) or subsequently to the step b). However, the time from the end of step b) to the beginning of step c) is preferably relatively short in order to avoid any de-orientation and loss of information. Typically, the time between the end of step b) and the beginning of step c) is less than 1 minutes, preferably less than 20 seconds, further preferably less than 5 seconds, even more preferably less than 1 second. It is particularly preferable that there is essentially no time gap between the end of the orientation step b) and the beginning of the hardening step c), i.e. that step c) follows immediately after step b) or already starts while step b) is still in progress.

As outlined above, step (a) (application on the supporting surface, or preferably substrate surface on a supporting surface formed by a magnet or plate) can be performed either simultaneously with the step b) or previously to the step b) (orientation of particles by a magnetic field), and also step c) (hardening) can be performed either simultaneously with the step b) or subsequently to the step b) (orientation of particles by a magnetic field). While this may also be possible for certain types of equipment, typically not all three steps a), b) and c) are performed simultaneously. Also, steps a) and b), and steps b) and c) may be performed such that they are partly performed simultaneously (i.e. the times of performing each of the steps partly overlap, so that e.g. the hardening step c) is started at the end of the orientation step b).

With the aim of increasing the durability through soiling or chemical resistance and cleanliness and thus the circulation lifetime of security documents, or with the aim of modifying their aesthetical appearance (e.g. optical gloss), one or more protective layers may be applied on top of OEL. When present, the one or more protective layers are typically made of protective varnishes. These may be transparent or slightly colored or tinted and may be more or less glossy. Protective varnishes may be radiation curable compositions, thermal drying compositions or any combination thereof. Preferably, the one or more protective layers are radiation curable compositions, more preferable UV-Vis curable compositions. The protective layers may be applied after the formation of the OEL in step c).

The above processes allow obtaining a substrate carrying an OEL comprising nested loop-shaped areas that are able to provide the optical appearance or optical impression of nested loop-shaped bodies surrounding one central area, wherein, in a cross sectional view perpendicular to the plane of the OEL and extending from the centre of the central area, the orientation of the non-spherical magnetic or magnetizable particles present in the closed loop-shaped areas each follow either the negatively curved part (see FIG. 1B) or the positively curved part (see FIG. 1C) of the surface of respective hypothetical semi-toroidal bodies lying in the plane of the OEL, depending upon whether the magnetic field of the magnetic-field-generating device is applied from below or from above to the layer of coating composition comprising the non-spherical magnetic or magnetizable particles. Further, depending on the type of equipment used, the central area surrounded by the loop-shaped bodies can comprise a so-called "protrusion", i.e. an area that comprises the magnetic or magnetizable particles in an orientation that is substantially parallel to the substrate surface. In such embodiments, the orientation changes towards the surrounding loop-shaped body, following either a negative or a positive curve when seen from a cross-section extending from the center of the central area to the closed shape body in loop shape. Between the innermost closed loop-shaped body and the "protrusion", there is preferably an area in which the particles are oriented substantially perpendicular to the substrate surface, showing no or only little reflectivity.

This is particularly useful in applications where the OEL is formed from an ink, e.g. a security ink, or some other coating material, and is permanently disposed on a substrate like a security document, e.g. by way of printing as described above.

In the processes described above and when the OEL is to be provided on a substrate, said OEL may be provided directly on a substrate surface on which it shall remain permanently (such as for banknote applications). However, in an alternative embodiment of the present invention, the OEL may also be provided on a temporary substrate for production purposes, from which the OEL is subsequently removed. This may for example facilitate the production of the OEL, particularly while the binder material is still in its fluid state. Thereafter, after hardening the coating composition for the production of the OEL, the temporary substrate may be removed from the OEL. Of course, in such cases the coating composition must be in a form that is physically integral after the hardening step, such as for instances in cases where a plastic-like or sheet-like material is formed by the hardening. Thereby, a film-like transparent and/or translucent material consisting of the OEL as such (i.e. essentially consisting of oriented magnetic or magnetizable particles having non-isotropic reflectivity, hardened binder components for fixing the particles in their orientation and forming a film-like material, such as a plastic film, and further optional components) can be provided.

Alternatively, in another embodiment the substrate may comprise an adhesive layer on the side opposite the side where the OEL is provided, or an adhesive layer can be provided on the same side as the OEL and on top of the OEL, preferably after the hardening step has been completed. In such instances, an adhesive label comprising the adhesive layer and the OEL is formed. Such a label may be attached to all kinds of documents or other articles or items without printing or other processes involving machinery and rather high effort.

According to one embodiment, the OEC is manufactured in the form of a transfer foil, which can be applied to a document or to an article in a separate transfer step. To this aim, the substrate is provided with a release coating, on which an OEL is produced as described herein. One or more adhesive layers may be applied over the so produced OEL.

The term "substrate" is used to denote a material on which a coating composition can be applied. Typically, a substrate is in sheet like form and has a thickness not exceeding 1 mm. preferably not exceeding 0.5 mm, further preferably not exceeding 0.2 mm. The substrate described herein is preferably selected from the group consisting of papers or other fibrous materials, such as cellulose, paper-containing materials, glasses, ceramics, plastics and polymers, glasses, composite materials and mixtures or combinations thereof. Typical paper, paper-like or other fibrous materials are made from a variety of fibers including without limitation abaca, cotton, linen, wood pulp, and blends thereof. As is well known to those skilled in the art, cotton and cotton/linen blends are preferred for banknotes, while wood pulp is commonly used in non-banknote security documents. Typical examples of plastics and polymers include polyolefins such as polyethylene (PE) and polypropylene (PP), polyamides, polyesters such as poly(ethylene terephthalate) (PET), poly(1,4-butylene terephthalate) (PBT), poly(ethylene 2,6-naphthoate) (PEN) and polyvinylchlorides (PVC). Spunbond olefin fibers such as those sold under the trademark Tyvek® may also be used as substrate. Typical examples of composite materials include without limitation multilayer structures or laminates of paper and at least one plastic or polymer material such as those described hereabove as well as plastic and/or polymer fibers incorporated in a paper-like or fibrous material such as those described hereabove. Of course, the substrate can comprise further additives that are known to the skilled person, such as sizing agents, whiteners, processing aids, reinforcing or wet strengthening agents etc.

According to one embodiment of the present invention, the optical effect layer coated substrate (OEC) comprises more than one OEL on the substrate described herein, for example it may comprise two, three, etc. OELs. Herein, one, two or more OELs may be formed using several same magnetic-field-generating devices, or may be formed by using several magnetic-field-generating devices.

The OEC may comprise a first OEL and a second OEL, wherein both of them are present on the same side of the substrate or wherein one is present on one side of the substrate and the other one is present on the other side of the substrate. If provided on the same side of the substrate, the first and the second OEL may be adjacent or not adjacent to each other. Additionally or alternatively, one of the OELs may partially or fully superimpose the other OEL.

If more than one magnetic-field-generating device is used for producing a plurality of OELs, the magnetic-field-generating devices for orienting the plurality of non-spherical magnetic or magnetizable particles for producing one OEL and the magnetic-field-generating device for producing another OEL may be placed either i) on the same side of the substrate, so as to produce two OELs exhibiting either exhibiting a negatively curved part (see FIG. 1*b*) or a positively curved part (see FIG. 1*c*), or ii) on opposite sides of the substrate so as to have one OEL exhibiting a negatively curved and the other exhibiting positively curved part. The magnetic orientation of the non-spherical magnetic or magnetizable particles for producing the first OEL and the non-spherical magnetic or magnetizable particles for producing the second OEL may be performed simultaneously or sequentially, with or without intermediate hardening or partial hardening of the binder material.

With the aim of further increasing the security level and the resistance against counterfeiting and illegal reproduction of security documents, the substrate may comprise printed, coated, or laser-marked or laser-perforated indicia, watermarks, security threads, fibers, planchettes, luminescent compounds, windows, foils, decals and combinations thereof. With the same aim of further increasing the security level and the resistance against counterfeiting and illegal reproduction of security documents, the substrate may comprise one or more marker substances or taggants and/or machine readable substances (e.g. luminescent substances, UV/visible/IR absorbing substances, magnetic substances and combinations thereof).

The OEL described herein may be used for decorative purposes as well as for protecting and authenticating a security document.

The present invention also encompasses articles and decorative objects comprising the OEL described herein. The articles and decorative objects may comprise more than one optical effect layers described herein. Typical examples of articles and decorative objects include without limitation luxury goods, cosmetic packaging, automotive parts, electronic/electrical appliances, furnitures, etc.

An important aspect of the present invention relates to security documents comprising the OEL described herein. The security document may comprise more than one optical effect layers described herein. Security documents include without limitation value documents and value commercial goods. Typical example of value documents include without limitation banknotes, deeds, tickets, checks, vouchers, fiscal stamps and tax labels, agreements and the like, identity documents such as passports, identity cards, visas, driving licenses, bank cards, credit cards, transactions cards, access documents or cards, entrance tickets, public transportation tickets or titles and the like. The term "value commercial good" refers to packaging materials, in particular for pharmaceutical, cosmetics, electronics or food industry, that shall be protected against counterfeiting and/or illegal reproduction in order to warrant the content of the packaging like for instance genuine drugs. Examples of these packaging materials include without limitation labels, such as authentication brand labels, tamper evidence labels and seals.

Preferably, the security document described herein is selected from the group consisting of banknotes, identity documents, right-conferring documents, driving licenses, credit cards, access cards, transportation titles, bank checks and secured product labels. Alternatively, the OEL may be produced onto an auxiliary substrate such as for example a security thread, security stripe, a foil, a decal, a window or a label and consequently transferred to a security document in a separate step.

The skilled person can envisage several modifications to the specific embodiments described above without departing from the spirit of the present invention. Such modifications are encompasses by the present invention.

Further, all documents referred to throughout this specification are hereby incorporated by reference in their entirety as set forth in full herein.

The present invention will now be described further by way of examples. However, the examples are not intended to limit the scope of the invention in any way.

EXAMPLES

Example 1

A magnetic-field-generating device according to FIG. 3A was used to orient non-spherical optically variable magnetic pigments in a printed layer of a UV-curable screen printing ink on a black paper as the substrate.

The ink had the following formula:

| | |
|---|---|
| Epoxyacrylate oligomer | 40% |
| Trimethylolpropane triacrylate monomer | 10% |
| Tripropyleneglycol diacrylate monomer | 10% |
| Genorad 16 (Rahn) | 1% |
| Aerosil 200 (Evonik) | 1% |
| Irgacure 500 (BASF) | 6% |
| Genocure EPD (Rahn) | 2% |
| Non-spherical optically variable magnetic pigments (7 layers) (*) | 20% |
| Dowanol PMA | 10% |

A magnetic-field generating device according to FIG. 3A was used to orient optically variable magnetic pigments in a printed layer of a UV-curable screen printing ink according to the formula of Example 1 on a black paper as the substrate.

The magnetic-field-generating device comprised a ground plate of soft-magnetic iron, an axially magnetized annular permanent magnet of strontium-hexaferrite-loaded plastoferrite of inner diameter 15 mm, outer diameter 19 mm, and thickness 4 mm, and a cylinder-shaped yoke of soft-magnetic iron, of diameter 6 mm and thickness 4 mm, disposed in the center of the annular permanent magnet.

The paper substrate carrying the printed layer of a UV-curable screen printing ink was disposed at a distance of 1 mm from the magnetic pole of the annular permanent magnet and the iron yoke. The so obtained magnetic orientation pattern of the optically variable pigments was, subsequently to the applications step, fixed by UV-curing the printed layer comprising the pigments.

The resulting magnetic orientation image is given in FIG. 3B, under three different views, illustrating the viewing-angle dependent change of the image.

Example 2

A magnetic-field-generating device according to FIG. 6D was used to orient optically variable magnetic pigments in a printed layer of a UV-curable screen printing ink according to the formula of Example 1 on a black paper as the substrate.

The magnetic-field-generating device comprised a ground plate of soft-magnetic iron, on which an axially magnetized NdFeB permanent magnetic disk of 6 mm diameter and 1 mm thickness was disposed, with the magnetic South Pole on the soft-magnetic ground plate. A rotationally symmetric, U-shaped soft-magnetic iron yoke of 10 mm external diameter, 8 mm internal diameter, and 1 mm depth was disposed on the magnetic North pole of the permanent magnetic disk. A second axially magnetized NdFeB permanent magnetic disk of 6 mm diameter and 1 mm thickness was disposed in the center of the rotationally symmetric, U-shaped soft-magnetic iron yoke with the magnetic South Pole on the soft-magnetic iron yoke.

The paper substrate carrying the printed layer of a UV-curable screen printing ink comprising optically variable magnetic pigments was disposed immediately on the magnetic pole of the second permanent magnet disk and the iron yoke. The so obtained magnetic orientation pattern of the optically variable pigment particles was, subsequently to the applications step, fixed by UV-curing the printed layer comprising the pigments.

The resulting magnetic orientation image is given in FIG. 6E, under three different views, illustrating the viewing-angle dependent change of the image.

Example 3

A magnetic-field-generating device according to FIG. 24 was used to orient optically variable magnetic pigments in a printed layer of a UV-curable screen printing ink according to the formula of Example 1 on a black paper as the substrate.

The magnetic-field-generating device comprised a non-magnetic ground plate, and disposed on said ground-plate, a series of four nested, axially magnetized annular permanent magnets of strontium-hexaferrite-loaded plastoferrite, with an axially magnetized cylindrical permanent magnet of strontium-hexaferrite-loaded plastoferrite in the center. All magnetic rings are 4 mm high and 2 mm thick, the magnetic cylinder is 4 mm high and has a diameter of 3 mm, and the interstice between all magnets is 2 mm. The magnetic North and South Poles of the magnets are disposed in alternating sequence.

The paper substrate carrying the printed layer of a UV-curable screen printing ink comprising optically variable magnetic pigments was disposed immediately on the poles of the magnets. The so obtained magnetic orientation pattern of the optically variable pigment particles was, subsequently to the applications step, fixed by UV-curing the printed layer comprising the pigments.

The resulting magnetic orientation image is given in FIG. 24, under three different views, illustrating the viewing-angle dependent change of the image.

Example 4

A magnetic-field-generating device according to FIG. 15A was used to orient optically variable magnetic pigments in a printed layer of a UV-curable screen printing ink according to the formula of Example 1 on a black paper as the substrate.

The magnetic-field-generating device comprised a linear sequence of six NdFeB permanent magnets, each of dimensions 3×3×3 mm, mounted together on a rotate-able non-magnetic ground plate. The interstices between the permanent magnets were 1 mm large. The magnetic axes of the magnets were all aligned in the same sense along the direction of the linear sequence of magnets, resulting in a NS—NS—NS—NS—NS—NS linear arrangement.

In a first embodiment, the paper substrate carrying the printed layer of a UV-curable screen printing ink comprising optically variable magnetic pigments was disposed immediately over the magnetic poles of the magnets, and the rotate-able non-magnetic ground plate carrying the linear sequence of magnets was rapidly rotated so as to produce an average magnetic field for orienting the particles. The so obtained magnetic orientation pattern of the optically variable pigment pigments was, subsequently to the applications step, fixed by UV-curing the printed layer comprising the pigments. The resulting magnetic orientation images are given in FIG. 15B under three different views, illustrating the viewing-angle dependent change of the image.

In a second embodiment, the paper substrate carrying the printed layer of a UV-curable screen printing ink comprising optically variable magnetic pigments was disposed at a distance of 1.5 mm from the magnetic poles of the magnets, resulting in a slightly different annular effect image. The resulting magnetic orientation images are given in FIG. 15C under three different views, illustrating the viewing-angle dependent change of the image.

What is claimed:

1. A magnetic field-generating device comprising a plurality of elements selected from magnets and pole pieces and comprising at least one magnet, the plurality of elements being either (i) located below a supporting surface or a space configured to receive a substrate acting as supporting surface or (ii) forming a supporting surface, and being configured such as to be capable of providing a magnetic field wherein magnetic field lines run substantially parallel to said supporting surface or space in two or more areas above said supporting surface or space, and wherein i) the two or more areas form nested loop-shaped areas surrounding a central area; and/or ii) the plurality of elements comprise a plurality of magnets, and the magnets are arranged rotatable around an axis of rotation such that the areas with field lines running substantially parallel to the supporting surface or space combine upon rotation around the axis of rotation, thereby forming, upon rotation around the axis of rotation, a plurality of nested loop-shaped areas surrounding one central area.

2. The magnetic field-generating device according to claim 1, option ii), wherein the magnets are arranged such that in an area; which is above said supporting surface or space and which is centered on the axis of rotation, a magnetic field with field lines running substantially parallel to the plane of magnets is generated.

3. The magnetic field-generating device according to claim 1, option i), wherein the two or more areas of parallel field lines; which form the nested loop-shaped areas surrounding a central area, are caused by an arrangement of a plurality of elements selected from magnets and pole pieces, at least one of said elements having a loop-shaped form corresponding to the loop-shaped area with parallel field lines above the supporting surface or space.

4. The magnetic field-generating device according to claim 3, wherein the arrangement of a plurality of elements selected from magnets and pole pieces comprises at least one loop-shaped magnet having its magnetic axis substantially perpendicular to said supporting surface or space, which arrangement further contains a pole piece having a loop-shaped form, the loop-shaped magnet and the looped shaped pole piece surrounding a central area in a nested manner.

5. The magnetic-field-generating device according to claim 4, wherein the central area comprises a bar dipole magnet having its magnetic axis substantially perpendicular to said supporting surface or space or a central pole piece, and wherein the pole piece and that magnet are arranged in alternating manner starting from the central area.

6. The magnetic field-generating device according to claim 1, option ii), wherein the plurality of magnets are arranged symmetrically around the axis of rotation and have their magnetic axis substantially parallel or substantially perpendicular to the supporting surface or space.

7. The magnetic-field-generating device according to claim 1, which is selected from the group consisting of the following:

a) a magnetic-field-generating device, wherein a loop-shaped axially magnetized dipole magnet is provided such that the North-South axis is perpendicular to the supporting surface or space, wherein the loop-shaped magnet surrounds a central area, and the device further comprises a pole piece that is provided below the loop-shaped axially magnetized dipole magnet with respect to the supporting surface or the space and that closes one side of the loop formed by the loop-shaped magnet, and wherein the pole piece forms one or more projections extending into the space surrounded by the loop-shaped magnet and being spaced apart therefrom, wherein a1) the pole piece forms one projection that extends into the central area surrounded by the loop-shaped magnet, wherein the projection is laterally spaced apart from the loop-shaped magnet and fills a part of the central area;

a2) the pole piece forms one loop-shaped projection and surrounds a central bar dipole magnet having the same North-South direction as the loop-shaped magnet, the projection and the bar dipole magnet being spaced apart from each other, or a3) the pole piece forms two or more spaced-apart projections, either all of these or all but one of these are loop-shaped, and, depending on the number of projections, one or more additional axially magnetized loop shaped magnets having the same North South direction as the first axially magnetized loop-shaped magnet is/are provided in the space formed between the spaced-apart loop-shaped projections, the additional magnets being spaced apart from the loop-shaped projections; and wherein the central area surrounded by the loop-shaped projections and the loop-shaped magnets is partly filled with either a central bar dipole magnet having the same North-South direction as the surrounding loop-shaped magnets or with a central projection of the pole piece, such that, as viewed from the supporting surface or the space, an alternating arrangement of spaced-apart loop-shaped pole piece projections and loop-shaped axially magnetized dipole magnets is formed, surrounding one central area, wherein the central area is filled either with a bar dipole magnet or a central projection as set out above;

b) a magnetic-field-generating device, comprising two or more bar dipole magnets and two or more pole pieces, wherein the device comprises an equal number of pole pieces and bar dipole magnets, wherein the bar dipole magnets have their North-South axis substantially perpendicular to the supporting surface or space, have the same North-South direction and are provided in different distances from the supporting surface or space, along one line extending perpendicular from the supporting surface or space, and spaced apart from each other; and the pole pieces being provided in the space between the bar dipole magnets and in contact therewith, wherein the pole pieces form one or more projections which, in loop-shaped form, surrounds a central area in which the bar dipole magnet located next to the supporting surface or space is located;

c) a magnetic-field-generating device, comprising one bar dipole magnet located below the supporting surface or space and having its North-South direction perpendicular to said supporting surface or space, one or more loop-shaped pole pieces arranged above the magnet and below the supporting surface or space, which, for a plurality of loop-shaped pole pieces, are arranged spaced apart and coplanar nested, the one or more pole pieces laterally surrounding a central area under which the magnet is located, the device further comprising a first plate-like pole piece having about the same size and about the same outer peripheral shape as the outermost loop-shaped pole piece, the plate-like pole piece being arranged below the magnet such that its outer peripheral shape is superimposed with the periphery of outermost of the loop-shaped pole pieces in direction from the supporting surface or space, and which is in contact with one of the poles of the magnet; and a central pole piece in contact with the respectively other pole of the magnet, the central pole piece having the outer peripheral shape of a loop, partly filling the central area and being laterally and spaced apart from and surrounded by the one or more loop-shaped pole pieces;

d) a magnetic-field-generating device according to item c) above, wherein a second plate like pole piece having the outer peripheral shape of a loop is provided at a position above and in contact with one pole of the magnet and below and in contact with the one or more loop-shaped pole pieces and below and in contact with the central pole piece, so that the central pole piece is no longer in direct contact with the pole of the magnet, the second plate-like pole piece being of about the same size and shape as the first plate-like pole piece;

e) a magnetic-field-generating device, wherein two or more bar dipole magnets are arranged below the supporting surface or space and such as to be rotatable around an axis of rotation that is perpendicular to the supporting surface or space, the two or more bar dipole magnets being spaced apart from the axis of rotation and from each other and provided symmetrically on opposite sides of the axis of rotation, the device optionally further comprising one bar dipole magnet that is arranged below the supporting surface or space and on the axis of rotation, wherein either e1) the device comprises, on either side of the axis of rotation, one or more bar dipole magnets all having their North-South axis substantially perpendicular to the supporting surface or space and substantially parallel to the axis of rotation, the North-South direction of all magnets being identical with respect to the supporting surface or space, and the magnets being spaced apart from each other, the device optionally comprising one bar dipole magnet that is arranged below the supporting surface or space and on the axis of rotation, the North-South axis thereof being substantially perpendicular to the supporting surface or space and substantially parallel to the axis of rotation, and the North-South direction of which is either identical to the North South direction of the magnets that are arranged rotatable around the axis and spaced apart therefrom or opposite thereto;

e2) no optional bar dipole magnet on the axis of rotation is present and the device comprises, on either side of the axis of rotation, two or more bar dipole magnets arranged spaced apart from each other and from the axis of rotation, the North-South axis of the magnets being substantially perpendicular to the supporting surface or space and substantially parallel to the axis of rotation, and wherein the magnets provided on either side of the axis have alternating North-South directions, and the innermost magnets with regard to the axis of rotation either have the same or opposite North-South directions;

e3) no optional bar dipole magnet on the axis of rotation is present and the device comprises, on either side of the axis of rotation, two or more bar dipole magnets arranged spaced apart from each other and from the axis of rotation, the North-South axis of the magnets being substantially perpendicular to the supporting surface or space and substantially parallel to the axis of rotation, and wherein the magnets provided on either side of the axis have the same North-South direction and the magnets provided on different sides of the axis of rotation have opposite North-South directions;

e4) the device comprises, on either side of the axis of rotation, one or more bar dipole magnets that are arranged spaced apart from the axis of rotation and, if more than one magnet is present on one side, spaced apart from each other, the North-South axis of the magnets being substantially parallel to the supporting surface or space and substantially radial to the axis of rotation, and the North-South directions of the magnets being arranged such that the North-South directions of all magnets point essentially in the same direction, wherein further either e4-1) no optional magnet is provided on the axis of rotation and at least two magnets are provided on either side of the axis of rotation; or e4-2) an optional magnet is provided on the axis of rotation, the magnets on either side being arranged spaced apart therefrom, the magnet on the axis of rotation being a bar dipole magnet having its North-South axis substantially parallel to the supporting surface and its North-South direction pointing in the same direction as the other magnets provided on either side of the axis or rotation;

e5) the device comprises no optional magnet provided on the axis of rotation and comprises, on either side of the axis of rotation, two or more bar dipole magnets that are arranged spaced apart from the axis of rotation and spaced apart from each other, the North-South axis of the magnets being substantially parallel to the supporting surface or space and substantially radial to the axis of rotation, wherein the North-South directions of all magnets are symmetrical with respect to the axis of rotation (i.e. all pointing towards or away from the axis of rotation);

e6) the device comprises no optional magnet provided on the axis of rotation and comprises, on either side of the axis of rotation, one or more pairs of bar dipole magnets that are arranged spaced apart from the axis of rotation and spaced apart from each other, the North-South axis of all magnets being substantially parallel to the supporting surface or space and substantially radial to the axis of rotation, and each pair of magnets being formed by two magnets with opposite North-South directions pointing towards each other or away from each other, respectively, and wherein the innermost magnets of the innermost pairs of magnets on either side have either e6-1) symmetric North South directions with respect to the axis of rotation, both pointing either away or towards the axis of rotation; or e6-2) asymmetric North-South direction with respect to the axis of rotation, one pointing away and one towards the axis of rotation; or e-7) the device either e7-1) comprises the optional bar dipole magnet on the axis of rotation and one or more magnets on either side of the axis of rotation, the North-South axis of all magnets being substantially parallel to the supporting surface and the North-South axis of the magnets on either side of the axis of rotation is essentially radial to the axis of rotation; or e7-2) the device does not comprise the optional bar dipole magnet on the axis of rotation and comprises two or more magnets on either side of the axis of rotation that are arranged spaced apart from the axis of rotation, the Noah-South axis of all magnets being substantially parallel to the supporting surface or space and substantially radial to the axis of rotation, wherein in both instances the North-South directions of the magnets arranged on one side of the axis of rotation are asymmetric to the North-South directions of the magnets arranged on the other side of the axis of rotation with respect to the axis of rotation (i.e. pointing towards the axis of rotation on one side and away from the axis of rotation on the other side), such that the North-South directions are in line from the outermost magnet on one side to the outermost magnet on the other side, the magnet on the axis of rotation in case e7-1 being aligned in this line;

e8) the device comprises, on either side of the axis of rotation two or more bar dipole magnets all having their North-South axis substantially perpendicular to the supporting surface or space and substantially parallel to the axis of rotation, and optionally a bar dipole magnet arranged on the axis of rotation and also having its North-South axis substantially perpendicular to the supporting surface or space and substantially parallel to the axis of rotation;

the North-South direction of adjacent magnets being opposite with respect to the supporting surface or space, and the magnets being spaced apart from each other; or e9) the device comprises, on either side of the axis of rotation two or more bar dipole magnets all having their North-South axis substantially parallel to the supporting surface or space and substantially radial to the axis of rotation, and optionally a bar dipole magnet arranged on the axis of rotation and also having its North-South axis substantially parallel to the supporting surface or space and substantially perpendicular to the axis of rotation; the North-South directions of adjacent magnets pointing in opposite directions, and the magnets being spaced apart from each other;

f) a magnetic-field-generating device, wherein two or more loop-shaped dipole magnets are provided such that their North-South axis are perpendicular to the supporting surface or space, the two or more loop-shaped magnets being arranged nested, spaced apart and surrounding one central area, the magnets being axially magnetized, and adjacent loop-shaped magnets have opposite North-South directions pointing either to or away from the supporting surface or space, the device further comprising a bar dipole magnet provided in the central area surrounded by the loop-shaped magnets, the bar dipole magnet having its North South axis substantially perpendicular to the supporting surface and parallel to the North-South axis of the loop-shaped magnets, the North-South direction of the bar dipole magnet being opposite to the North-South direction of the innermost loop-shaped magnet, the device optionally further comprising a pole piece on the side opposite to the supporting surface or space and in contact with the central bar dipole magnet and the loop-shaped magnets;

g) a magnetic-field-generating device, comprising a permanent magnetic plate that is magnetized perpendicular to the plane of the plate and having projections and impressions, the projections and impressions being arranged to form nested loop-shaped projections and impressions surrounding a central area, the projections and impressions forming opposite magnetic poles; and h) a magnetic-field-generating device which comprises a plurality of bar dipole magnets provided around an axis of rotation, the magnets on either side of the axis of rotation being two or more bar dipole magnets all having their North-South axis either substantially parallel or perpendicular to the supporting surface or space, and optionally a bar dipole magnet arranged on the axis of rotation and also having its North-South axis substantially parallel or perpendicular to the supporting surface; respectively, the North-South directions of adjacent magnets pointing in the same or in opposite directions, and the magnets being spaced apart from each other or in direct contact with each other, the magnets optionally being provided on a ground plate.

8. A printing assembly comprising:

the magnetic-field-generating devices recited in claim 1 being arranged to produce in two or more areas above a supporting surface or a space configured to receive the substrate acting as the supporting surface a magnetic field with magnetic field lines running substantially parallel to the supporting surface or the space, whereby the two or more areas are formed as nested loop-shaped areas surrounding a central area, wherein the magnetic-field-generating device are configured in one of a fixed and a rotating printing assembly.

9. A method for forming an optical effect layer (OEL), comprising:

arranging the magnetic-field-generating devices recited in claim 1 to produce in two or more areas above a supporting surface or a space configured to receive the substrate acting as the supporting surface a magnetic field with magnetic field lines running substantially parallel to the supporting surface or the space, whereby the two or more areas form nested loop-shaped areas surrounding a central area.

* * * * *